US008827797B2

(12) United States Patent
Okada et al.

(10) Patent No.: US 8,827,797 B2
(45) Date of Patent: Sep. 9, 2014

(54) GAMING MACHINE AND GAMING METHOD

(71) Applicant: Aruze Gaming (Hong Kong) Limited, Hong Kong (HK)

(72) Inventors: Kazuo Okada, Hong Kong (HK); Kenta Kitamura, Tokyo (JP); Masumi Fujisawa, Tokyo (JP); Ryosuke Takahashi, Tokyo (JP); Tatsuya Teranishi, Tokyo (JP)

(73) Assignee: Aruze Gaming (Hong Kong) Limited, Hong Kong (HK)

( * ) Notice: Subject to any disclaimer, the term of this patent is extended or adjusted under 35 U.S.C. 154(b) by 116 days.

(21) Appl. No.: 13/625,179

(22) Filed: Sep. 24, 2012

(65) Prior Publication Data

US 2014/0087817 A1 Mar. 27, 2014

(51) Int. Cl.
*G07F 17/32* (2006.01)

(52) U.S. Cl.
USPC ..... 463/20; 463/16; 463/25; 463/31

(58) Field of Classification Search
USPC ..... 463/16, 20, 31
IPC ..... G07F 17/32
See application file for complete search history.

(56) References Cited

U.S. PATENT DOCUMENTS

| | | | | |
|---|---|---|---|---|
| 6,315,663 | B1 * | 11/2001 | Sakamoto | 463/20 |
| 2003/0211881 | A1 * | 11/2003 | Walker et al. | 463/20 |
| 2011/0092288 | A1 * | 4/2011 | Pryzby et al. | 463/35 |

* cited by examiner

*Primary Examiner* — Omkar Deodhar
(74) *Attorney, Agent, or Firm* — Lexyoume IP Meister, PLLC

(57) ABSTRACT

In a gaming machine, a speaker outputs music at a predetermined time when it is determined that a result of a game satisfies a predetermined condition. A memory stores a program corresponding to a data sheet including a plurality of rows and a plurality of columns. The plurality of columns include a reel field being predefined to be associated with the reels and including a command for controlling the reels and a trigger field including a triggering condition for executing a command of a corresponding row in synchronization with the music. A controller determines the result of the game. Each time any one of a plurality of triggering conditions for a plurality of rows is satisfied, the controller controls the reels according to a command of a row having the satisfied triggering condition.

12 Claims, 69 Drawing Sheets

FIG.6

| | 1st REEL | 2nd REEL | 3rd REEL | 4th REEL | 5th REEL |
|---|---|---|---|---|---|
| CODE | SYMBOL | SYMBOL | SYMBOL | SYMBOL | SYMBOL |
| 00 | BAR | 2BAR | BAR | 2BAR | BAR |
| 01 | BLANK | BLANK | BLANK | BLANK | BLANK |
| 02 | 7 | 7 | 7 | 7 | 7 |
| 03 | BLANK | BLANK | BLANK | BLANK | BLANK |
| 04 | 3BAR | 3BAR | 3BAR | 3BAR | 3BAR |
| 05 | BLANK | BLANK | BLANK | BLANK | BLANK |
| 06 | BAR | 2BAR | BAR | 2BAR | BAR |
| 07 | BLANK | BLANK | BLANK | BLANK | BLANK |
| 08 | 2BAR | BAR | 2BAR | BAR | 2BAR |
| 09 | BLANK | BLANK | BLANK | BLANK | BLANK |
| 10 | 3BAR | 3BAR | CHANCE | 3BAR | 3BAR |
| 11 | BLANK | BLANK | BLANK | BLANK | BLANK |
| 12 | 2BAR | BAR | 2BAR | BAR | 2BAR |
| 13 | BLANK | BLANK | BLANK | BLANK | BLANK |
| 14 | 7 | 7 | 7 | 7 | 7 |
| 15 | BLANK | BLANK | BLANK | BLANK | BLANK |
| 16 | 2BAR | BAR | 2BAR | BAR | 2BAR |
| 17 | BLANK | BLANK | BLANK | BLANK | BLANK |
| 18 | BAR | 2BAR | BAR | 2BAR | BAR |
| 19 | BLANK | BLANK | BLANK | BLANK | BLANK |
| 20 | 7 | 7 | 7 | 7 | 7 |
| 21 | BLANK | BLANK | BLANK | BLANK | BLANK |

FIG.7

| | 1st REEL | 2nd REEL | 3rd REEL | 4th REEL | 5th REEL |
|---|---|---|---|---|---|
| CODE | SYMBOL | SYMBOL | SYMBOL | SYMBOL | SYMBOL |
| 00 | BAR | 2BAR | BAR | 2BAR | BAR |
| 01 | BLANK | BLANK | BLANK | BLANK | BLANK |
| 02 | 7 | 7 | 7 | 7 | 7 |
| 03 | BLANK | BLANK | BLANK | BLANK | BLANK |
| 04 | 3BAR | 3BAR | 3BAR | 3BAR | 3BAR |
| 05 | BLANK | BLANK | BLANK | BLANK | BLANK |
| 06 | BONUS | BONUS | BONUS | BONUS | BONUS |
| 07 | BLANK | BLANK | BLANK | BLANK | BLANK |
| 08 | 2BAR | BAR | 2BAR | BAR | 2BAR |
| 09 | BLANK | BLANK | BLANK | BLANK | BLANK |
| 10 | 3BAR | 3BAR | CHANCE | 3BAR | 3BAR |
| 11 | BLANK | BLANK | BLANK | BLANK | BLANK |
| 12 | 2BAR | BAR | 2BAR | BAR | 2BAR |
| 13 | WILD | WILD | WILD | WILD | WILD |
| 14 | WILD | WILD | WILD | WILD | WILD |
| 15 | WILD | WILD | WILD | WILD | WILD |
| 16 | 2BAR | BAR | 2BAR | BAR | 2BAR |
| 17 | BLANK | BLANK | BLANK | BLANK | BLANK |
| 18 | BAR | 2BAR | BAR | 2BAR | BAR |
| 19 | BLANK | BLANK | BLANK | BLANK | BLANK |
| 20 | 7 | 7 | 7 | 7 | 7 |
| 21 | BLANK | BLANK | BLANK | BLANK | BLANK |

FIG.15

| | 1st REEL | 2nd REEL | 3rd REEL | 4th REEL | 5th REEL |
|---|---|---|---|---|---|
| CODE | RANDOM NO. | RANDOM NO. | RANDOM NO. | RANDOM NO. | RANDOM NO. |
| 00 | 0~NU1A | 0~NU2A | 0~NU3A | 0~NU4A | 0~NU5A |
| 01 | NL1A~NU1B | NL2A~NU2B | NL3A~NU3B | NL4A~NU4B | NL5A~NU5B |
| 02 | NL1B~NU1C | NL2B~NU2C | NL3B~NU3C | NL4B~NU4C | NL5B~NU5C |
| 03 | NL1C~NU1D | NL2C~NU2D | NL3C~NU3D | NL4C~NU4D | NL5C~NU5D |
| 04 | NL1D~NU1E | NL2D~NU2E | NL3D~NU3E | NL4D~NU4E | NL5D~NU5E |
| 05 | NL1E~NU1F | NL2E~NU2F | NL3E~NU3F | NL4E~NU4F | NL5E~NU5F |
| 06 | NL1F~NU1G | NL2F~NU2G | NL3F~NU3G | NL4F~NU4G | NL5F~NU5G |
| 07 | NL1G~NU1H | NL2G~NU2H | NL3G~NU3H | NL4G~NU4H | NL5G~NU5H |
| 08 | NL1H~NU1I | NL2H~NU2I | NL3H~NU3I | NL4H~NU4I | NL5H~NU5I |
| 09 | NL1I~NU1J | NL2I~NU2J | NL3I~NU3J | NL4I~NU4J | NL5I~NU5J |
| 10 | NL1J~NU1K | NL2J~NU2K | NL3J~NU3K | NL4J~NU4K | NL5J~NU5K |
| 11 | NL1K~NU1L | NL2K~NU2L | NL3K~NU3L | NL4K~NU4L | NL5K~NU5L |
| 12 | NL1L~NU1M | NL2L~NU2M | NL3L~NU3M | NL4L~NU4M | NL5L~NU5M |
| 13 | NL1M~NU1N | NL2M~NU2N | NL3M~NU3N | NL4M~NU4N | NL5M~NU5N |
| 14 | NL1N~NU1O | NL2N~NU2O | NL3N~NU3O | NL4N~NU4O | NL5N~NU5O |
| 15 | NL1O~NU1P | NL2O~NU2P | NL3O~NU3P | NL4O~NU4P | NL5O~NU5P |
| 16 | NL1P~NU1Q | NL2P~NU2Q | NL3P~NU3Q | NL4P~NU4Q | NL5P~NU5Q |
| 17 | NL1Q~NU1R | NL2Q~NU2R | NL3Q~NU3R | NL4Q~NU4R | NL5Q~NU5R |
| 18 | NL1R~NU1S | NL2R~NU2S | NL3R~NU3S | NL4R~NU4S | NL5R~NU5S |
| 19 | NL1S~NU1T | NL2S~NU2T | NL3S~NU3T | NL4S~NU4T | NL5S~NU5T |
| 20 | NL1T~NU1U | NL2T~NU2U | NL3T~NU3U | NL4T~NU4U | NL5T~NU5U |
| 21 | NL1U~NU1V | NL2U~NU2V | NL3U~NU3V | NL4U~NU4V | NL5U~NU5V |
| 22 | NL1V~LAST | NL2V~LAST | NL3V~LAST | NL4V~LAST | NL5V~LAST |

FIG.26

| | 1st REEL | 2nd REEL | 3rd REEL | 4th REEL | 5th REEL |
|---|---|---|---|---|---|
| CODE | RANDOM NO. | RANDOM NO. | RANDOM NO. | RANDOM NO. | RANDOM NO. |
| 00 | 0~CU1A | 0~CU2A | 0~CU3A | 0~CU4A | 0~CU5A |
| 01 | CL1A~CU1B | CL2A~CU2B | CL3A~CU3B | CL4A~CU4B | CL5A~CU5B |
| 02 | CL1B~CU1C | CL2B~CU2C | CL3B~CU3C | CL4B~CU4C | CL5B~CU5C |
| 03 | CL1C~CU1D | CL2C~CU2D | CL3C~CU3D | CL4C~CU4D | CL5C~CU5D |
| 04 | CL1D~CU1E | CL2D~CU2E | CL3D~CU3E | CL4D~CU4E | CL5D~CU5E |
| 05 | CL1E~CU1F | CL2E~CU2F | CL3E~CU3F | CL4E~CU4F | CL5E~CU5F |
| 06 | CL1F~CU1G | CL2F~CU2G | CL3F~CU3G | CL4F~CU4G | CL5F~CU5G |
| 07 | CL1G~CU1H | CL2G~CU2H | CL3G~CU3H | CL4G~CU4H | CL5G~CU5H |
| 08 | CL1H~CU1I | CL2H~CU2I | CL3H~CU3I | CL4H~CU4I | CL5H~CU5I |
| 09 | CL1I~CU1J | CL2I~CU2J | CL3I~CU3J | CL4I~CU4J | CL5I~CU5J |
| 10 | CL1J~CU1K | CL2J~CU2K | CL3J~CU3K | CL4J~CU4K | CL5J~CU5K |
| 11 | CL1K~CU1L | CL2K~CU2L | CL3K~CU3L | CL4K~CU4L | CL5K~CU5L |
| 12 | CL1L~CU1M | CL2L~CU2M | CL3L~CU3M | CL4L~CU4M | CL5L~CU5M |
| 13 | CL1M~CU1N | CL2M~CU2N | CL3M~CU3N | CL4M~CU4N | CL5M~CU5N |
| 14 | CL1N~CU1O | CL2N~CU2O | CL3N~CU3O | CL4N~CU4O | CL5N~CU5O |
| 15 | CL1O~CU1P | CL2O~CU2P | CL3O~CU3P | CL4O~CU4P | CL5O~CU5P |
| 16 | CL1P~CU1Q | CL2P~CU2Q | CL3P~CU3Q | CL4P~CU4Q | CL5P~CU5Q |
| 17 | CL1Q~CU1R | CL2Q~CU2R | CL3Q~CU3R | CL4Q~CU4R | CL5Q~CU5R |
| 18 | CL1R~CU1S | CL2R~CU2S | CL3R~CU3S | CL4R~CU4S | CL5R~CU5S |
| 19 | CL1S~CU1T | CL2S~CU2T | CL3S~CU3T | CL4S~CU4T | CL5S~CU5T |
| 20 | CL1T~CU1U | CL2T~CU2U | CL3T~CU3U | CL4T~CU4U | CL5T~CU5U |
| 21 | CL1U~CU1V | CL2U~CU2V | CL3U~CU3V | CL4U~CU4V | CL5U~CU5V |
| 22 | CL1V~LAST | CL2V~LAST | CL3V~LAST | CL4V~LAST | CL5V~LAST |

FIG.27

| | 1st REEL | 2nd REEL | 3rd REEL | 4th REEL | 5th REEL |
|---|---|---|---|---|---|
| CODE | SYMBOL | SYMBOL | SYMBOL | SYMBOL | SYMBOL |
| 00 | BAR | 2BAR | BAR | 2BAR | BAR |
| 01 | BLANK | BLANK | BLANK | BLANK | BLANK |
| 02 | 7 | 7 | 7 | 7 | 7 |
| 03 | BLANK | BLANK | BLANK | BLANK | BLANK |
| 04 | 3BAR | 3BAR | 3BAR | 3BAR | 3BAR |
| 05 | BLANK | BLANK | BLANK | BLANK | BLANK |
| 06 | 7 | 7 | 7 | 7 | 7 |
| 07 | BLANK | BLANK | BLANK | BLANK | BLANK |
| 08 | 2BAR | BAR | 2BAR | BAR | 2BAR |
| 09 | BLANK | BLANK | BLANK | BLANK | BLANK |
| 10 | 7 | 7 | 7 | 7 | 7 |
| 11 | BLANK | BLANK | BLANK | BLANK | BLANK |
| 12 | 2BAR | BAR | 2BAR | BAR | 2BAR |
| 13 | BLANK | BLANK | BLANK | BLANK | BLANK |
| 14 | 7 | 7 | 7 | 7 | 7 |
| 15 | BLANK | BLANK | BLANK | BLANK | BLANK |
| 16 | 2BAR | BAR | 2BAR | BAR | 2BAR |
| 17 | BLANK | BLANK | BLANK | BLANK | BLANK |
| 18 | 7 | 7 | 7 | 7 | 7 |
| 19 | BLANK | BLANK | BLANK | BLANK | BLANK |
| 20 | 7 | 7 | 7 | 7 | 7 |
| 21 | BLANK | BLANK | BLANK | BLANK | BLANK |

FIG.42

| SPINNING SPEED | SPIN TABLE |
|---|---|
| LOW SPEED (~1) | SPIN TABLE 1 |
| | SPIN TABLE 2 |
| | SPIN TABLE 3 |
| MIDDLE SPEED (1~5) | SPIN TABLE 4 |
| | SPIN TABLE 5 |
| | SPIN TABLE 6 |
| HIGH SPEED (5~) | SPIN TABLE 7 |
| | SPIN TABLE 8 |
| | SPIN TABLE 9 |

FIG.43

| NO. OF FREE ROUNDS | WEIGHT |
|---|---|
| 6 | 40 |
| 8 | 30 |
| 12 | 20 |
| 15 | 10 |

FIG.44

| STOP POSITION | WEIGHT |
|---|---|
| P1 | 40 |
| P2 | 10 |
| P3 | 10 |
| P4 | 40 |

FIG.66

| | SCENE NO. | TRIGGER 1 | TRIGGER 2 | TRIGGER 3 | REEL | SOUND | LIGHT |
|---|---|---|---|---|---|---|---|
| #SCENE_ST | | | | | | | |
| | | | | | | | |
| #SCENE_TR | | | | | | | |
| | | | | | | | |
| #SCENE_TR | | | | | | | |
| | | | | | | | |
| #SCENE_TR | | | | | | | |
| | | | | | | | |
| #SCENE_TR | | | | | | | |
| | | | | | | | |
| #SCENE_TR | | | | | | | |
| | | | | | | | |
| #SCENE_END | | | | | | | |
| | | | | | | | |

FIG.67

| | SCENE NO. | TRIGGER 1 | TRIGGER 2 | TRIGGER 3 | REEL | SOUND | LIGHT |
|---|---|---|---|---|---|---|---|
| #SCENE_ST | 0 | | | START | REELALLSPEED.CSV | BGM | |
| | | | | | | | |
| #SCENE_TR | 0 | R1_STOP | | START | | STOP_SOUND | |
| | | | | | | | |
| #SCENE_TR | 0 | R2_STOP | | START | | STOP_SOUND | |
| | | | | | | | |
| #SCENE_ST | 1 | | | START | 12STOP345HIGH.CSV | MUSIC | LIGHTING_PATTERN1.CSV |
| | | | | | | | |
| #SCENE_TR | 1 | MUSIC_START | 3.20 SEC | START | 1245STOP3COMA.CSV | | LIGHTING_PATTERN1.CSV |
| | | | | | | | |
| #SCENE_TR | 1 | MUSIC_START | 6.40 SEC | START | 12STOP3SLOW.CSV | | LIGHTING_PATTERN2.CSV |
| | | | | | | | |
| #SCENE_TR | 1 | MUSIC_START | 9.60 SEC | START | 1245STOP3COMA.CSV | | LIGHTING_PATTERN2.CSV |
| | | | | | | | |
| #SCENE_TR | 1 | MUSIC_START | 12.80 SEC | START | 123STOP4SLOW.CSV | | LIGHTING_PATTERN3.CSV |
| | | | | | | | |
| #SCENE_TR | 1 | MUSIC_START | 16.00 SEC | START | 1235STOP4COMA.CSV | | LIGHTING_PATTERN3.CSV |
| | | | | | | | |
| #SCENE_TR | 1 | MUSIC_START | 19.20 SEC | START | 1234STOP5SLOW.CSV | | LIGHTING_PATTERN4.CSV |
| | | | | | | | |
| #SCENE_TR | 1 | MUSIC_START | 22.40 SEC | START | 1234STOP5COMA.CSV | | LIGHTING_PATTERN4.CSV |
| | | | | | | | |
| #SCENE_END | 1 | | | END | | | |
| | | | | | | | |

FIG.68

REEL CONTROL FILE (REELALLSPEED.CSV)

| REEL NO. | REEL SPIN | SPIN DIRECTION | HIGHEST SPEED | LOWEST SPEED | LOWEST SPIN TIME | STOP INTERVAL |
|---|---|---|---|---|---|---|
| 1ST REEL | 0 | FORWARD SPIN | 90RPM | 80RPM | 5 SEC | 0 SEC |
| 2ND REEL | 0 | FORWARD SPIN | 90RPM | 80RPM | 5 SEC | 1 SEC |
| 3RD REEL | 1 | FORWARD SPIN | 90RPM | 80RPM | | |
| 4TH REEL | 1 | FORWARD SPIN | 90RPM | 80RPM | | |
| 5TH REEL | 1 | FORWARD SPIN | 90RPM | 80RPM | | |

FIG.69

REEL CONTROL FILE (12STOP345HIGH.CSV)

| REEL NO. | REEL SPIN | SPIN DIRECTION | HIGHEST SPEED | LOWEST SPEED | LOWEST SPIN TIME | STOP INTERVAL |
|---|---|---|---|---|---|---|
| 1ST REEL | 0 | FORWARD SPIN | 90RPM | 80RPM | 0 SEC | 0 SEC |
| 2ND REEL | 0 | FORWARD SPIN | 90RPM | 80RPM | 0 SEC | 0 SEC |
| 3RD REEL | 1 | FORWARD SPIN | 90RPM | 80RPM | | |
| 4TH REEL | 0 | FORWARD SPIN | 90RPM | 80RPM | 3.2 SEC | 0 SEC |
| 5TH REEL | 0 | FORWARD SPIN | 90RPM | 80RPM | 3.2 SEC | 0 SEC |

FIG.70

REEL CONTROL FILE (1245STOP3COMA.CSV)

| REEL NO. | REEL SPIN | SPIN DIRECTION | HIGHEST SPEED | LOWEST SPEED | LOWEST SPIN TIME | STOP INTERVAL |
|---|---|---|---|---|---|---|
| 1ST REEL | 0 | FORWARD SPIN | 90RPM | 80RPM | 0 SEC | 0 SEC |
| 2ND REEL | 0 | FORWARD SPIN | 90RPM | 80RPM | 0 SEC | 0 SEC |
| 3RD REEL | 0 | FORWARD SPIN | 90RPM | 3RPM | 2.4 SEC | 0 SEC |
| 4TH REEL | 0 | FORWARD SPIN | 90RPM | 80RPM | 0 SEC | 0 SEC |
| 5TH REEL | 0 | FORWARD SPIN | 90RPM | 80RPM | 0 SEC | 0 SEC |

FIG.71

REEL CONTROL FILE (12STOP3SLOW.CSV)

| REEL NO. | REEL SPIN | SPIN DIRECTION | HIGHEST SPEED | LOWEST SPEED | LOWEST SPIN TIME | STOP INTERVAL |
|---|---|---|---|---|---|---|
| 1ST REEL | 0 | FORWARD SPIN | 90RPM | 80RPM | 0 SEC | 0 SEC |
| 2ND REEL | 0 | FORWARD SPIN | 90RPM | 80RPM | 0 SEC | 0 SEC |
| 3RD REEL | 1 | FORWARD SPIN | 90RPM | 20RPM | | |
| 4TH REEL | 0 | FORWARD SPIN | 90RPM | 80RPM | 3.2 SEC | 0 SEC |
| 5TH REEL | 0 | FORWARD SPIN | 90RPM | 80RPM | 3.2 SEC | 0 SEC |

FIG.72

REEL CONTROL FILE (123STOP4SLOW.CSV)

| REEL NO. | REEL SPIN | SPIN DIRECTION | HIGHEST SPEED | LOWEST SPEED | LOWEST SPIN TIME | STOP INTERVAL |
|---|---|---|---|---|---|---|
| 1ST REEL | 0 | FORWARD SPIN | 90RPM | 80RPM | 0 SEC | 0 SEC |
| 2ND REEL | 0 | FORWARD SPIN | 90RPM | 80RPM | 0 SEC | 0 SEC |
| 3RD REEL | 0 | FORWARD SPIN | 90RPM | 80RPM | 0 SEC | 0 SEC |
| 4TH REEL | 1 | FORWARD SPIN | 90RPM | 20RPM | | |
| 5TH REEL | 0 | FORWARD SPIN | 90RPM | 80RPM | 3.2 SEC | 0 SEC |

FIG.73

REEL CONTROL FILE (1235STOP4COMA.CSV)

| REEL NO. | REEL SPIN | SPIN DIRECTION | HIGHEST SPEED | LOWEST SPEED | LOWEST SPIN TIME | STOP INTERVAL |
|---|---|---|---|---|---|---|
| 1ST REEL | 0 | FORWARD SPIN | 90RPM | 80RPM | 0 SEC | 0 SEC |
| 2ND REEL | 0 | FORWARD SPIN | 90RPM | 80RPM | 0 SEC | 0 SEC |
| 3RD REEL | 1 | FORWARD SPIN | 90RPM | 80RPM | 0 SEC | 0 SEC |
| 4TH REEL | 0 | FORWARD SPIN | 90RPM | 3RPM | 2.4 SEC | 0 SEC |
| 5TH REEL | 0 | FORWARD SPIN | 90RPM | 80RPM | 0 SEC | 0 SEC |

FIG.74

REEL CONTROL FILE (1234STOP5SLOW.CSV)

| REEL NO. | REEL SPIN | SPIN DIRECTION | HIGHEST SPEED | LOWEST SPEED | LOWEST SPIN TIME | STOP INTERVAL |
|---|---|---|---|---|---|---|
| 1ST REEL | 0 | FORWARD SPIN | 90RPM | 80RPM | 0 SEC | 0 SEC |
| 2ND REEL | 0 | FORWARD SPIN | 90RPM | 80RPM | 0 SEC | 0 SEC |
| 3RD REEL | 0 | FORWARD SPIN | 90RPM | 80RPM | 0 SEC | 0 SEC |
| 4TH REEL | 0 | FORWARD SPIN | 90RPM | 80RPM | 0 SEC | 0 SEC |
| 5TH REEL | 1 | FORWARD SPIN | 90RPM | 20RPM | | |

FIG.75

REEL CONTROL FILE (1234STOP5COMA.CSV)

| REEL NO. | REEL SPIN | SPIN DIRECTION | HIGHEST SPEED | LOWEST SPEED | LOWEST SPIN TIME | STOP INTERVAL |
|---|---|---|---|---|---|---|
| 1ST REEL | 0 | FORWARD SPIN | 90RPM | 80RPM | 0 SEC | 0 SEC |
| 2ND REEL | 0 | FORWARD SPIN | 90RPM | 80RPM | 0 SEC | 0 SEC |
| 3RD REEL | 0 | FORWARD SPIN | 90RPM | 80RPM | 0 SEC | 0 SEC |
| 4TH REEL | 0 | FORWARD SPIN | 90RPM | 90RPM | 0 SEC | 0 SEC |
| 5TH REEL | 0 | FORWARD SPIN | 90RPM | 3RPM | 2.4 SEC | 0 SEC |

FIG.77

| | SCENE NO. | TRIGGER 1 | TRIGGER 2 | TRIGGER 3 | REEL | SOUND | LIGHT |
|---|---|---|---|---|---|---|---|
| #SCENE_ST | 0 | | | START | REELALLSPEED.CSV | BGM | |
| | | | | | | | |
| #SCENE_TR | 0 | R1_STOP | | START | | STOP_SOUND | |
| | | | | | | | |
| #SCENE_TR | 0 | R2_STOP | | START | | STOP_SOUND | |
| | | | | | | | |
| #SCENE_ST | 1 | | | START | 12STOP345HIGH.CSV | MUSIC | LIGHTING_PATTERN1.CSV |
| | | | | | | | |
| #SCENE_TR | 1 | R2_STOP | 3.20 SEC | START | 1245STOP3COMA.CSV | | LIGHTING_PATTERN1.CSV |
| | | | | | | | |
| #SCENE_TR | 1 | R2_STOP | 6.40 SEC | START | 12STOP3SLOW.CSV | | LIGHTING_PATTERN2.CSV |
| | | | | | | | |
| #SCENE_TR | 1 | R2_STOP | 9.60 SEC | START | 1245STOP3COMA.CSV | | LIGHTING_PATTERN2.CSV |
| | | | | | | | |
| #SCENE_TR | 1 | R2_STOP | 12.80 SEC | START | 123STOP4SLOW.CSV | | LIGHTING_PATTERN3.CSV |
| | | | | | | | |
| #SCENE_TR | 1 | R2_STOP | 16.00 SEC | START | 1235STOP4COMA.CSV | | LIGHTING_PATTERN3.CSV |
| | | | | | | | |
| #SCENE_TR | 1 | R2_STOP | 19.20 SEC | START | 1234STOP5SLOW.CSV | | LIGHTING_PATTERN4.CSV |
| | | | | | | | |
| #SCENE_TR | 1 | R2_STOP | 22.40 SEC | START | 1234STOP5COMA.CSV | | LIGHTING_PATTERN4.CSV |
| | | | | | | | |
| #SCENE_END | 1 | | | END | | | |
| | | | | | | | |

FIG.78

| | SCENE NO. | TRIGGER 1 | TRIGGER 2 | TRIGGER 3 | REEL | SOUND | LIGHT |
|---|---|---|---|---|---|---|---|
| #SCENE_ST | 0 | | | START | REELALLSPEED.CSV | BGM | |
| | | | | | | | |
| #SCENE_TR | 0 | R1_STOP | | START | | STOP_SOUND | |
| | | | | | | | |
| #SCENE_TR | 0 | R2_STOP | | START | | STOP_SOUND | |
| | | | | | | | |
| #SCENE_ST | 1 | | | START | 12STOP345HIGH.CSV | MUSIC | LIGHTING_PATTERN1.CSV |
| | | | | | | | |
| #SCENE_TR | 1 | STOP_TIMER | 3.20 SEC | START | 1245STOP3COMA.CSV | | LIGHTING_PATTERN1.CSV |
| | | | | | | | |
| #SCENE_TR | 1 | STOP_TIMER | 6.40 SEC | START | 12STOP3SLOW.CSV | | LIGHTING_PATTERN2.CSV |
| | | | | | | | |
| #SCENE_TR | 1 | STOP_TIMER | 9.60 SEC | START | 1245STOP3COMA.CSV | | LIGHTING_PATTERN2.CSV |
| | | | | | | | |
| #SCENE_TR | 1 | STOP_TIMER | 12.80 SEC | START | 123STOP4SLOW.CSV | | LIGHTING_PATTERN3.CSV |
| | | | | | | | |
| #SCENE_TR | 1 | STOP_TIMER | 16.00 SEC | START | 1235STOP4COMA.CSV | | LIGHTING_PATTERN3.CSV |
| | | | | | | | |
| #SCENE_TR | 1 | STOP_TIMER | 19.20 SEC | START | 1234STOP5SLOW.CSV | | LIGHTING_PATTERN4.CSV |
| | | | | | | | |
| #SCENE_TR | 1 | STOP_TIMER | 22.40 SEC | START | 1234STOP5COMA.CSV | | LIGHTING_PATTERN4.CSV |
| | | | | | | | |
| #SCENE_END | 1 | | | END | | | |
| | | | | | | | |

GAMING MACHINE AND GAMING METHOD

BACKGROUND (a) Field

The present invention generally relates to a gaming machine and a gaming method.

(b) Description of the Related Art

A gaming machine executes a game to rearrange symbols, and awards a benefit to the player according to a result of the rearranged symbols. Free rounds where no coin needs to be inserted are provided as the benefic when the result satisfies a predetermined condition. The player can receive additional benefic by playing the free rounds.

A gaming machine operator wants the players to frequently play the games, thereby increasing their profits. Accordingly, the gaming machine operator provides visual effects such as symbol patterns, gaming scenarios, and side effects when the players play the games. However, since general visual effects can be provided by gaming machines of other operators, there are limits to continuously attracting the players' attention through only the general visual features.

SUMMARY

Aspects of the present invention provide a gaming machine and a gaming method for continuously attracting the players' attention.

According to an aspect of the present invention, a gaming machine is provided. The gaming machine includes a plurality of reels, a speaker, a memory, and a controller. Each of the reels spins and rearranges a plurality of symbols in a game. The speaker outputs music at a predetermined time when it is determined that a result of the game satisfies a predetermined condition. The memory stores a program corresponding to a data sheet including a plurality of rows and a plurality of columns. The plurality of columns include a reel field being predefined to be associated with the reels and including a command for controlling the reels and a trigger field including a triggering condition for executing a command of a corresponding row in synchronization with the music. The controller determines the result of the game. Each time any one of a plurality of triggering conditions for a plurality of rows is satisfied, the controller controls the reels according to a command of a row having the satisfied triggering condition.

Each of the triggering conditions may include a time that is synchronized with the music.

Each of the triggering conditions may further include a start of the music.

The gaming machine may further include a backlight unit for the reels. The plurality of columns may further include a light field being predefined to be associated with the backlight unit and including a command for controlling the backlight unit. Each time any one of the triggering condition is satisfied, the controller may control the backlight to emit light according to a command of the row having the satisfied triggering condition.

The command of the reel field may include a control file including information for controlling the reels. The information may include a spin speed of each of the reels and a spin time of each of the reels.

According to another aspect of the present invention, a gaming machine is provided. The gaming machine includes a plurality of reels, a memory, and a controller. Each of the reels spins and rearranges a plurality of symbols in a game. The memory stores a program corresponding to a data sheet including a plurality of rows and a plurality of columns. The plurality of columns include a reel field being predefined to be associated with the reels and including a command for controlling the reels and a trigger field including a triggering condition for executing a command of a corresponding row. Trigger fields for a plurality of rows include a plurality of predefined times as the triggering condition, respectively. The controller determines a result of the game and to control the reels, at each of the predefined times, according to the command of a row having each of the predefined times as the triggering condition when it is determined that the result of the game satisfies a predetermined condition.

The gaming machine may further include a speaker configured to output music at a predetermined time when the result of the game satisfies the predetermined condition. The plurality of predefined times may be synchronized with the music.

Each of the trigger fields may further include a start of the music as the triggering condition.

The gaming machine may further include a backlight unit for the reels. The plurality of columns may further include a light field being predefined to be associated with the backlight unit and including a command for controlling the backlight unit. The controller may control the backlight to emit light, at each of the predefined times, according to the command of the row having each of the predefined times as the triggering condition.

The command of the reel field may include a control file including information for controlling the reels. The information may include a spin speed of each of the reels and a spin time of each of the reels.

The controller may spin the reels at a first speed when the game is started, and may start to spin a first reel of the reels at a second speed that is lower than the first speed, at a first time of the predefined times.

The controller may start to spin the first reel by one symbol each time a predetermined period elapses, at a second time of the predefined times, the second time being later than the first time.

The controller may start to spin a second reel of the reels at the second speed, at a third time of the predefined times, the second reel being next to the first reel and the third time being later than the second time.

The controller may start to spin the second reel by one symbol each time the predetermined period elapses, at a fourth time of the predefined times, the fourth time being later than the third time.

According to yet another aspect of the present invention, a gaming method by a controller of a gaming machine is provided. The gaming machine includes a plurality of reels each configured to spin and rearrange a plurality of symbols in a game, a speaker, and a memory. The method includes storing a program corresponding to a data sheet including a plurality of rows and a plurality of columns. The plurality of columns include a reel field being predefined to be associated with the reels and including a command for controlling the reels and a trigger field including a triggering condition for executing a command of a corresponding row in synchronization with a music. The method further includes executing a game to spin the reels and determining a result of the game. The method further includes outputting the music through the speaker at a predetermined time when it is determined that the result of the game satisfies a predetermined condition. The method further includes, each time any one of a plurality of triggering conditions for a plurality of rows is satisfied, controlling the reels according to a command of a row having the satisfied triggering condition.

Each of the triggering conditions may include a time that is synchronized with the music.

Each of the triggering conditions may further include a start of the music.

According to yet another aspect of the present invention, a gaming method by a controller of a gaming machine is provided. The gaming machine includes a plurality of reels each configured to spin and rearrange a plurality of symbols in a game, and a memory. The method includes storing a program corresponding to a data sheet including a plurality of rows and a plurality of columns. The plurality of columns include a reel field being predefined to be associated with the reels and including a command for controlling the reels and a trigger field including a triggering condition for executing a command of a corresponding row. Trigger fields for a plurality of rows include a plurality of predefined times as the triggering condition, respectively. The method further includes executing a game to spin the reels and determining a result of the game. The method further includes controlling the reels, at each of the predefined times, according to the command of the reel field for a row having each of the predefined times as the triggering condition when it is determined that the result of the game satisfies a predetermined condition.

The gaming machine may further include a speaker configured to output music at a predetermined time when the result of the game satisfies the predetermined condition. The plurality of predefined times may be synchronized with the music.

Each of the trigger fields may further include a start of the music as the triggering condition.

According to yet another aspect of the present invention, a method of developing a gaming machine by a gaming machine development system including an input device and a storage device is provided. The gaming machine includes a reel, a driver for driving the reel, and a speaker. The method includes storing a data sheet having an editable format in the storage device. The method further includes inputting, by the input device, commands for controlling the reel and a triggering condition for executing each of the commands in synchronization with music output by the speaker, to the data sheet stored in the storage device. The method further includes generating a program for controlling the driver based on the commands and triggering conditions that are input to the data sheet.

The gaming machine may further include a main CPU for executing the program and a body printed circuit board (PCB) connected to the main CPU and the driver. The main CPU and the body PCB may control the driver according to the commands and the program.

The commands may be input based on an order of execution. The order of execution may be defined by the triggering condition for each of the commands or a priority for each of the commands. The commands may be executed in the order of execution at the gaming machine.

Some of the commands may include a control file for controlling the reel, and the method may further include defining the control file.

According to yet another aspect of the present invention, a gaming machine development system for developing a gaming machine is provided. The gaming machine includes a reel, a driver for driving the reel, and a speaker, and the gaming machine development system includes a storage device, an input device, and a processor. The storage device stores a data sheet having an editable format. The input device inputs commands for commands for controlling the reel and a triggering condition for executing each of the commands in synchronization with music output by the speaker, to the data sheet stored in the storage device. The processor generates a program for controlling the driver based on the commands and the triggering conditions that are input to the data sheet.

The gaming machine may further include a main CPU for executing the program and a body PCB connected to the main CPU and the driver. The main CPU and the body PCB may control the driver according to the commands and the game program.

The commands may be input based on an order of execution. The order of execution may be defined by the triggering condition for each of the commands or a priority for each of the commands. The commands may be executed in the order of execution at the gaming machine.

Some of the commands may include a control file for controlling the reel, and the processor may define the control file by an input of the input device.

BRIEF DESCRIPTION OF THE DRAWINGS

FIG. 6 is an exemplary symbol code table according to an embodiment of the present invention.

FIG. 7 is another exemplary symbol code table according to an embodiment of the present invention.

FIG. 15 is an exemplary symbol code determination table according to an embodiment of the present invention.

FIG. 26 is an exemplary symbol code determination table for a chance round according to an embodiment of the present invention.

FIG. 27 is an exemplary symbol code table for a chance round according to another embodiment of the present invention.

FIG. 42 is an exemplary spinning speed table according to an embodiment of the present invention.

FIG. 43 is an exemplary spin table according to an embodiment of the present invention.

FIG. 44 is an exemplary position determination table according to an embodiment of the present invention.

FIG. 66 is a schematic diagram of a data sheet provided by a gaming machine development system according to an embodiment of the present invention.

FIG. 67 is a schematic diagram of an example data sheet for a rendering effect 6 according to an embodiment of the present invention.

FIG. 68 to FIG. 75 are schematic diagrams of example reel controls file shown in FIG. 67.

FIG. 77 is a schematic diagram of another example data sheet for a rendering effect 6 according to an embodiment of the present invention.

FIG. 78 is a schematic diagram of yet another example data sheet for a rendering effect 6 according to an embodiment of the present invention.

DETAILED DESCRIPTION

Figure 1:
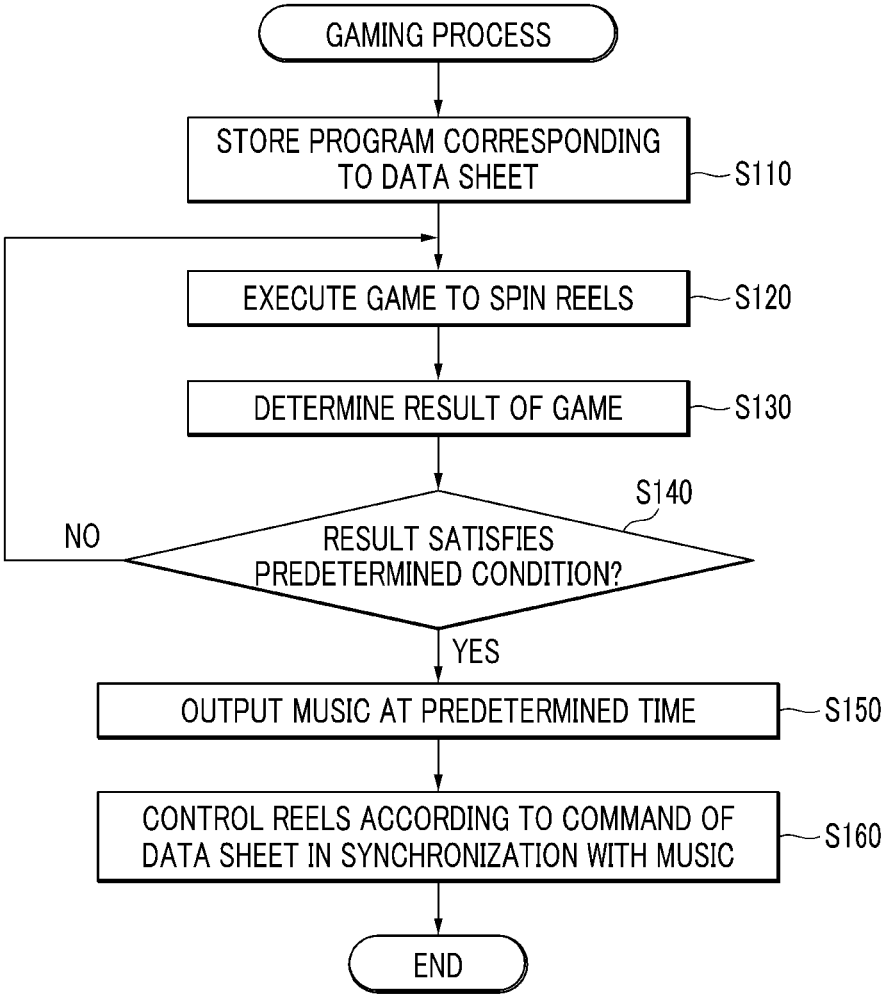
FIG. 1 is a flowchart of a gaming method according to an embodiment of the present invention.

In the following detailed description, only certain embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

A gaming machine, and a gaming method thereof according to embodiments of the present invention are described in detail with reference to the accompanying drawings.

Outline for Gaming Method

FIG. 1 is a flowchart of a gaming method according to an embodiment of the present invention.

Referring to FIG. 1, a gamine machine receive a program corresponding to data sheet including a plurality of rows and a plurality of column, and stores the program corresponding to data sheet in a memory (S110). The gaming machine executes a normal round or a free round of a game to spin a plurality of reels of a primary display (S120), and randomly determines a result of the game (S130). When it is determined that a result of the game satisfies a predetermined condition (S140), the gaming machine renders a rendering effect corresponding to the predetermined condition (S150 and S160).

First, the gaming machine output a music through a speaker at a predetermined time (S150), and controls the reels according to commands input to the data sheet in synchronization with the music (S160). For the operation of the reels synchronized with the music, the plurality of columns of the data sheet include a reel field being predefined to be associated with the reels and including a command for controlling the reels and a trigger field including a triggering condition for executing a command of a corresponding row in synchronization with a music. Accordingly, each time any one of triggering conditions for a plurality of rows is satisfied, the gaming machine can control the reels according to a command of a row having the satisfied triggering condition. As a result, the reels can move in synchronization with the music such that the gaming machine can continuously attract the players' attention.

Overall Configuration of Gaming Machine

A gaming machine according to embodiments of the present invention is described in detail.

First, a mechanical structure of a gaming machine according to embodiments of the present invention is described in detail with reference to FIG. 2 to FIG. 8.

Figure 2:
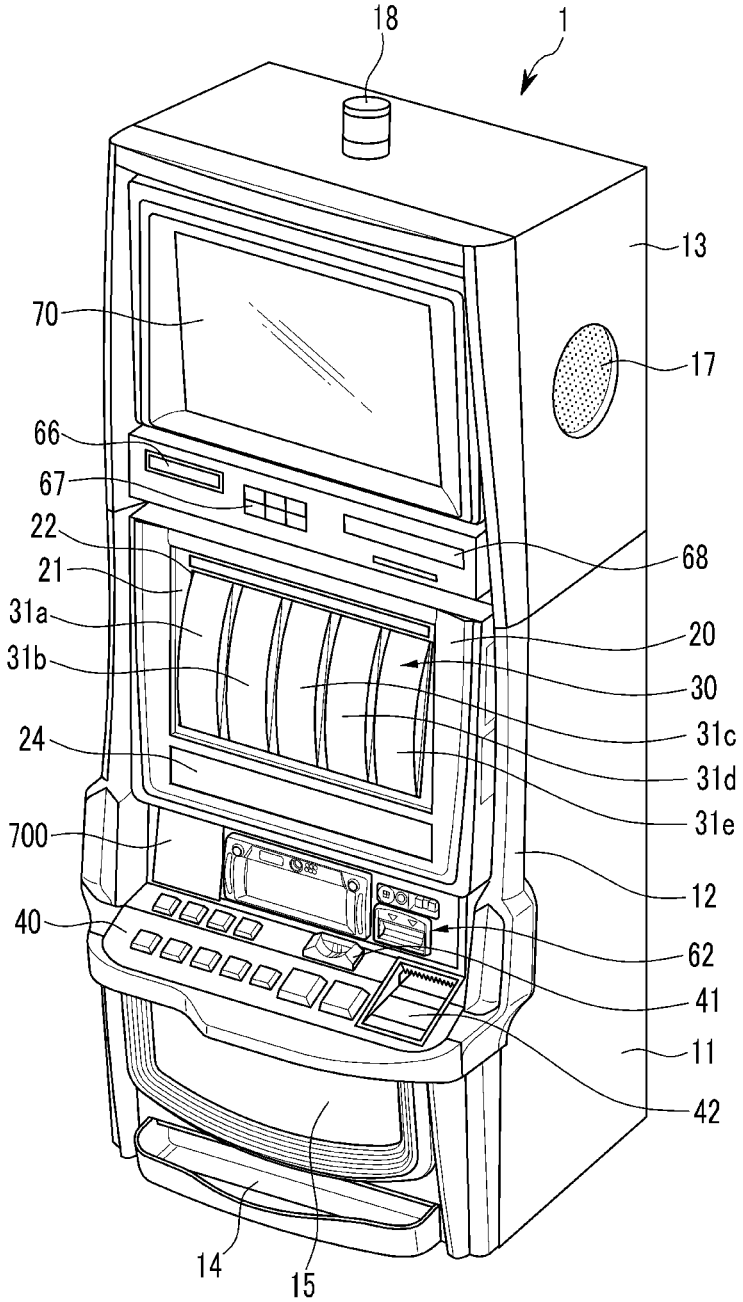
FIG. 2 is a schematic perspective view of a slot machine according to an embodiment of the present invention.
Figure 3:
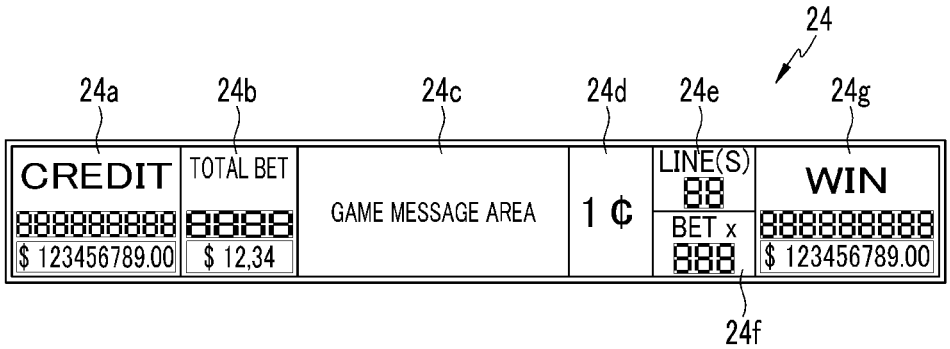
FIG. 3 is a schematic front view of a display panel of a primary display in the gaming machine shown in FIG. 2 according to an embodiment of the present invention.
Figure 4:
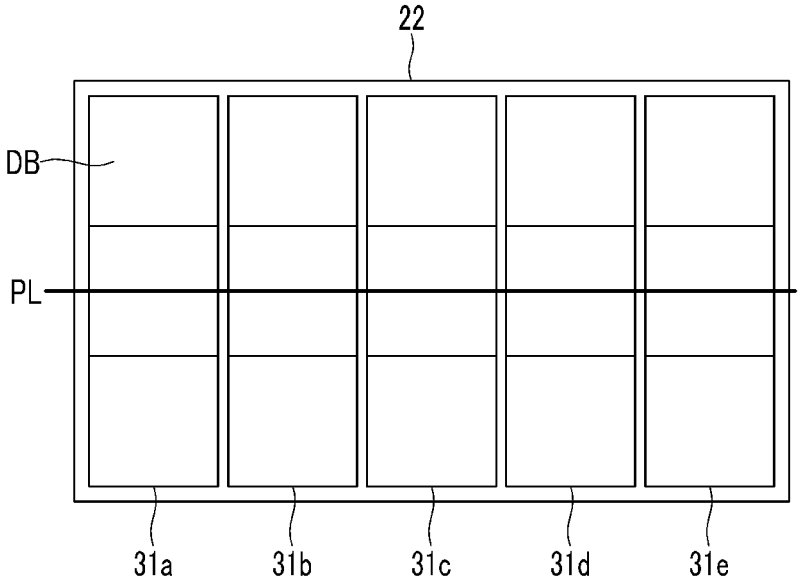
FIG. 4 is a schematic front view of a display window of a primary display in the gaming machine shown in FIG. 2 according to an embodiment of the present invention.
Figure 5:
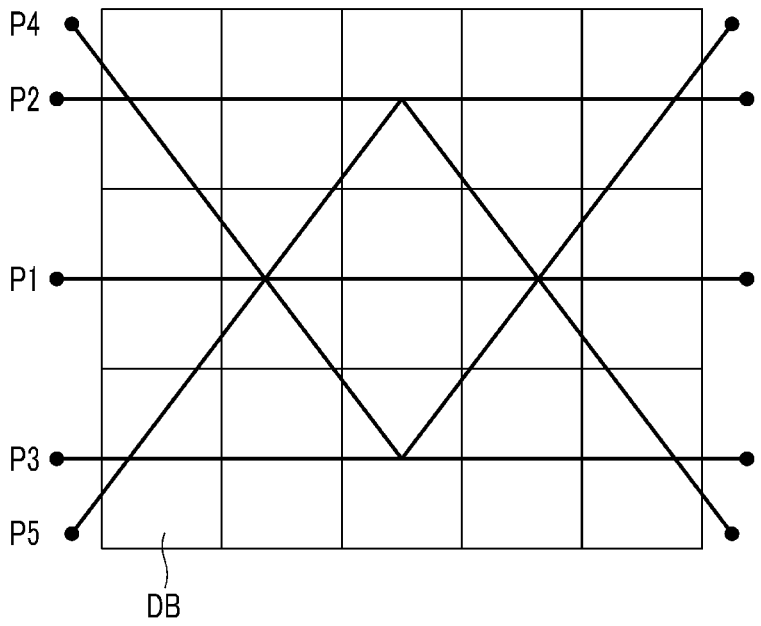
FIG. 5 is a schematic diagram showing exemplary paylines according to an embodiment of the present invention.
Figure 8:
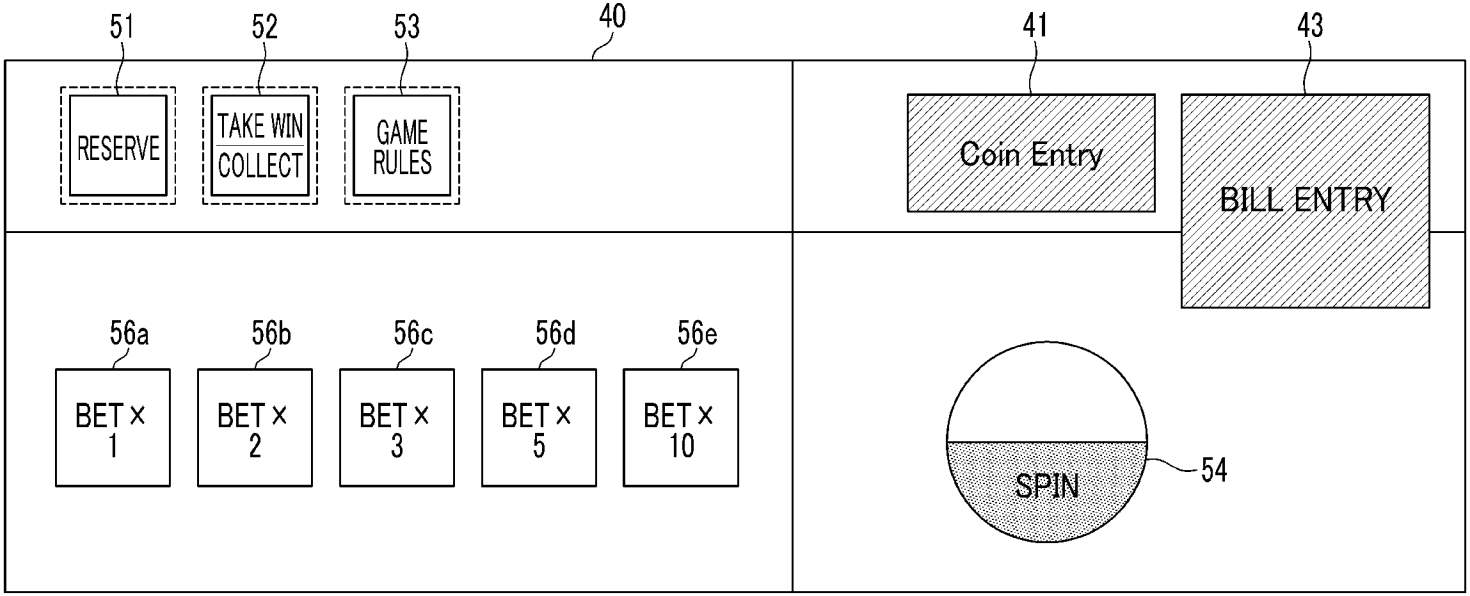
FIG. 8 is a layout view of a control panel in the gaming machine shown in FIG. 2 according to an embodiment of the present invention.

FIG. 2 is a schematic perspective view of a gaming machine according to an embodiment of the present invention, FIG. 3 is a schematic front view of a display panel of a primary display in the gaming machine shown in FIG. 2 according to an embodiment of the present invention, FIG. 4 is a schematic front view of a display window of a primary display in the gaming machine shown in FIG. 2 according to an embodiment of the present invention, FIG. 5 is a schematic diagram showing exemplary paylines according to an embodiment of the present invention, FIG. 6 and FIG. 7 are exemplary symbol code tables according to an embodiment of the present invention, and FIG. 8 is a layout view of a control panel in the gaming machine shown in FIG. 2 according to an embodiment of the present invention.

Referring to FIG. 2, a gaming machine, for example, a slot machine 1 may include a cabinet 11, a top box 13 disposed on the cabinet 11, and a main door 12 disposed in front of the cabinet 11.

A primary display 20 including a reel assembly 30 is provided in the main door 12. According to an embodiment of the present embodiment, the reel assembly 30 may include five reels 31*a* to 31*e*. Each of the reels 31*a* to 31*e* may include a drum (not shown) that has a peripheral surface bearing plural types of symbols. The primary display 20 further includes a reel cover 21 disposed in front of the reel assembly 30 and having a display window 22 that exposes a portion of the reels 31*a* to 31*e*. The reel cover 21 is provided with a display panel 24 that may include a transparent liquid crystal display panel (not shown).

The primary display 20 further includes a display panel 24 provided below the reel assembly 30. The display panel 24 notifies a player of information related to a game. Referring to FIG. 3, the display panel 24 includes a credit area 24*a*, a total bet area 24*b*, a game message area 24*c*, a denomination area 24*d*, a line area 24*e*, a bet area 24*f*, and a win area 24*g*. The credit area 24*a* operates as a credit meter and displays a credit amount of the player. The credit amount indicates the number of credits that are owned by the player and deposited inside the gaming machine 1. The total bet area 24*b* operates as a total bet meter and displays a betting amount that is wagered by the player in a current game. The game message area 24*c* displays various game messages related to the game, and the denomination area 24*d* displays a denomination, for example 1¢, of a minimum credit that can be wagered by the player. The line area 24*e* displays the number of paylines selected by the player in the current game, and the bet area 24*f* displays a multiplier (BET×N) determined by the total bet. The win area 24*g* operates as a win amount meter and displays a payout amount. The payout amount indicates the number of credits to be paid out to the player when a winning combination is established. The display panel 24 may include a flat panel display, for example, a vacuum fluorescent display (VFD), a liquid crystal display (LCD), an organic light emitting display (OLED), a plasma display panel (PDP), and so on.

Referring to FIG. 4, a given number of symbols, for example, three symbols on each of the reels 31*a* to 31*e* may be shown on the display window 22 when the reels 31*a* to 31*e* are at rest. Therefore, a symbol matrix including five columns and three rows is shown on the display window 22, where a pair of a column and a row define a symbol block DB. In this case, each symbol may be stopped on the symbol block DB or a boundary between two symbol blocks DB. That is, each symbol may be sequentially shown on an upper boundary of an upper block, the upper block, a boundary between the upper block and a middle block, the middle block, a boundary between the middle block and a lower block, the lower block, and a lower boundary of the lower block.

FIG. 4 also shows an exemplary payline PL that may be defined on the display window 22 and may pass through a symbol block DB in each column. When a combination of the symbols on the payline PL in a game satisfies a predetermined condition, a player wins the game. For example, if all the symbols in a combination are the same, the gaming machine 1 awards a win (i.e., prize) to the player. Such a combination of the symbols that provides a win is referred to as a "winning combination." The payline PL shown in FIG. 4 is merely an example, and various paylines may be drawn and two or more paylines may be selected by a player.

FIG. 5 shows a variety of paylines PL1 to PL5. An exemplary play line P1, P2 or P3 shown in FIG. 5 connects five blocks in the second, first, or third row, respectively, and another exemplary payline P4 shown in FIG. 5 connects an upper block in the first column, a middle block in the second column, a lower block in the third column, a middle block in the fourth column, and an upper block in the fifth column Another exemplary payline P5 shown in FIG. 5 connects a lower block in the first column, the middle block in the second column, an upper block in the third column, the middle block in the fourth column, and a lower block in the fifth column.

In addition to a win with the payline PL (referred to as a "line win"), there may be another type of win referred to as "scatter win" that is given when at least one scatter symbol among the plural types of the symbols is shown on the display window 22.

Referring to FIG. 6, a symbol sequence including a plurality of symbols is marked on each of the reels 31*a* to 31*e*. Each symbol in the symbol sequence may be assigned to a code, and may include a picture (hereinafter referred to as "a picture symbol") or may include no picture (hereinafter referred to as "a blank symbol"). The picture symbols may include symbols denoted by, for example, "7," "BAR," "DOUBLE BAR," or "TRIPLE BAR," a scatter symbol. The scatter symbol may include a "BONUS" symbol and a "CHANCE" symbol. For example, the symbol sequence may include eleven picture symbols and eleven blank symbols each being located between adjacent two picture symbols. Codes ranging from "00" to "21" may be assigned to the eleven picture symbols and the eleven blank symbols. In an example symbol code table shown in FIG. 6, the "BAR," blank, "7," blank, "TRIPLE BAR," blank, "BAR," blank, "DOUBLE BAR," blank, "TRIPLE BAR," blank, "DOUBLE BAR," blank, "7," blank, "DOUBLE BAR," blank, "BAR," blank, "7," and blank symbols to which the codes from "00" to "21 are respectively assigned are marked on the first reel 31*a* (reel 1). In an example symbol code table shown in FIG. 7, the "BAR," blank, "7," blank, "TRIPLE BAR," blank, "BONUS," blank, "DOUBLE BAR," blank, "TRIPLE BAR," blank, "DOUBLE BAR," blank, "7," blank, "DOUBLE BAR," blank, "BAR," blank, "7," and blank symbols to which the codes from "00" to "21 are respectively assigned are marked on the first reel 31*a* (reel 1). Further, as shown in FIG. 6 and FIG. 7, "CHANCE" symbol may be marked on only the third reel 31*c* (reel 3). A gaming machine spins the reels 31*a* to 31*e* according to a player's input, and randomly determines a code for each of the reels 31*a* to 31*e*. After a certain time period elapses, the gaming machine stops each of the reels 31*a* to 31*e* to locate the symbol corresponding to the determined code at one row (for example, the middle row) of the symbol matrix. Accordingly, the symbols are rearranged in the symbol matrix.

When three or more symbols of the same rank are continuously arranged on the payline starting from the first reel 31*a*, a winning combination may be established. The same symbols have the same rank, and "BAR," "DOUBLE BAR," and "TRIPLE BAR" symbols have the same rank. Accordingly, when three or more "7" symbols are continuously arranged on the payline starting from the first reel 31*a*, a winning combination for the "7" symbol is be established. When three or more "BAR," "DOUBLE BAR," and/or "TRIPLE BAR" symbols are continuously arranged on the payline starting from the first reel 31*a*, a winning combination for the "BAR," "DOUBLE BAR," or "TRIPLE BAR" symbols is established. Further, when two or more "BONUS" symbols are arranged on any two or more reels regardless of the payline, a winning combination for the "BOUNS" symbol may be established. Further, when the "CHANCE" symbol is arranged on the third reel 31*c* in a normal round of a game, a chance round of the game may be triggered. The chance round may include a plurality of free rounds. Each free round may be executed without actual betting of the player (i.e., without reducing credits of the player), and the betting amount used for determining a win of the free round may be that of the normal round that has triggered the chance round. A normal round of a game may be referred to as "a normal game," a chance round of a game may be referred to as "a chance game," and a free round of a game may be referred to as "a free game."

Although the gaming machine 1 employs the mechanical reels 31*a* to 31*e* in the present embodiment, video reels or a combination of the mechanical reels and the video reels may be used as well, alternatively.

An IC card reader 62 is disposed below the primary display 20. The IC card reader 62 receives an IC card which stores predetermined data such as player identification information and game log data related with the games previously played by the player. Also, the IC card may store data equivalent to coins, bills, or credits owned by the player. The IC card reader 62 reads and writes data from and to the inserted IC card. The IC card reader 62 includes an LCD for displaying the data read from the IC card.

In front of a lower end of the IC card reader 62 are provided a control panel 40, on which includes various buttons, a coin entry 41, and a bill entry 43. For example, referring to FIG. 8, a RESERVE button 51, a COLLECT button 52, and a GAME RULES button 53 are disposed on an upper left area of the control panel 40. 1-BET button 56*a*, 2-BET button 56*b*, 3-BET button 56*c*, 5-BET button 56*d*, and 10-BET button 56*e* are disposed on a lower left area of the control panel 40. Also, a SPIN button 54 is disposed on the lower center area of the control panel 40. The coin entry 41 is disposed upper center area, and the bill entry 43 is disposed right area of the control panel 40.

The RESERVE button 51 is used when the player temporarily leaves the seat or when the player wants to ask a staff of the game facility to exchange money. Alternatively, the RESERVE button 51 may be used to store remaining credits into an IC card inserted into the IC card reader 62. The COLLECT button 52 is used to instruct the slot machine 1 to pay out credited coins to a coin tray 15. The GAME RULES button 53 is used when the player is not acquainted with game rules or manipulation method. When the GAME RULES button 33 is pressed, various types of help information are displayed on a secondary display 70.

The BET buttons 56*a* to 56*e* are used to set the betting amount. Each time the 1-BET button 56*a* is pressed, one credit is bet for each active pay line from the current credits owned by the player. When the 2-BET button 56*b* is pressed, the game is started on condition that two credits are bet for each active pay line. When the 3-BET button 56*c* is pressed, the game is started on condition that three credits are bet for each active pay line. When the 5-BET button 56*d* is pressed, the game is started on condition that five credits are bet for each active pay line. When the 10-BET button 56*e* is pressed, the game is started on condition that ten credits are bet for each active pay line. The SPIN button 54 is used to instruct the initiation of spinning the reels 31*a* to 31*e* under the previously set betting condition.

The coin entry 41 receives coins and guides the inserted coins into a hopper inside the cabinet 11. The bill entry 43 receives a bill and validates the legitimacy of the inserted bill to accept only a legitimate bill into the cabinet 11.

On a lower front face of the main door 13 and below the control panel 40, there are provided a belly glass 14 on which a character of the slot machine 1 or the like is drawn, and a coin tray 15 receiving coins paid out from the cabinet 11.

Referring back to FIG. 2, a secondary display 70 includes a display panel having a touch screen panel. The display panel may include a flat panel display, for example, an LCD, an OLED, a PDP, and so on. Further, the display panel may be a touch panel. However, embodiments are not limited thereto. The touch screen panel is a device that allows the gaming machine 1 to perform a desired command when the player's finger draws a picture or a line or touches an icon on a screen. The secondary display 70 determines when the player's finger touches the screen and determines touch position information thereof. A plurality of sensing units may be arranged in an approximate matrix form on the touch screen panel, and each sensing unit allows the secondary display 70 to determine when the player's finger touches the screen and the touch position by detecting the change in capacitance or pressure that is generated as the player's finger touches the touch screen panel. Further, the secondary display 70 may provide rendering effect for enhancing the amusement of the game, and displays information of game rules and manipulation methods. Also, a speaker 17 and a lamp 18 are provided on the side and top faces, respectively, of the top box 13. The slot machine 1 augments the amusement of the game by providing sound effect or flashing light through the speaker 17 or the lamp 18, respectively.

Below the secondary display 70, there are provided a ticket printer 66, a keypad 67, and a data display 68.

The ticket printer 66 prints, on a ticket, a bar code containing the credit data, date and time, and an ID number of the slot machine 1 to output the barcode imprinted ticket. The player can exchange the barcode imprinted ticket with bills or the like at a predetermined location of a gaming facility (e.g., from a cashier in a casino).

The keypad 67 includes a plurality of keys allowing the player to input instructions pertinent to the issuance of the ticket. The data display 68, which is implemented using a fluorescent display, LEDs, or the like, displays data input by the player through the keypad 67.

Configuration of Primary Display

A primary display 20 of the gaming machine 1 shown in FIG. 2 is described in detail with reference to FIG. 9 and FIG. 10.

Figure 9:
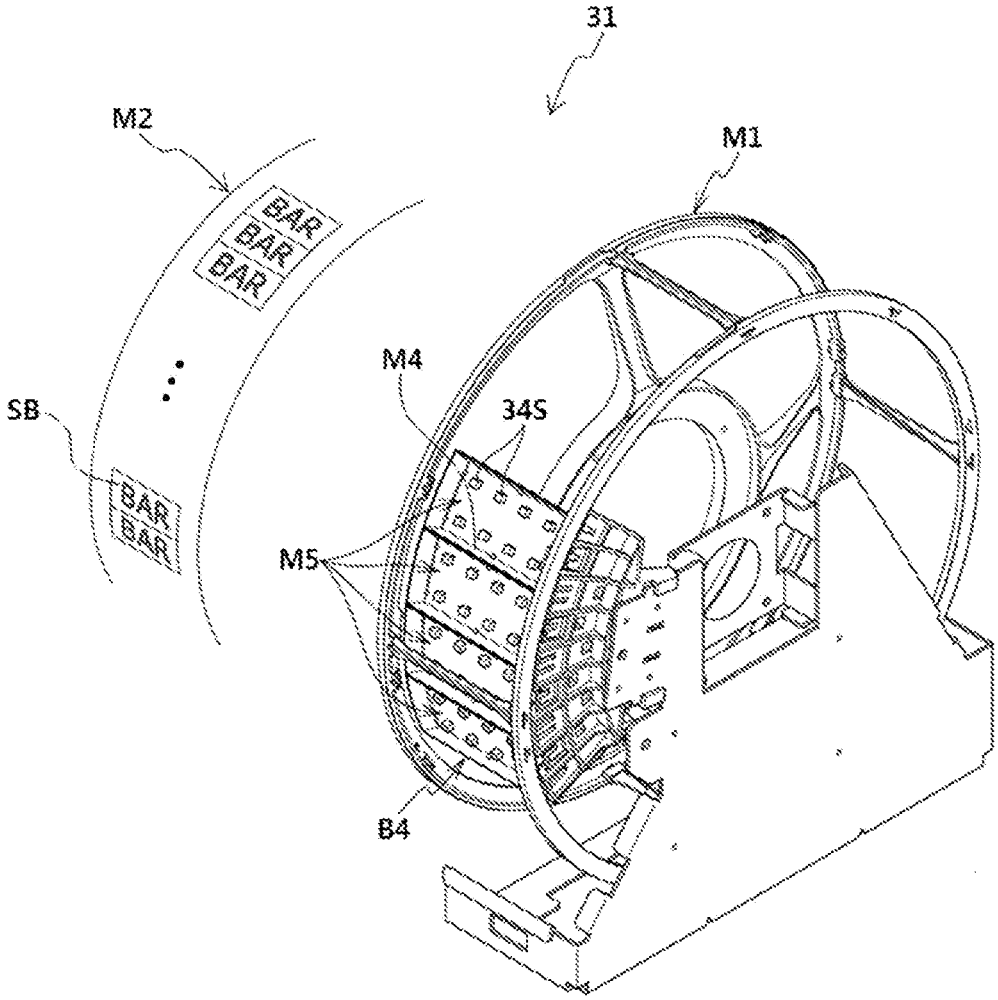
FIG. 9 is a schematic perspective view of an exemplary reel of a reel assembly shown in FIG. 2 according to an embodiment of the present invention.
Figure 10:
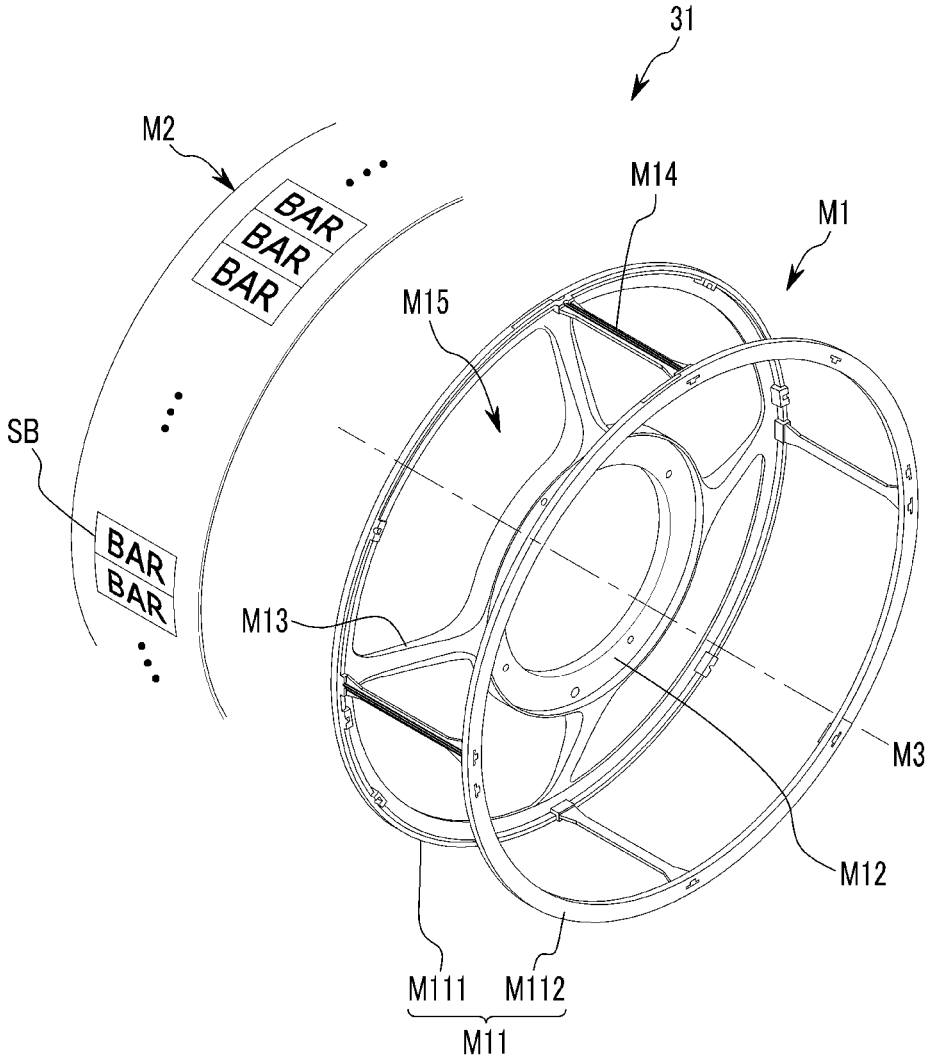
FIG. 10 is a schematic exploded perspective view of an exemplary reel of a reel assembly shown in FIG. 2 according to an embodiment of the present invention.

FIG. 9 is a schematic perspective view of an exemplary reel of a reel assembly shown in FIG. 2 according to an embodiment of the present invention, and FIG. 10 is a schematic exploded perspective view of an exemplary reel of a reel assembly shown in FIG. 2 according to an embodiment of the present invention.

Referring to FIG. 9, the reels 31*a* to 31*e* of a reel assembly 30 included in a primary display 20 have substantially equal diameters and are arranged in a coaxial manner such that they can rotate or spin around a common rotational axis. One reel 31 of the reels 31*a* to 31*e* is shown in FIG. 9 for easy description. The reels 31*a* to 31*e* may be configured to rotate individually. Although the number of the reels 31*a* to 31*e* is five in this embodiment, but it is not limited thereto.

A symbol sequence including a plurality of symbols SB is marked on each of the reels 31*a* to 31*e*. The symbol sequence may be determined by a symbol code table shown in FIG. 6. The reel assembly 30 further includes a backlight unit 34 that illuminate the symbols SB.

Referring to FIG. 9 and FIG. 10, each of the reels 31*a* to 31*e* includes a reel frame M1 and a reel stripe M2 disposed on an entire outer circumference of the reel frame M1. The plurality of symbols SB of the symbol sequence is marked on the reel stripe M2. The reel frame M1 may receive rotational force from a rotational axis of a motor (not shown) to rotate a central axis M3.

The reel frame M1 includes a rim M11, a herb M12, a plurality of spokes M13, and a plurality of connecting rods M14.

The rim M11 includes a pair of circular loops M111 and M112 that are arranged substantially parallel to each other along the central axis M3 and are spaced apart from each other by a substantially uniform distance.

The herb M12 has a shape of a ring, and is disposed at a center of one M111 of the two loops M111 and M112 in a coaxial manner. The herb M12 and the loop M111 are connected by the spokes M13. The herb M12 may transmit the rotational force from the motor to the rim M11.

The connecting rods M14 are connected between the pair of loops M111 and M112 such that they keep the distance between the pair of loops M111 and M112. The connecting rods M14 are arranged substantially in parallel along a circumference of the rim M11. The connecting rods M14 and the rim M11 form a plurality of rectangle-like openings M15.

The backlight unit 34 includes a plurality of light sources 34*s* such as light emitting diodes (LEDs), and the light sources 34*s* are partitioned by a plurality of partitions M4. Each of a plurality of lighting areas M5 defined by the partitions M4 corresponds to a symbol SB on a reel stripe M2.

Electrical Configuration of Slot Machine

Now, electrical structure of the slot machine 1 shown in FIG. 2 is described in detail with reference to FIG. 11 to FIG. 13.

Figure 11:
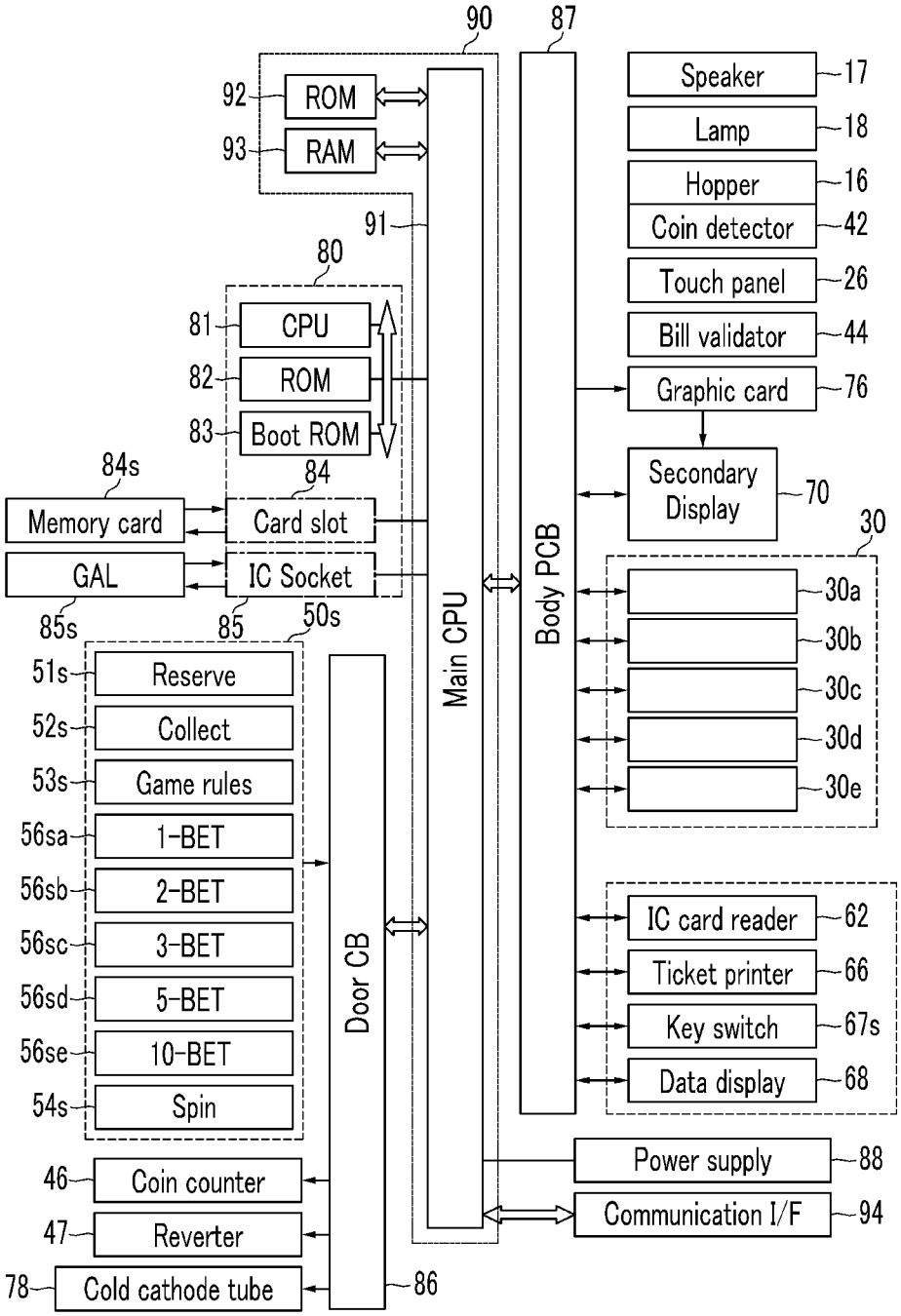
FIG. 11 is an electrical block diagram of the slot machine shown in FIG. 2 according to an embodiment of the present invention.
Figure 12:
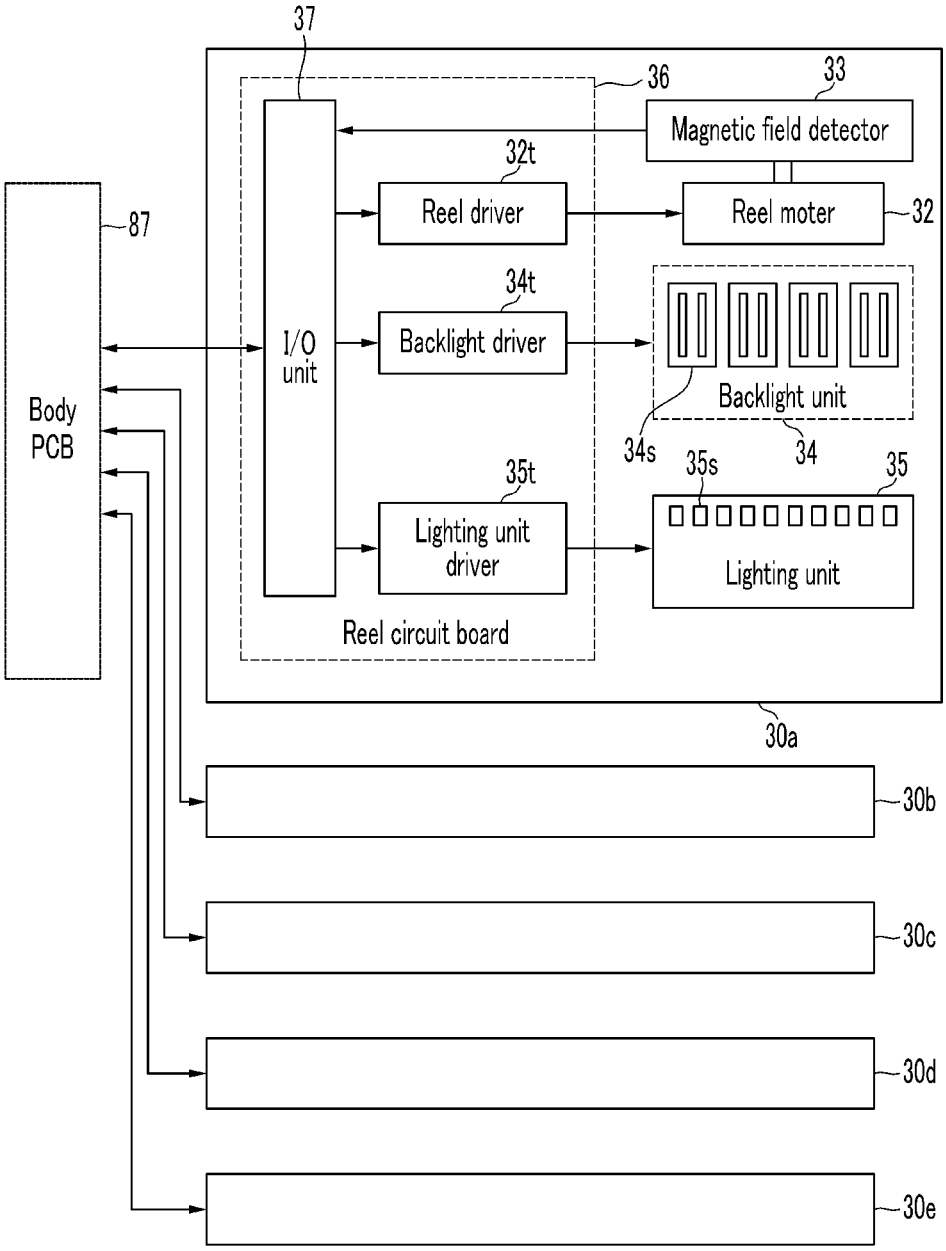
FIG. 12 is a block diagram of an electrical circuit of the reel assembly according to an embodiment of the present invention.
Figure 13:
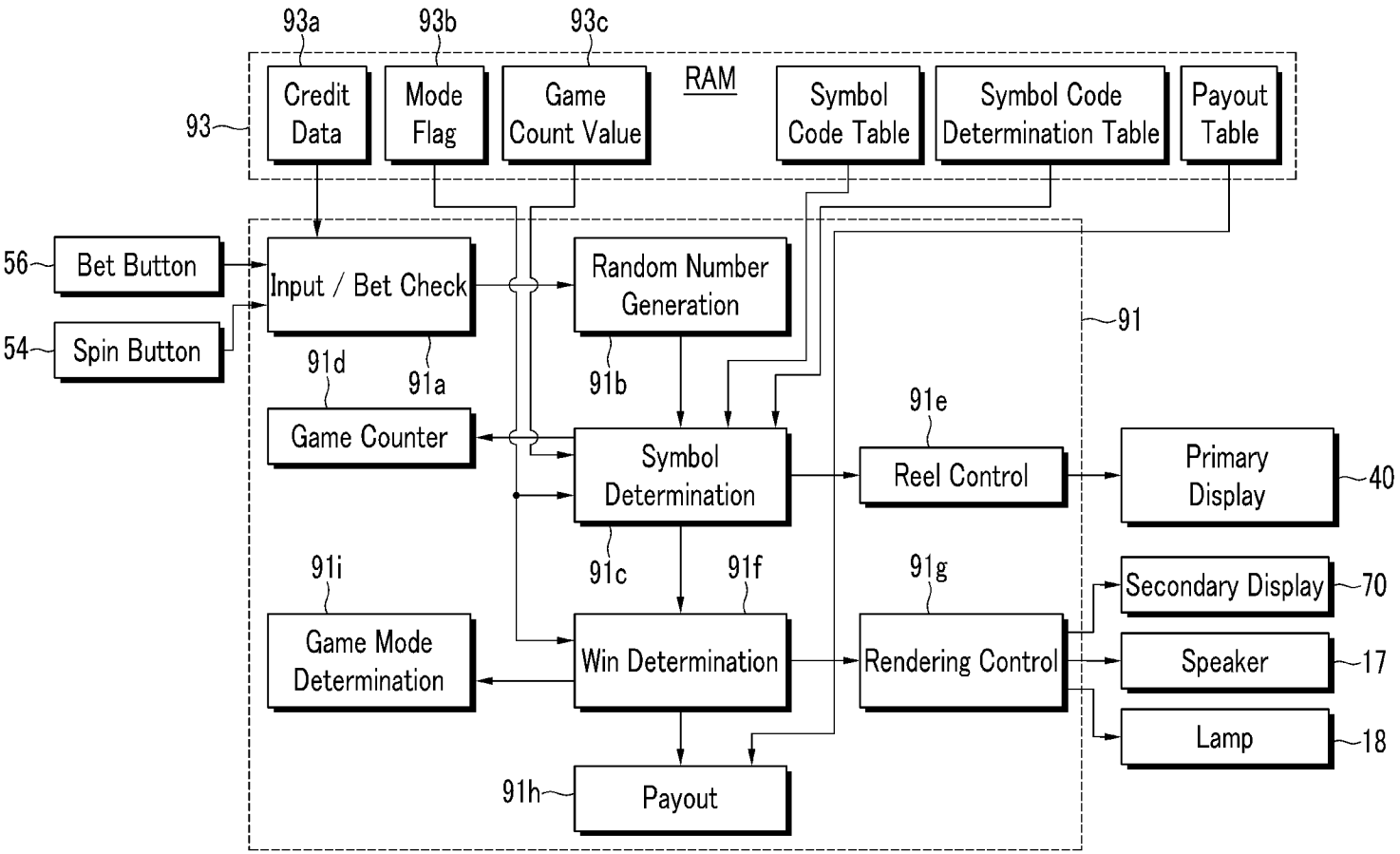
FIG. 13 is a functional block diagram of the game program executed by a main CPU of a motherboard in the slot machine shown in FIG. 2 according to an embodiment of the present invention.

FIG. 11 is an electrical block diagram of the slot machine shown in FIG. 2 according to an embodiment of the present invention, FIG. 12 is a block diagram of an electrical circuit of the reel assembly according to an embodiment of the present invention, and FIG. 13 is a functional block diagram of the game program executed by a main CPU of a motherboard in the slot machine shown in FIG. 2 according to an embodiment of the present invention.

Referring to FIG. 11, the gaming machine 1 includes a gaming board 80, a motherboard 90, and a door PCB 86, and a body PCB 87.

A gaming board 80 includes a CPU 81, a ROM 82 accessible by the CPU 81 through an internal bus, and a boot ROM 83 accessible by the CPU 81 by an internal bus. The gaming board 80 additionally includes a card slot 84 which can receive and communicate with a memory card 84*s*, and an IC socket 85 provided correspondingly to a Generic Array Logic (GAL) 85*s*.

The memory card 84*s* includes a non-volatile memory and stores a game program and a game system program.

The card slot 84 is configured to receive and eject the memory card 84*s*, and is connected to a motherboard 90 by an IDE bus. The details of the game performed in the slot machine 1 can be changed by replacing the memory card 84*s* with another one, or by withdrawing the memory card 84*s* from card slot 84, writing another program into the memory card 84*s*, and then inserting the memory card 84*s* into the card slot 84 again.

The GAL 85*s*, which is a type of a Programmable Logic Device (PLD) having a fixed OR array structure, has a plurality of input ports and output ports. When the GAL 85*s* receives certain data through the input ports, it outputs data corresponding to the input data through the output ports.

The IC socket 85 is configured in such a manner that the GAL 85*s* can be inserted into the IC socket 85 or detached from the IC socket 85, and connected to a motherboard 90 by a PCI bus.

The CPU 81, the ROM 82, and the boot ROM 83 interconnected by the internal bus are connected to the motherboard 90 by the PCI bus. The PCI bus enables signal transmission between the motherboard 90 and the gaming board 80, and supply of power from the motherboard 90 to the gaming board 80.

The ROM 82 stores an authentication program. The boot ROM 83 stores a preliminary authentication program, a boot code to be used by the CPU 81 for activating the preliminary authentication program, and the like. The authentication program is a tamper check program for authenticating the originality of the game program and the game system program. The preliminary authentication program is a program for authenticating the originality of the authentication program. The authentication program and the preliminary authentication program are written in a sequence of proving that the subject program has not been tampered.

The motherboard 90, which may be implemented using a commonly available general main board, executes the game program and the game system program. The motherboard 90 includes a main CPU 91, a ROM 92, a RAM 93, and a communication interface 94.

The ROM 92, which may be a flash memory, may be configured to store a program to be executed by the main CPU 91 such as BIOS, along with another data to be maintained permanently. When being executed by the main CPU 91, the BIOS performs initialization of peripheral devices. Also, the BIOS starts to load the game program and the game system program stored in the memory card 54 through the gaming board 80. The ROM 92 may be rewritable. However, write-protected one might be used as the ROM 92 as well.

The RAM 93 stores data and programs which are used during the operation of the main CPU 91. For example, when the game program, the game system program, or the authentication program is to be loaded, the RAM 93 can store such programs. Also, the RAM 93 is provided with working space for the execution of the programs. Examples of the space include a space for storing the number of bets, the payout amount, the credit amount, and the like can be maintained during the execution of the game. Also, plurality of tables defining symbols, symbol codes, winning combinations, and their probabilities are maintained during the execution of the game. Further, the RAM 93 stores symbol code determination tables which stores mapping information between symbol codes and random number which can used for determining symbols based on random numbers. In particular, the RAM 93 maintains a mode flag indicating the gaming mode, along with a game and a game counter of which count value indicates the number of executed chance games or the number of possibly remaining chance games.

Also, the RAM 93 stores count values of a plurality of counters, which include a bet counter, a payout amount counter, a credit amount counter, and a chance game counter which counts the number of chance games. Alternatively, however, some of the count values can be maintained in an internal register of the main CPU 91.

The communication interface 94 facilitates data communication of the main CPU 91 with an external controller of, for example, a server through a communication channel.

Besides, the motherboard 90 is connected to the door PCB 86 and the body PCB 87 by USB communications. The motherboard 90 is also connected to a power supply 88. The main CPU 91 of the motherboard 90 boots up and operates using the power supplied from the power supply 88, and passes over some of the power to the gaming board 80 through the PCI bus so as to boot up the CPU 81. The door PCB 86 and the body PCB 87 are connected to input devices such as a switch and a sensor, and peripheral devices of which operation are controlled by the main CPU 91. Also, the door PCB 86 is connected with a control panel 40, a coin counter 46, a reverter 47, and a cold cathode tube 78.

The control panel 40 has a reserve switch 51*s*, a collect switch 52*s*, a game rule switch 53*s*, a spin switch 54*s*, a 1-BET switch 56*as*, a 2-BET switch 56*bs*, a 3-BET switch 56*cs*, a 5-BET switch 56*ds*, and a 10-BET switch 56*es*, each of which is provided correspondingly to respective buttons 51 to 54 and 56*a* to 56*e*. The switches 51*s* to 54*s* and 56*as* to 56*es* detects pressing of the respective buttons 51 to 54 and 56*a* to 56*e* to output signals to the main CPU 91.

The coin counter 46 and the reverter 47 are disposed in the coin entry 41. The coin counter 46 validates legitimacy of coins inserted into the coin entry 41 in terms of material, shape, or the like. The coin counter 46 outputs a signal to the main CPU 91 when detecting a legitimate coin. Meanwhile, illegitimate coins are discharged to the coin tray 15. The reverter 47, which operates based upon a control signal from the main CPU 91, distributes the legitimate coins validated by the coin counter 46 into either a hopper 16 or a cash box (not shown in the drawing). The coins are guided into the hopper 16 when the hopper 16 is not filled with coins. Contrarily, however, the coins are guided into the cash box when the hopper 16 is filled with coins.

The cold cathode tube 78, which is disposed on the rear face of the secondary display 70, functions as a backlight and illuminates based on a control signal from the main CPU 91.

The body PCB 87 is connected with the speaker 17, the lamp 18, the hopper 16, a coin detector 42, the touch panel 26, a bill validator 44, the reel assembly 30, the IC card reader 62, a graphic card 76, the ticket printer 66, a key switch 67*s*, and the data display 68.

The lamp 18 flashes based upon a control signal from the main CPU 91. The speaker 17 outputs a sound such as BGM based upon the control signal from the main CPU 91.

The hopper 16, which operates based upon a control signal from the main CPU 91, pays out coins of the designated payout amount to the coin tray 15 through a coin payout exit formed between the belly glass 14 and the coin tray 15. The coin detector 42 detects coins paid out from the hopper 16 to output a detection signal to the main CPU 91.

The touch panel 26 detects a position touched by the player to provide the main CPU 91 with a position sense signal corresponding to the detected position. The bill validator 44 in the bill entry 43 provides, upon detection of a legitimate bill, the main CPU 91 with a bill detection signal corresponding to the bill amount.

The graphic card 76 controls video display of the secondary display 70 and the display panel 24 of the primary display 20 in response to a control signal from the main CPU 91. The graphic card 76 includes a Video Display Processor (VDP) generating video data, and a video RAM temporarily storing the video data. The video data may be originated from the game program stored in the RAM 93.

The IC card reader 62 reads out data stored in the IC card inserted into the card slot 176 to provide the read-out data to the main CPU 91. Also, the IC card reader 62 writes data received the main CPU 91 into the ID card.

The ticket printer 66 prints on a ticket the barcode containing information of the credit amount stored in the RAM 93, date and time, the identification number of the slot machine 1, and the like, in response to the control signal from the main CPU 91 to output the barcode imprinted ticket.

The key switch 67*s*, which is disposed behind the keypad 67, outputs a key detection signal to the main CPU 91 when the keypad 67 is pressed by the player.

The data display 68 displays information related the input through the keypad 67 in response to a control signal from the main CPU 91.

The body PCB 87 is also electrically connected to the reel assembly 30, which includes first to fifth reel units 30*a* to 30*e*, each of the reel unit 30*a* to 30*e* including the reels 31*a* to 31*e*, respectively.

Referring to FIG. 12, each of the reel units 30*a* to 30*e* includes a reel circuit board 36. The reel circuit board 36 includes an input/output (I/O) unit 37 capable of communicating with the body PCB 87, a reel driver 32*t* connected to the I/O unit 37, a backlight driver 34*t*, and a lighting unit driver 35*t*.

To the I/O unit 37 is connected a magnetic field detector 33, which includes a magnetic sensor for sensing magnetic field intensity to output a magnetic detection signal proportional to the magnetic field intensity, and sensor fixation means for fixing the magnetic sensor to a predetermined position. The magnetic sensor detects the intensity of the magnetic field generated by a magnet which is connected to a rotating axis of a reel motor 32 to rotate with the reel 31*a*.

The reel driver 32*t* supplies electric power to the reel motor 32. The backlight driver 34*t* supplies electric power individually to each light source 34*s* in a backlight unit 34. The lighting unit driver 35*t* supplies electric power individually to each light source 35*t* of a lighting unit 35.

Since a second to a fifth reel units 30*b* to 30*e* have the same configuration as a first reel unit 30*a*, detailed description thereof will be omitted.

The body PCB 87, which is connected to the main CPU 92, may be also electrically connected to the secondary display 70.

When the power is supplied to the slot machine 1, the main CPU 91 reads the authenticated game program and game system program from the memory card 84*s* through the gaming board 80 and writes the programs into the RAM 93. The game program is executed in a state being loaded into the RAM 93 in such a manner.

According to an embodiment, as shown in FIG. 13, the game program includes a input/bet check 91*a*, a random number generation 91*b*, a symbol determination 91*c*, a game counter 91*d*, a reel control 91*e*, a win determination 91*f*, a rendering control 91*g*, a payout 91*h*, and a game mode determination 91*i* to execute respective processing.

The bet/input check 91*a*, in an idle state where the reels 31*a* to 31*e* stop, continuously checks whether any of the BET buttons 56*a* to 56*e* or the SPIN button 54 is pressed. After the BET buttons 56*a* to 56*e* or the SPIN button 54 is pressed, the bet/input check 91*a* checks whether there remains any credit for the player on the basis of credit data 93*a* stored in the RAM 93. If the player has at least one remaining credit, the bet/input check 91*a* call the random number generation 91*b*.

Subsequently, the random number generation 91*b* generates random numbers to be used for the symbol determination 91*c*. In the present embodiment, the random number generation 91*b* generates five random numbers, each of which is directed to respective one of the first though the fifth reel units 30*a* to 30*e*.

After five random numbers are completely extracted, the symbol determination 91*c* determines a to-be-stopped symbol for each of the reel units 30*a* to 30*e* with reference to the symbol code determination table stored in the RAM 93. The symbol determination 91*c* uses the five random numbers to determine five to-be-stopped symbols for the reel units 30*a* to 30*e* to be shown in the display window 22 of the primary display 20 for each of the reels 31*a* to 31*e*.

In particular, the symbol determination 91*c* checks the current gaming mode with reference to mode flag 93*b* stored in the RAM 93, and differentiates the symbol determination process between the normal mode and the chance mode. In the normal mode, the symbol determination 91*c* applies a fixed symbol code determination table to determine the symbol using the random number according to a fixed scheme. In the chance mode, the symbol determination 91*c* may apply a symbol code determination table that is different from the symbol code determination table applied to the normal mode. In particular, the symbol determination 91*c* may consecutively change the symbol code determination table for each free round (i.e., each unit game) to vary the symbol determination process. The consequence of varying the symbol code determination table is that winning combinations including at least one specific symbol (for example, "7" symbol) increases as the chance games continue. Possible number of chance games available in a single session is limited to a certain limit that is randomly determined. For example, the certain limit may be determined as any one of six, eight, twelve, and fifteen based on a random number generated by the random number generation 91*b*. In order to limit the number of chance games, a game counter 91*d* counts the number of chance games already performed or possibly remaining in the session, and a game count value 93*c* is stored in the RAM 93. The game counter 91*d* may reside in the symbol determination 91*c*, alternatively.

The reel control 91*e* provides controls the reel assembly 30 by providing stop position information corresponding to the determined symbols, so that the reels 31*a* to 31*e* spins and stops at position designated by the stop position information. Thus, the symbols scrolls along with the spinning of the reels 31*a* to 31*e* and then stops in such a manner that the determined symbols are arranged in central position vertically in the display window 22 of the primary display 20.

Meanwhile, the win determination 91*f* determines whether any winning combination is established in the rearranged symbols. In case that a winning combination is established in the rearranged symbols, the rendering control 91*g* controls the primary display 20 and the other devices such as the speaker 17, the lamp 18, the secondary display 70 to output production effect. The production effect includes video and audio effect, backlight change, and lighting effect. Also, the payout 91*h* determines payout amount depending on the established winning combination to payout the amount the player obtained.

Meanwhile, whenever the unit game is completed, the game mode determination 91*i* determines the gaming mode of the next unit game. The game mode determination 91*i* changes the normal mode into the chance mode when a trigger event occurs in the rearranged symbols. On the other hands, the game mode determination 91*i* changes the chance mode into the normal mode when an exit condition is satisfied. The exit condition may be either a case that a counter of the game counter 91*d* reaches the certain limit or a case that a winning combination including three or more specific symbols is appeared in a free round. In the other cases, the game mode determination 91*i* maintains the previous gaming mode. Meanwhile, the game mode determination 91*i* can be implemented inside win determination 91*f*.

Gaming Operations

Hereinafter, gaming operations according to embodiments of the present invention are described in detail with reference to FIG. 14 to FIG. 44.

Normal Round

Figure 14:
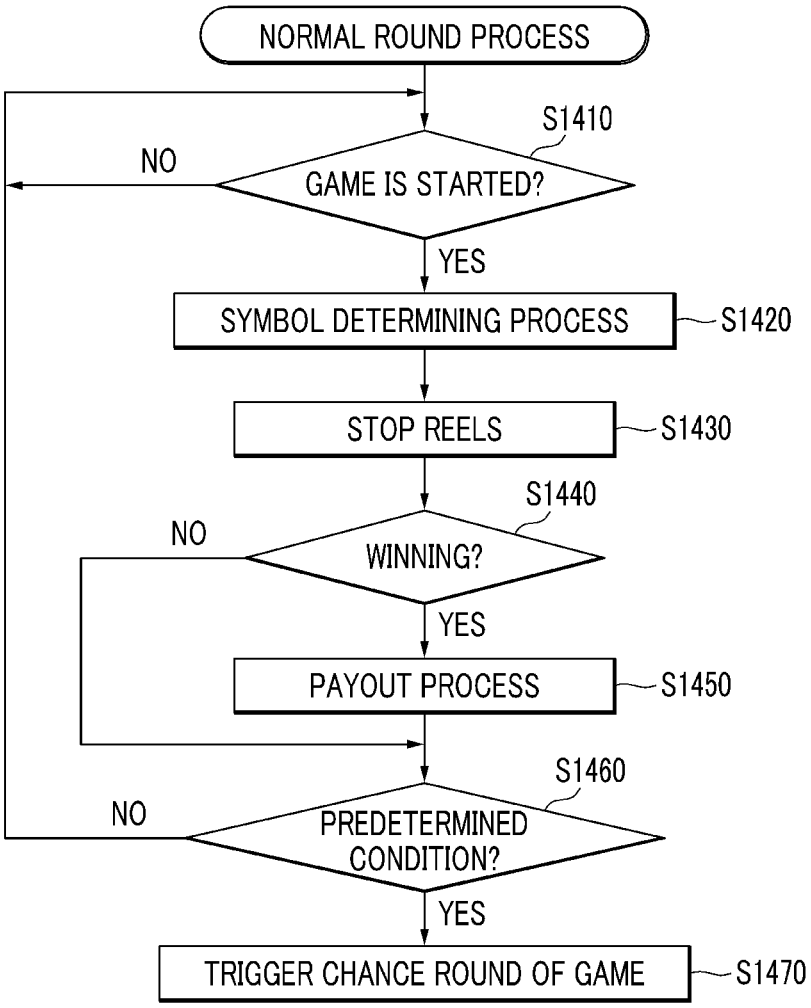
FIG. 14 is a flowchart of an exemplary normal round game process according to an embodiment of the present invention.

FIG. 14 is a flowchart of an exemplary normal round game process according to an embodiment of the present invention, and FIG. 15 is an exemplary symbol code determination table according to an embodiment of the present invention.

According to an embodiment of the present invention, a controller, i.e., a main CPU (91 of FIG. 11) of the gaming machine 1 performs a game process shown in FIG. 14 to execute a normal round of a game.

Referring to FIG. 14, after credits are bet by a player, the controller determines whether a normal round of a game is started by the player (S1410). The player may start the game by pressing a SPIN button (54 of FIG. 8). When the game is started, the controller executes a symbol determining process (S1420). In other words, the controller generates a random number for each of reels 31*a* to 31*e*, and determines positions where the reels 31*a* to 31*e* are to be stopped based on the generated random number and a symbol code determination table. Accordingly, symbols to be stopped on each payline are determined.

In one embodiment, a symbol code determination table for matching a code and a random number is stored in a memory of the gaming machine 1. The memory may be a RAM (93 of FIG. 11), a ROM (92 of FIG. 11), or other storage devices. In an example shown in FIG. 15, the symbol code determination table stores a plurality of codes and a range of random numbers corresponding to each of the codes, for each of the reels

31*a* to 31*e*. The range of random numbers corresponding to each code may determined by a probability of a winning combination for each symbol being satisfied. The probability corresponds to a weight of each symbol. The controller determines the code corresponding to the generated random number based on the symbol code determination table stored in the memory, and stops each of the reels 31*a* to 31*e* to appear the symbol corresponding to the determined code on each of the reels 31*a* to 31*e* (S1430). In this case, each of the reels 31*a* to 31*e* may be stopped such that the symbol corresponding to the determined code is appeared on a middle row of a display window 22.

The controller determines whether a combination of the symbols arranged on each pay line, i.e., a result of the game satisfies a winning combination (S1440). The winning combination is a combination where the combination of symbols arranged on the payline becomes a beneficial state for the player. The beneficial state is a state where credits corresponding to the winning combination are to be awarded the player. Various winning combinations are predefined for all symbols. For example, when at least three symbols of the same rank are continuously arranged from the first column on the pay line, the winning combination for the symbols is satisfied. The credits to be paid out may be varied according to a type of the symbol and/or the number of continuous symbols.

When the result of the game satisfies the winning combination (S1440: YES), the controller performs a payout process for awarding credits corresponding to the winning combination as a win (i.e., prize) (S1450). Further, the controller determines whether the result of the game satisfies a predetermined condition (S1460). The predetermined condition may be an appearance of "CHANCE" symbol on the display window 22. The "CHANCE" symbol may be appeared on only the third reel 31*c*. When the result of the game satisfies the predetermined condition (S1460: YES), the controller triggers a chance round of the game and executes a chance round process (S1470).

Next, exemplary screen images shown on a primary display 20 and a secondary display 70 in a normal round of a game according to an embodiment of the present invention are described with reference to FIG. 16 to FIG. 23. A controller of the gaming machine 1 may display the screen images on the primary display 20 and the secondary display 70.

Figure 16:
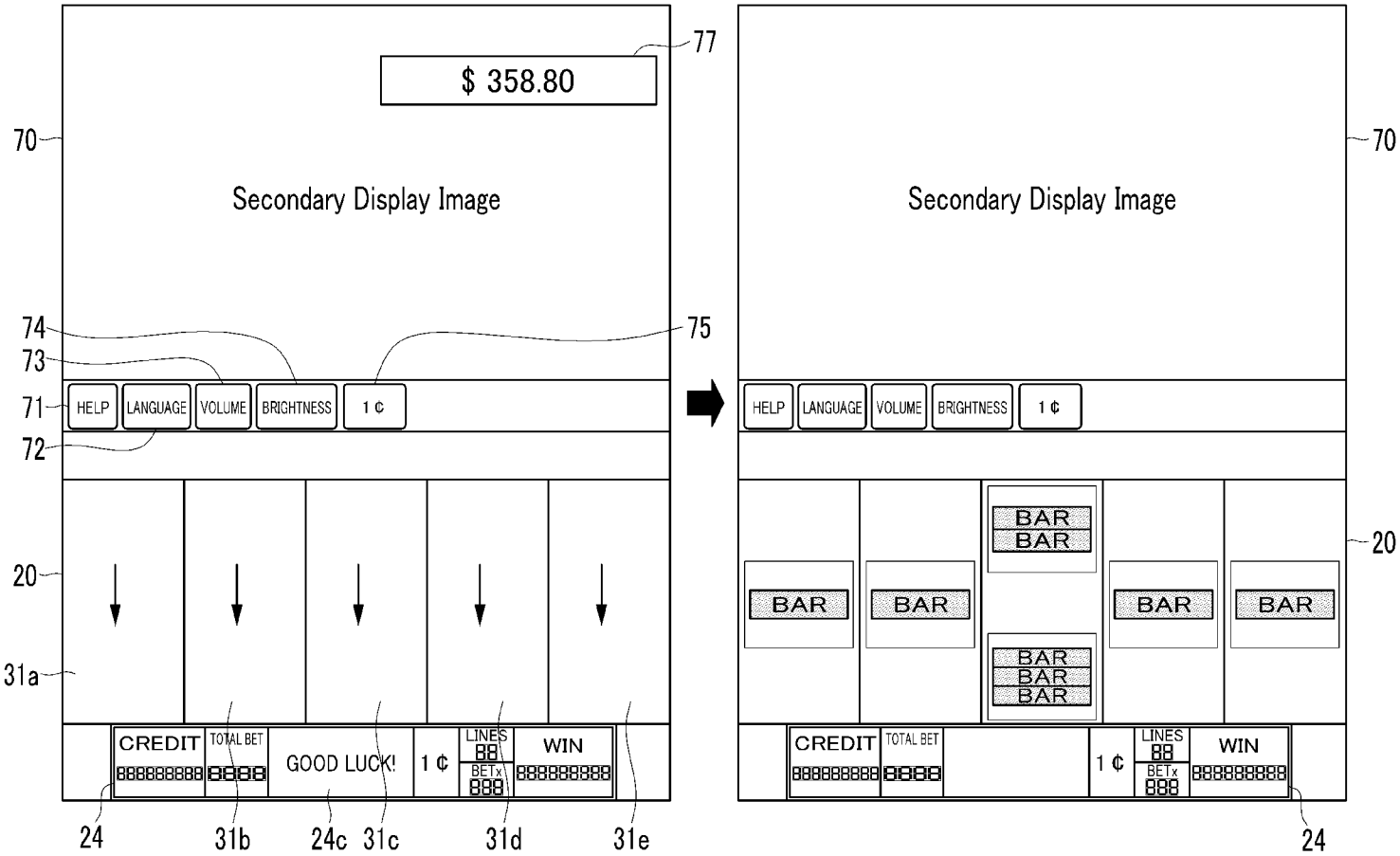
FIG. 16 is an exemplary screen image shown on a primary display and a secondary display in a normal round of a game according to an embodiment of the present invention.
Figure 17:
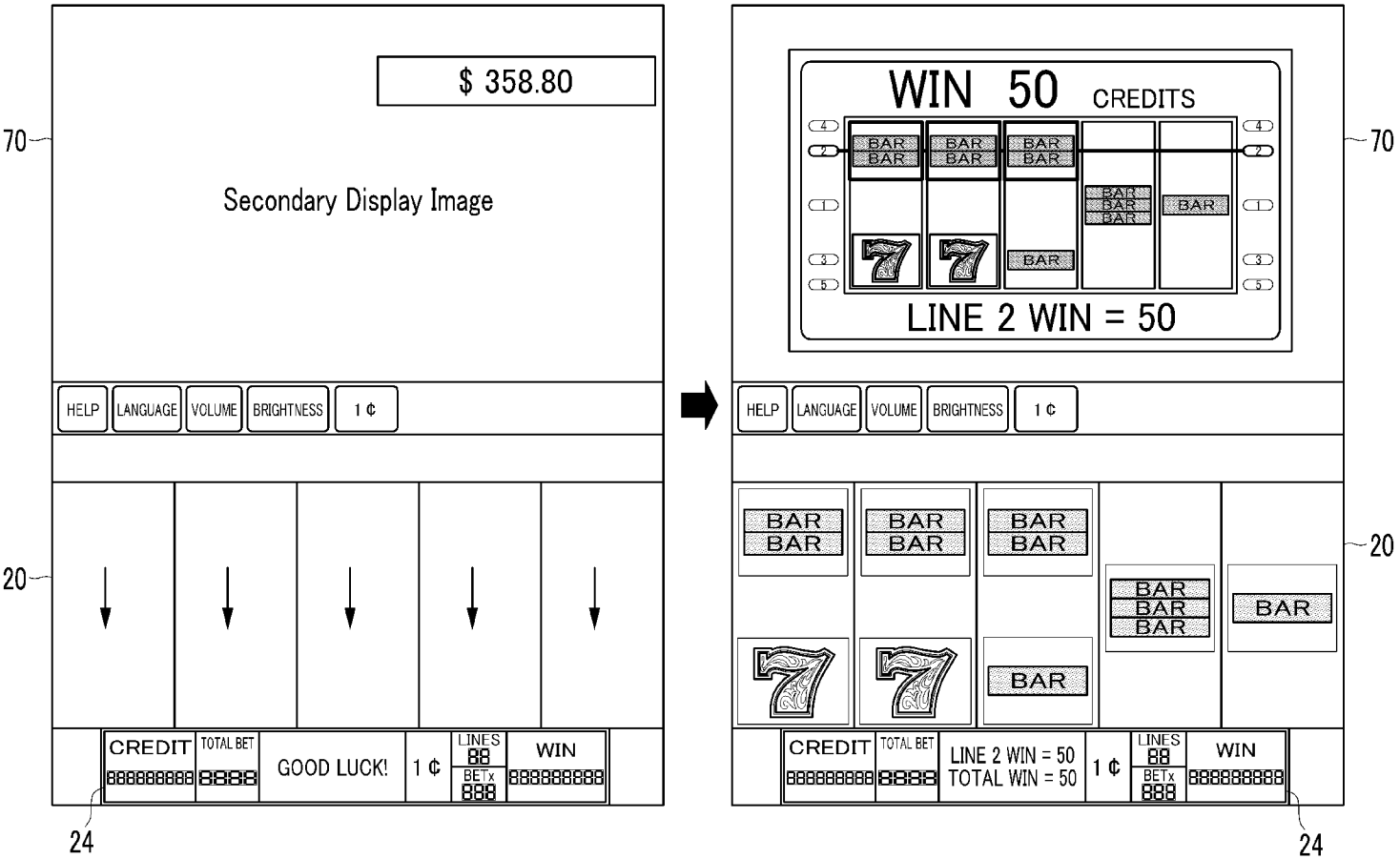
FIG. 17 is an exemplary screen image of a game result shown on a primary display and a secondary display in a normal round of a game according to an embodiment of the present invention.
Figure 18:
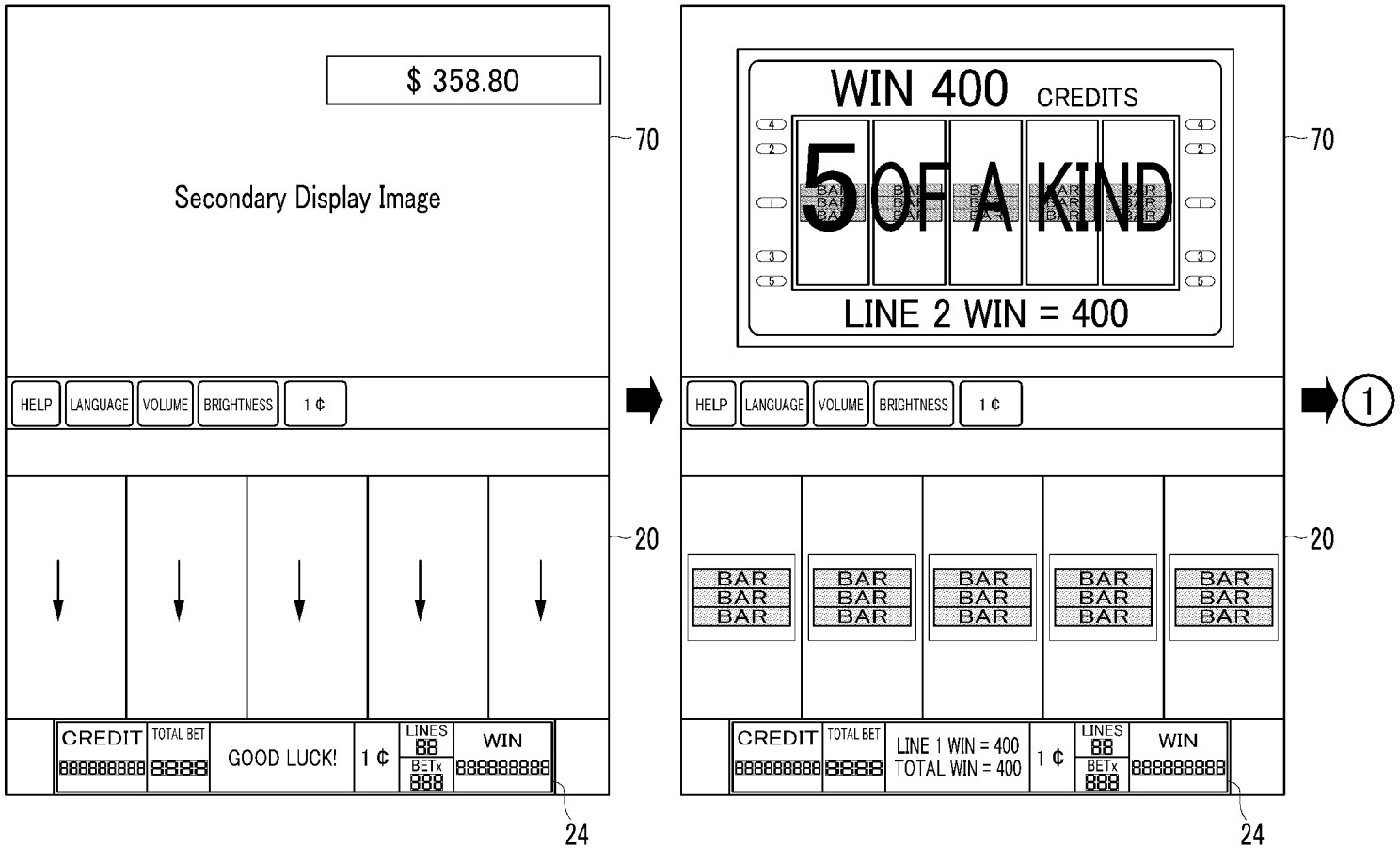
FIG. 18 is an exemplary screen image of five of a kind shown on a primary display and a secondary display in a normal round of a game according to an embodiment of the present invention.
Figure 19:
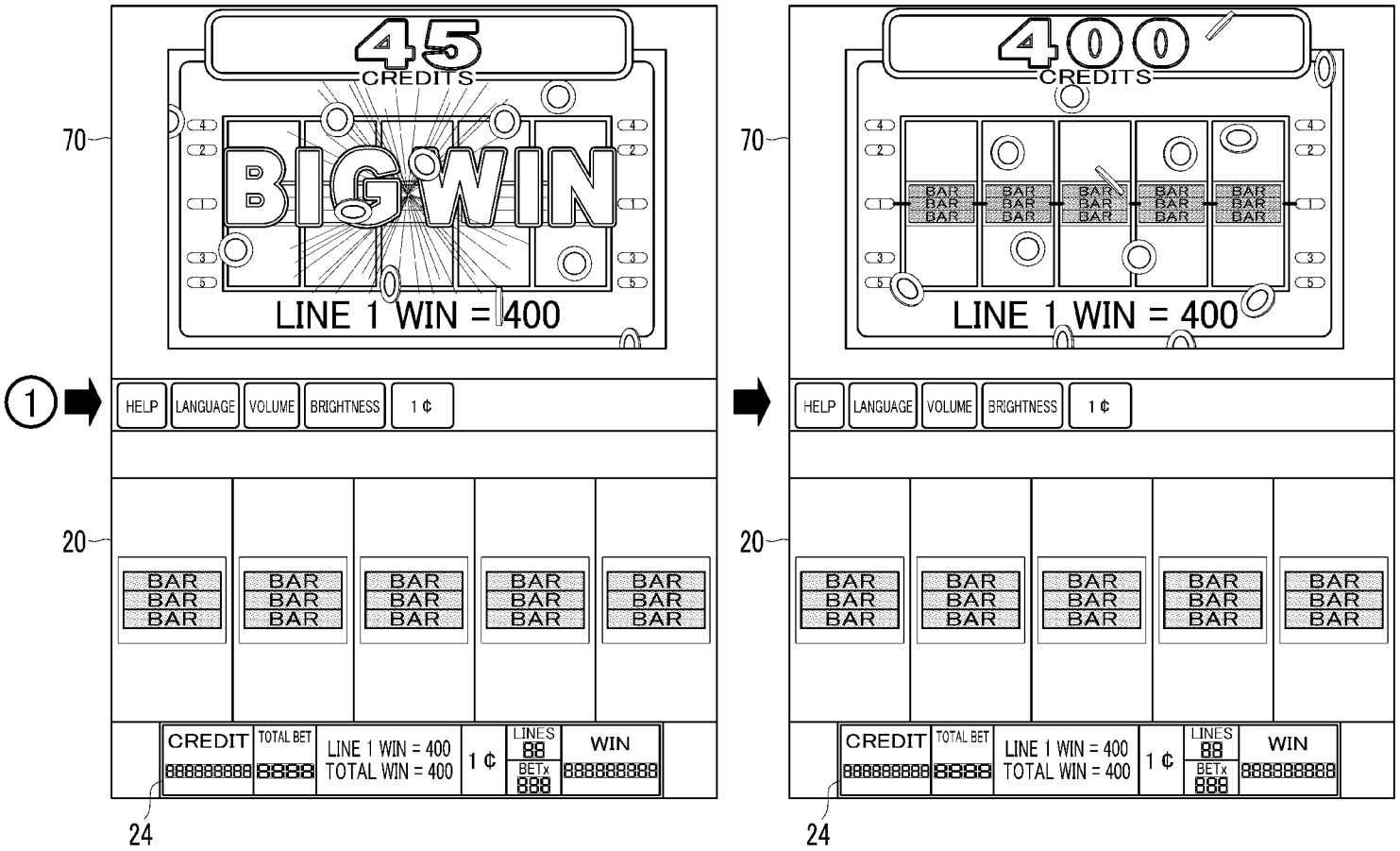
FIG. 19 is an exemplary screen image subsequent to the image shown in FIG. 18.
Figure 20:
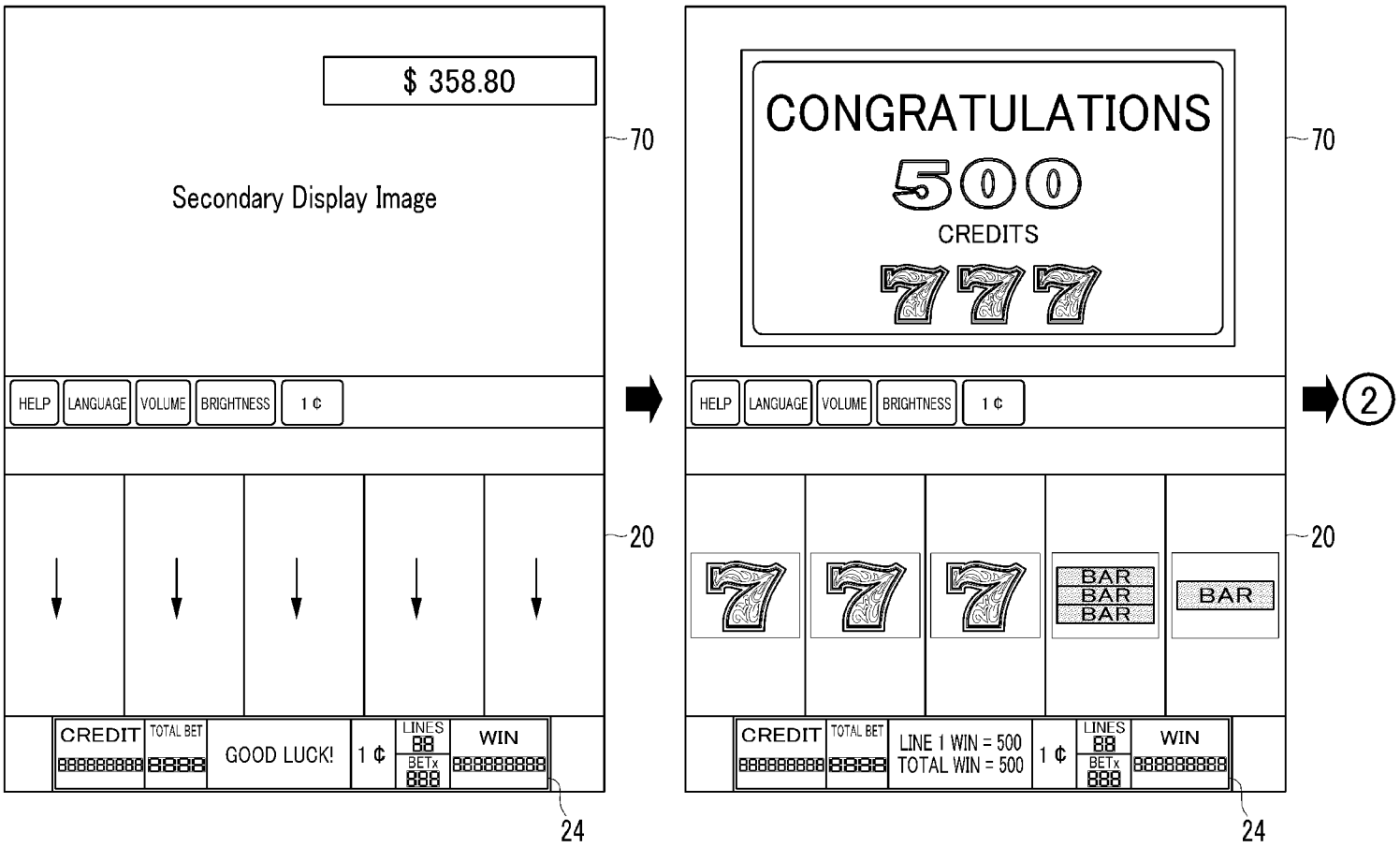
FIG. 20 is an exemplary screen image of a combination of 7 symbols shown on a primary display and a secondary display in a normal round of a game according to an embodiment of the present invention.
Figure 21:
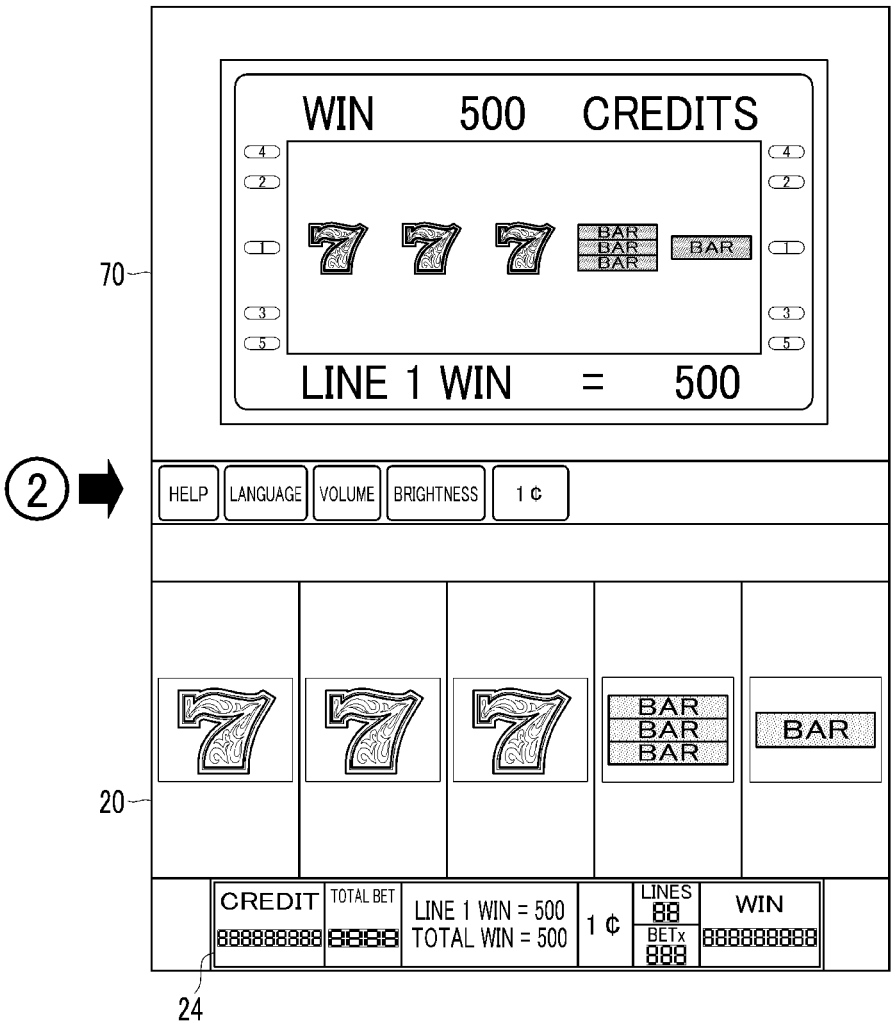
FIG. 21 is an exemplary screen image subsequent to the image shown in FIG. 20.
Figure 22:
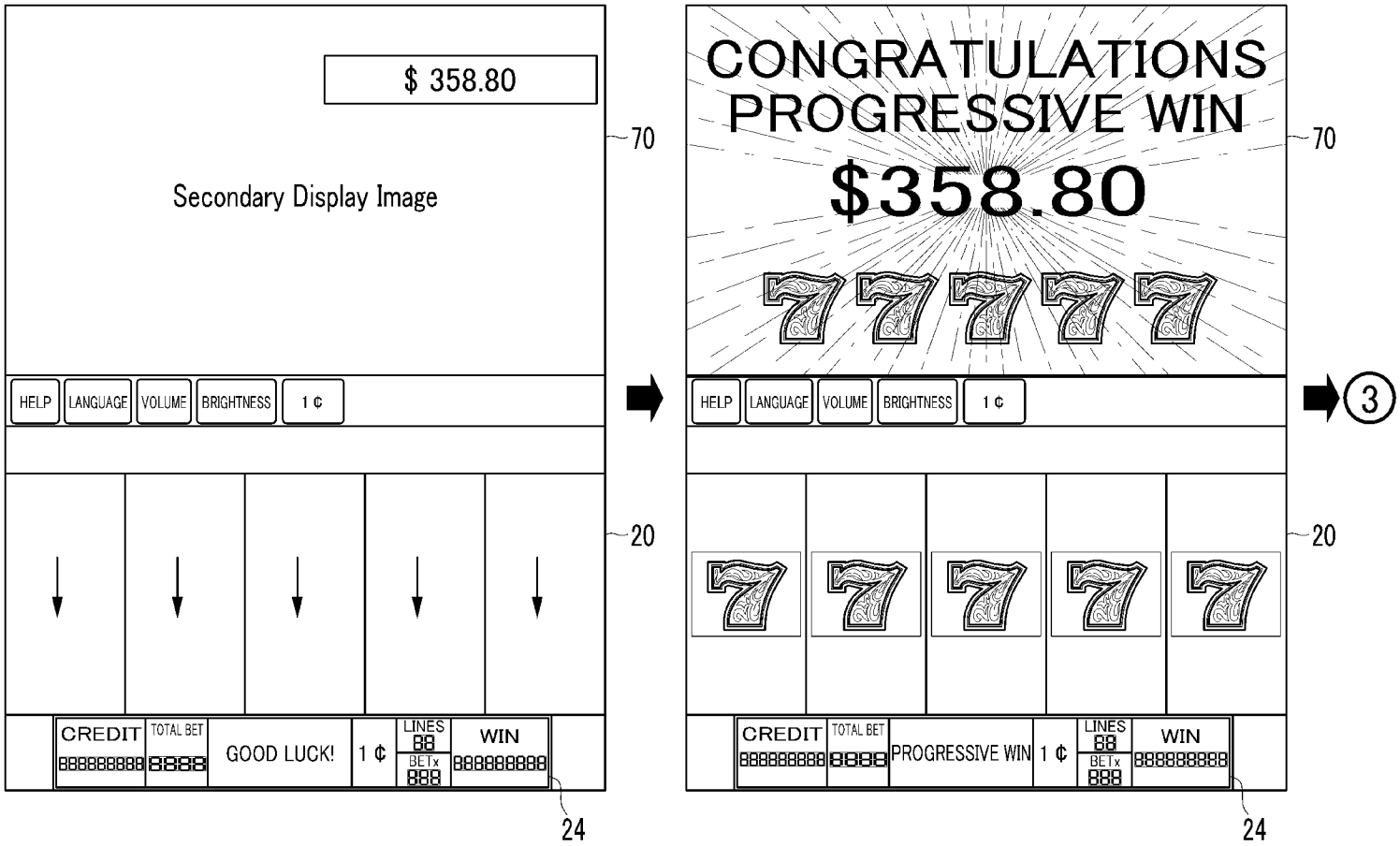
FIG. 22 is an exemplary screen image of a progressive jackpot shown on a primary display and a secondary display in a normal round of a game according to an embodiment of the present invention.
Figure 23:
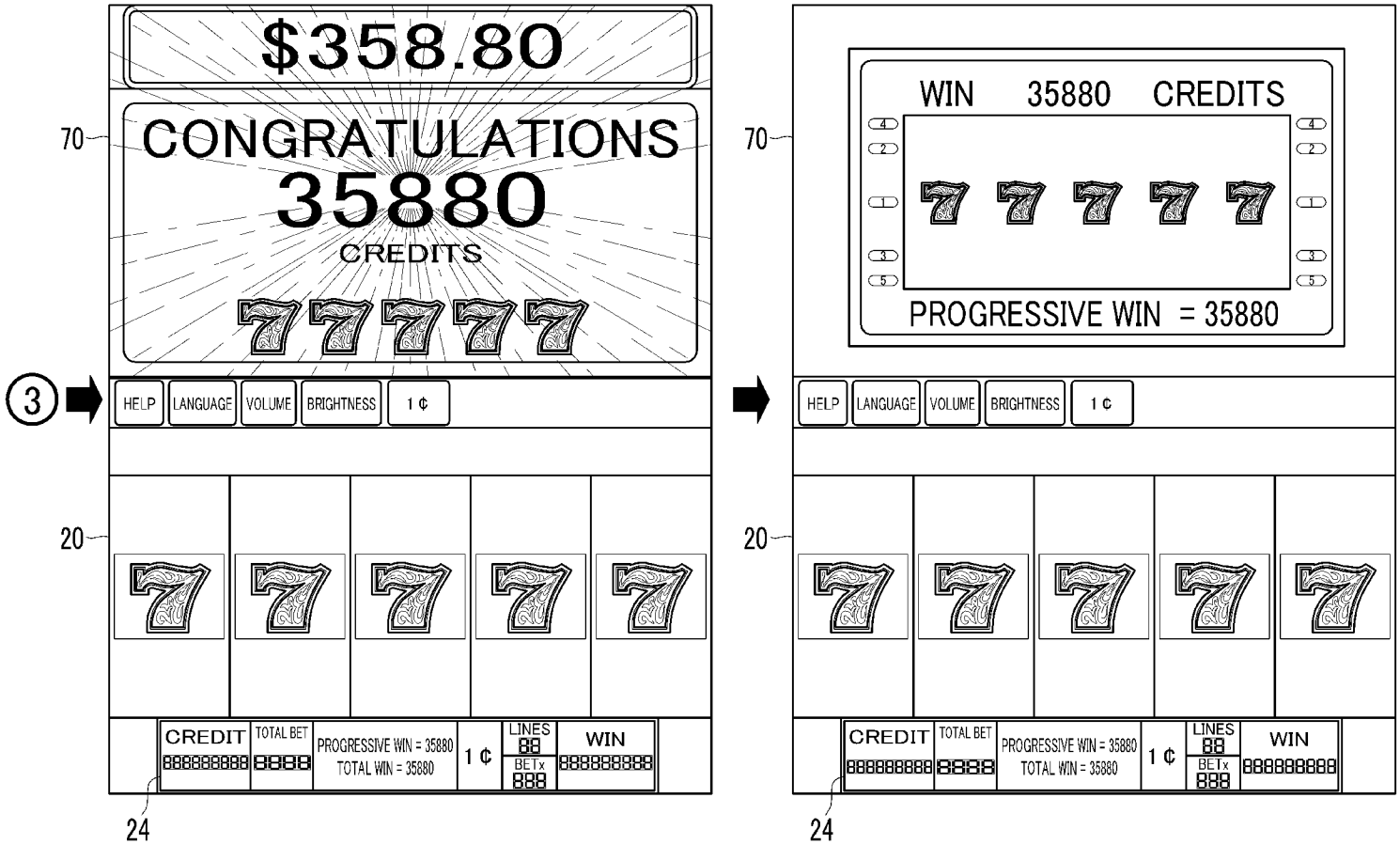
FIG. 23 is an exemplary screen image subsequent to the image shown in FIG. 22.

FIG. 16 is an exemplary screen image shown on a primary display and a secondary display in a normal round of a game according to an embodiment of the present invention, FIG. 17 is an exemplary screen image of a game result shown on a primary display and a secondary display in a normal round of a game according to an embodiment of the present invention, FIG. 18 and FIG. 19 are exemplary screen images of five of a kind shown on a primary display and a secondary display in a normal round of a game according to an embodiment of the present invention, FIG. 20 and FIG. 21 are exemplary screen images of a combination of 7 symbols shown on a primary display and a secondary display in a normal round of a game according to an embodiment of the present invention, and FIG. 22 and FIG. 23 are exemplary screen images of a progressive jackpot shown on a primary display and a secondary display in a normal round of a game according to an embodiment of the present invention.

Referring to FIG. 16, when a normal round of a game is executed, a plurality of reels 31*a* to 31*e* start to spin in a primary display 20. In this case, a display panel 24 of the primary display 20 may display a message such as "GOOD LUCK!" on a game message area 24*c*. After the reels 31*a* to 31*e* spin, the reels 31*a* to 31*e* are stopped according to the result of the symbol determining process, as shown in FIG. 16.

A secondary display 70 may display a secondary display image for representing a theme of a game. Various buttons 71 to 75 for setting a gaming machine 1 may be displayed on a lower part of the secondary display 70, and some of the buttons 71 to 75 may be operated by a player's touch. The various buttons 71 to 75 include, for example, a help button 71, a language button 72, a volume button 73, a brightness button 74, and a denomination button. The help button 71, if touched, displays help information on the secondary display 70. The language button 72, if touched, switches a language of the gaming machine 1 from one language to the other language. The volume button 73, if touched, increases or decreases a volume of a sound outputted from the gaming machine 1. The brightness button 74, if touched, increases or decreases a brightness of the secondary display 70. The denomination display section 75 displays a current denomination, for example, 1¢. When the gaming machine 1 supports a progressive jackpot, the secondary display 70 may further display an amount of the progressive jackpot on a progressive area 77. The progressive jackpot is a highest payout (i.e., a jackpot) for the gaming machine 1 where a value of the jackpot increases a small amount for every game played.

Referring FIG. 17, when the reels 31*a* to 31*e* are stopped according to the result of the symbol determining process, the result can satisfy a winning combination. In an example shown in FIG. 17, the winning combination is achieved by a combination of three "DOUBLE BAR" symbols arranged on the second payline. In this case, the secondary display 70 displays an image for symbols appeared on the display window 22, and an image representing the payline and a combination of symbols achieving the winning combination. Further, the secondary display 70 displays an image for notifying the payout (e.g., 50 credits) of the payline (e.g., LINE 2) achieving the winning combination, for example, as "WIN 50 CREDITS" and "LINE 2 WIN=50." Furthermore, the secondary display 70 displays an image for notifying total credits to be awarded by all paylines achieving the winning combination, for example, as "WIN 50 CREDITS." Moreover, the display panel 24 of the primary display 20 displays the payout of the payline achieving the winning combination (e.g., "LINE 2 WIN=50") and the total credits (e.g., "TOTAL WIN=50") on a game message area 24*c*.

Referring FIG. 18, when the reels 31*a* to 31*e* are stopped according to the result of the symbol determining process, the winning combination is achieved by a combination of five "TRIPPLE BAR" symbols arranged on the first payline. A combination of five symbols of the same rank is called "five of a kind." When five of a kind is achieved, the secondary display 70 displays an image of notifying five of a kind, for example, as "5 OF A KIND." Further, the display panel 24 displays a payout (e.g., 400 credits) of the payline (e.g., LINE 1) achieving the winning combination and the total credits on the game message area 24*c*, for example, as "LINE 1 WIN=400" and "TOTAL WIN=400."

Subsequently, the secondary display 70 displays an image for notifying the big win according to five of a kind, as shown in FIG. 19. The image for notifying the big win includes a message (e.g., "BIG WIN") for notifying the big win, a betting amount (e.g., 45 CREDITS), and a payout (e.g., "LINE 1 WIN=400") of the payline achieving the big win. Next, the secondary display 70 displays an image for symbols appeared on the display window 22, and the payline and a combination of symbols achieving the winning combination (i.e., the big win). Further, the secondary display 70 displays an image for notifying the payout (e.g., 400 credits) to be awarded.

Referring FIG. 20, when the reels 31*a* to 31*e* are stopped according to the result of the symbol determining process, the winning combination is achieved by a combination of "7" symbols arranged on the first payline. In an example in shown in FIG. 20, the combination of three "7" symbols is arranged on the first payline. When the combination of "7" symbols is arranged, the secondary display 70 displays an image for notifying an appearance of the combination of "7" symbols. The image further includes for a payout (e.g., 500 credits) according to the combination of "7" symbols and a congratulatory message (e.g., "CONGRATULATIONS") according to the combination of "7" symbols. Further, the display panel 24 displays a payout (e.g., 500 credits) of the payline (e.g., LINE 1) achieving the winning combination (e.g., "LINE 1 WIN=500") and the total credits (e.g., "TOTAL WIN=500") on the game message area 24*c*.

Subsequently, the secondary display 70 displays an image for symbols appeared on the display window 22, as shown in FIG. 21. Further, the secondary display 70 displays an image for notifying the payout (e.g., 500 credits) of the payline (e.g., LINE 1) achieving the winning combination, for example, as "WIN 500 CREDITS" and "LINE 1 WIN=500."

Referring FIG. 22, when the reels 31*a* to 31*e* are stopped according to the result of the symbol determining process, the winning combination is achieved by a combination of five "7" symbols arranged on the first payline. The combination of five "7" symbols corresponds to a progressive jackpot. Accordingly, the secondary display 70 displays an image for notifying the progressive jackpot according to the combination of five "7" symbols. The image further includes for a payout (e.g., $358.80), which is represented as a money, according to the combination of five "7" symbols and a congratulatory message (e.g., "CONGRATULATIONS PROGRESSIVE WIN") according to the progressive jackpot. Further, the display panel 24 displays a message (e.g., "PROGRESSIVE WIN") for notifying the progressive jackpot.

Subsequently, the secondary display 70 renders a screen shining brightly, and displays the payout according to the combination of five "7" symbols as credits (e.g., "35880 CREDITS"), as shown in FIG. 23. Further, the display panel 24 displays a payout of the payline achieving the winning combination (e.g., "PROGRESSIVE WIN=35880") and the total credits (e.g., "TOTAL WIN=35880") on the game message area 24*c*. Next, the secondary display 70 displays an image for symbols appeared on the display window 22. Further, the secondary display 70 displays an image for notifying the payout (e.g., 35880 credits) according to the progressive jackpot, for example, as "WIN 35880 CREDITS" and "PROGRESSIVE WIN=35880."

As described above, according to an embodiment of the present invention, various effects can be rendered by using the secondary display 70 and the display panel 24, according to the result of the symbol determining process, i.e., the result of the game.

Chance Round

Figure 24:
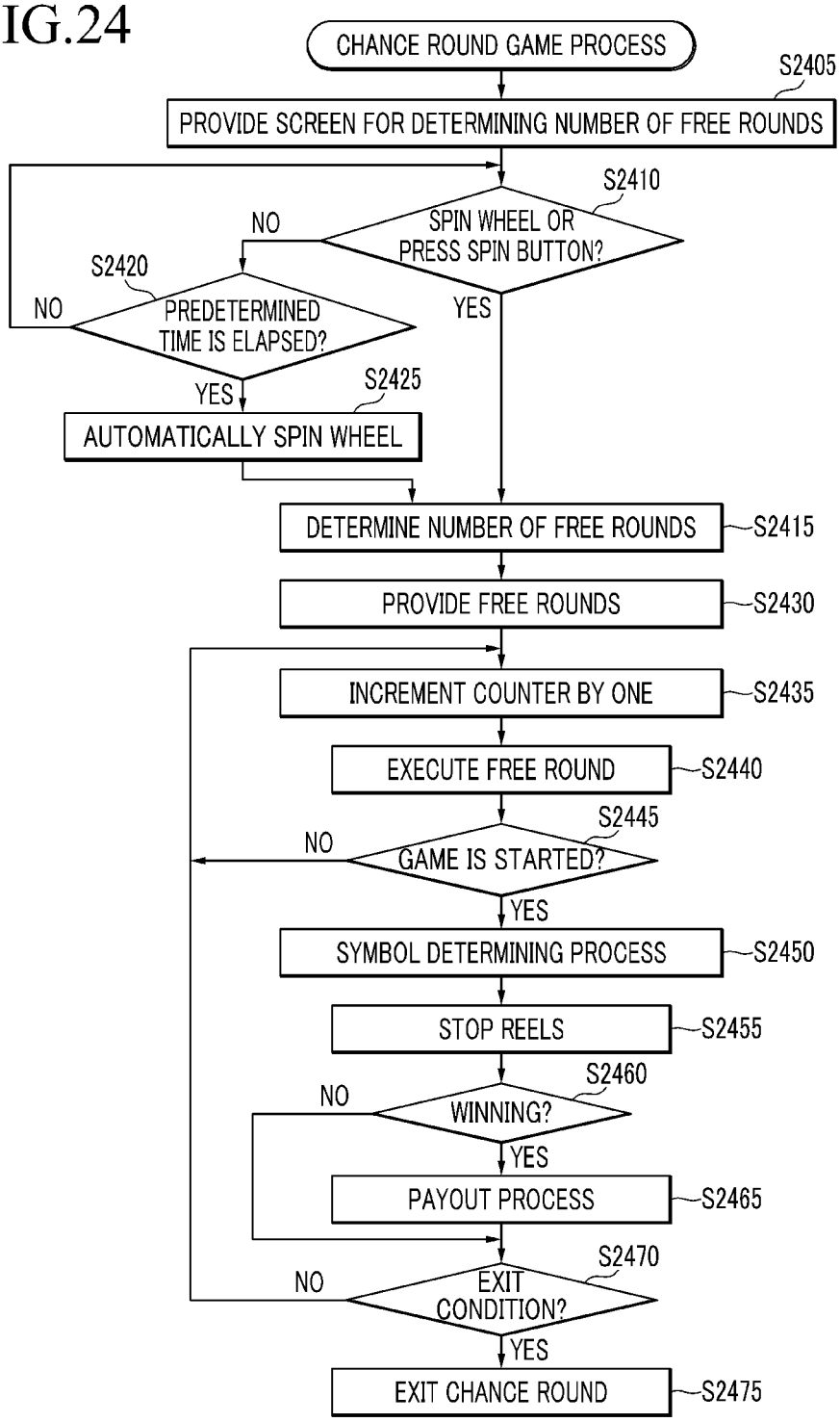
FIG. 24 is a flowchart of an exemplary chance round game process according to an embodiment of the present invention.
Figure 25:
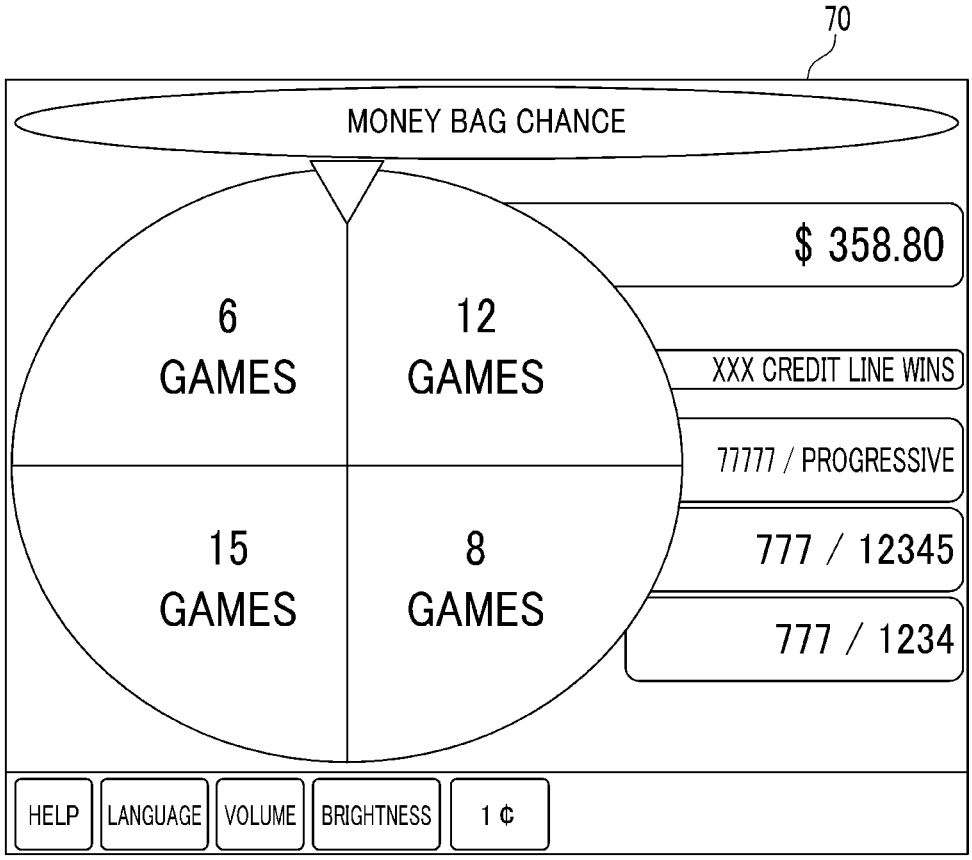
FIG. 25 is an exemplary screen image for determining a number of free rounds to be provided in a chance round according to an embodiment of the present invention.

FIG. 24 is a flowchart of an exemplary chance round game process according to an embodiment of the present invention, FIG. 25 is an exemplary screen image for determining a number of free rounds to be provided in a chance round according to an embodiment of the present invention, FIG. 26 is an exemplary symbol code determination table for a chance round according to an embodiment of the present invention, and FIG. 27 is an exemplary symbol code table for a chance round according to another embodiment of the present invention.

Referring to FIG. 14 again, a chance round of a game is triggered when a result of a normal round of the game satisfies a predetermined condition. When the chance round is triggered, a controller, i.e., a main CPU (91 of FIG. 11) of the gaming machine 1 performs a game process shown in FIG. 24 to execute the chance round of the game.

Referring to FIG. 24, the controller provides a screen for determining the number of free rounds to be provided in the chance round (S2405). The screen may be displayed on a secondary display 70. As shown in FIG. 25, the screen includes an image for a wheel having a plurality of options, and each of the plurality of options corresponds to the number of free rounds. The plurality of options, for example, includes an option for providing six free rounds (6 games), an option for providing eight free rounds (8 games), an option for providing twelve free rounds (12 games), and an option for providing fifteen free rounds (15 games). The secondary display 70 may further display an image for notifying the trigger of the chance round, for example as "MONEY BAG CHANCE." The secondary display 70 may further display an image for notifying payouts according to winning combinations. The winning combinations includes, for example, a combination of three "7" symbols, a combination of four "7" symbols, and a combination of five "7" symbols. The combination of five "7" symbols corresponds to the progressive jackpot.

The controller waits for an input of a player (S2410). When the player spins the wheel (S2410: YES), the controller determines the number of free rounds (S2415). The player may spin the wheel by moving a finger in a certain direction by touching the secondary display 70, or by pressing the SPIN button (54 of FIG. 8). Then, the secondary display 70 renders an effect that the wheel spins. The wheel may spin in either a clockwise direction or a counterclockwise direction according to a direction in which the player moves the finger. Further, the controller may randomly determine the number of free rounds. That is, the controller may generate a random number, and determine the number of free rounds based on the generated random number and a chance round determination table for matching the random number and the number of free rounds. The chance round determination table is stored in a memory of the gaming machine 1. The memory may be a RAM (93 of FIG. 11), a ROM (92 of FIG. 11), or other storage devices. In an example shown in FIG. 23, the chance round determination table stores a plurality of numbers and a range of random numbers corresponding to each of the numbers. The range of random numbers corresponding to each of the numbers may determined by a probability of each of the numbers being determined. The range of random numbers may be inversely proportional to the number of free rounds.

If there is no input of the player, the controller waits for the input of the player during a predetermined time. When there is no input of the player during the predetermined time (S2420: YES), the controller automatically spins the wheel (S2425) and determines the number of free rounds (S2415).

The controller provides the free rounds according to the determined number of free rounds (S2430). Next, the controller increments a counter for the chance round by one (S2435), and executes the free round (S2440). The controller determines whether the free round is started by the player (S2445). The player may start the free round by pressing a SPIN button (54 of FIG. 8) or the controller may automatically start the free round. When the free round is started, the controller executes a symbol determining process for the free round (S2450). In other words, the controller generates a random number for each of reels 31*a* to 31*e*, and determines positions where the reels 31*a* to 31*e* are to be stopped based on the generated random number and a symbol code determination table.

In one embodiment, a symbol code determination table for the free round may be the same as the symbol code determination table for the normal round.

In another embodiment, the symbol code determination table for the free round may be different from the symbol code determination table for the normal round, as shown in FIG. 26. In this case, a probability of a combination of a specific symbols being appeared in the symbol code determination table for the free round may be set higher than that in the symbol code determination table for the normal round. The specific symbols may be "7" symbols. For example, for the first reel 31*a*, a range (CL1B~CU1C, CL1N~CL1O, or CL1T~CL1U) of random numbers for the "7" symbol in FIG. 26 is wider than a range (NL1B~NU1C, NL1N~NL1O, NL1T~NL1U) of random numbers for the "7" symbol in FIG. 15. Alternatively, as shown in FIG. 27, the number of specific symbols may be increased in a symbol code table for the free round. That is, the number of "7" symbols in the symbol code table of FIG. 27 may be more than the number of "7" symbols in the symbol code table of FIG. 6. Furthermore, the probability of the combination of "7" symbols being appeared may be varied in a plurality of free rounds for the chance round.

The controller determines the code corresponding to the generated random number based on the symbol code determination table stored in the memory, and stops each of the reels 31*a* to 31*e* to appear the symbol corresponding to the determined code on each of the reels 31*a* to 31*e* (S2455). In this case, each of the reels 31*a* to 31*e* may be stopped such that the symbol corresponding to the determined code is appeared on a middle row of a display window 22. The controller determines whether a combination of the symbols arranged on each pay line, i.e., a result of the free round satisfies a winning combination (S2460).

When the result of the free round satisfies the winning combination (S2460: YES), the controller performs a payout process for awarding credits corresponding to the winning combination as a win (S2465). Further, the controller determines whether an exit condition of the chance round is satisfied (S2470). When the exit condition is satisfied (S2470: YES), the controller ends the chance round and returns to the normal round of the game (S2475). When the exit condition is not satisfied, the controller increments the counter by one and executes a next free round. That is, the controller repeats the process of the steps S2435 to S2470. The exit condition may be either a case that the counter reaches the determined number of free rounds or a case that a winning combination including three or more specific symbols, for example "7" symbols, is achieved in the free round.

Next, exemplary screen images shown on a primary display 20 and a secondary display 70 in a chance round of a game or at a time of a trigger of the chance round according to an embodiment of the present invention are described with reference to FIG. 28 to FIG. 37. A controller of the gaming machine 1 may display the screen images on the primary display 20 and the secondary display 70.

FIG. 28 to FIG. 32 are exemplary screen images shown on a primary display and a secondary display in a chance round of a game according to an embodiment of the present invention.

Figure 28:
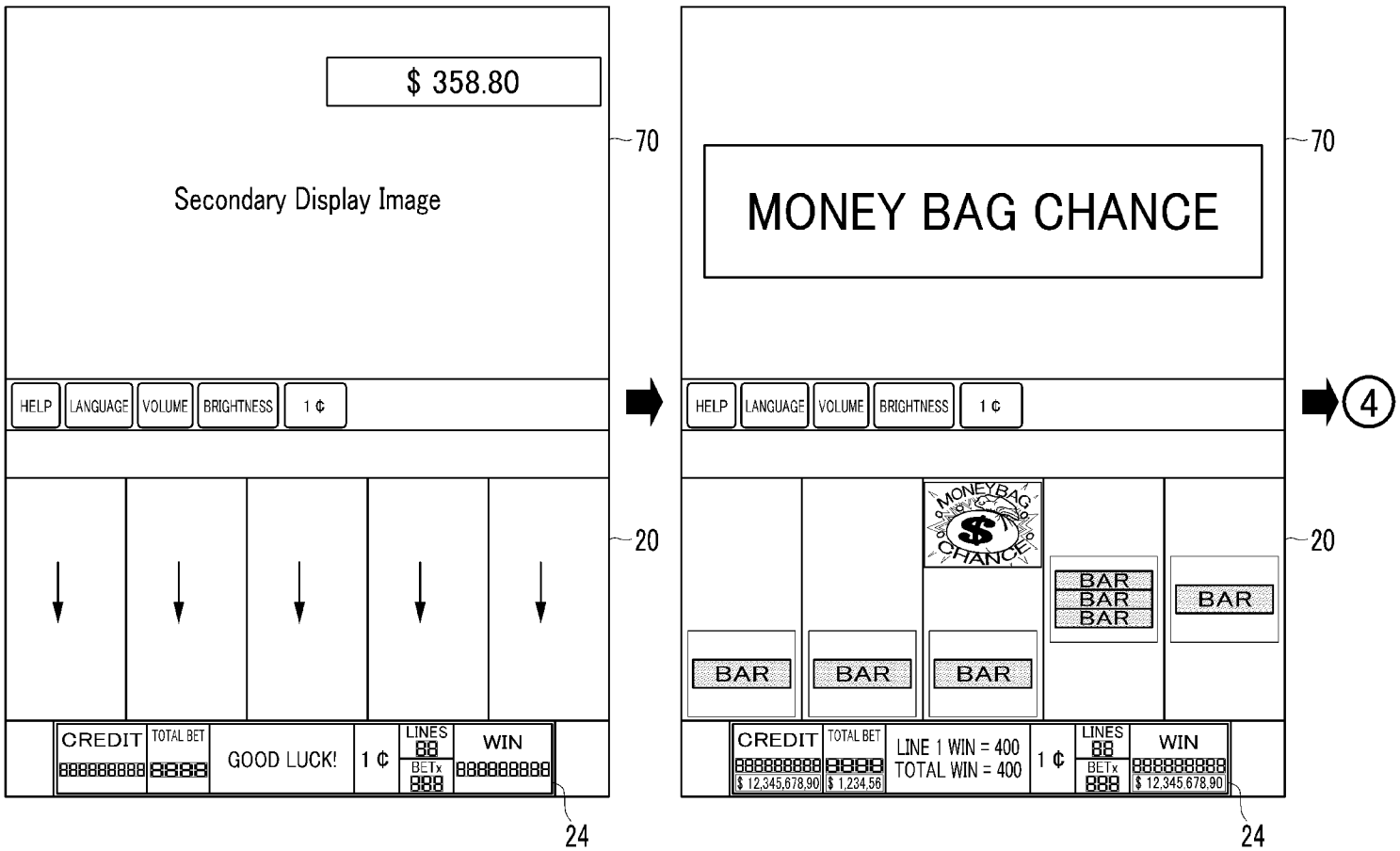
FIG. 28 is an exemplary screen image shown on a primary display and a secondary display in a chance round of a game according to an embodiment of the present invention.

Referring to FIG. 28, when a "CHANCE" symbol is appeared on a display window 22 in a normal round of a game, a chance round of the game is triggered. At this time, a secondary display 70 notifies a trigger of the chance round, for example as "MONEY BAG CHANCE." In this case, a display panel 24 of the primary display 20 may display a message for notifying the trigger of the chance round (e.g., "MONEY BAG CHANCE") on a game message area 24*c*.

Figure 29:
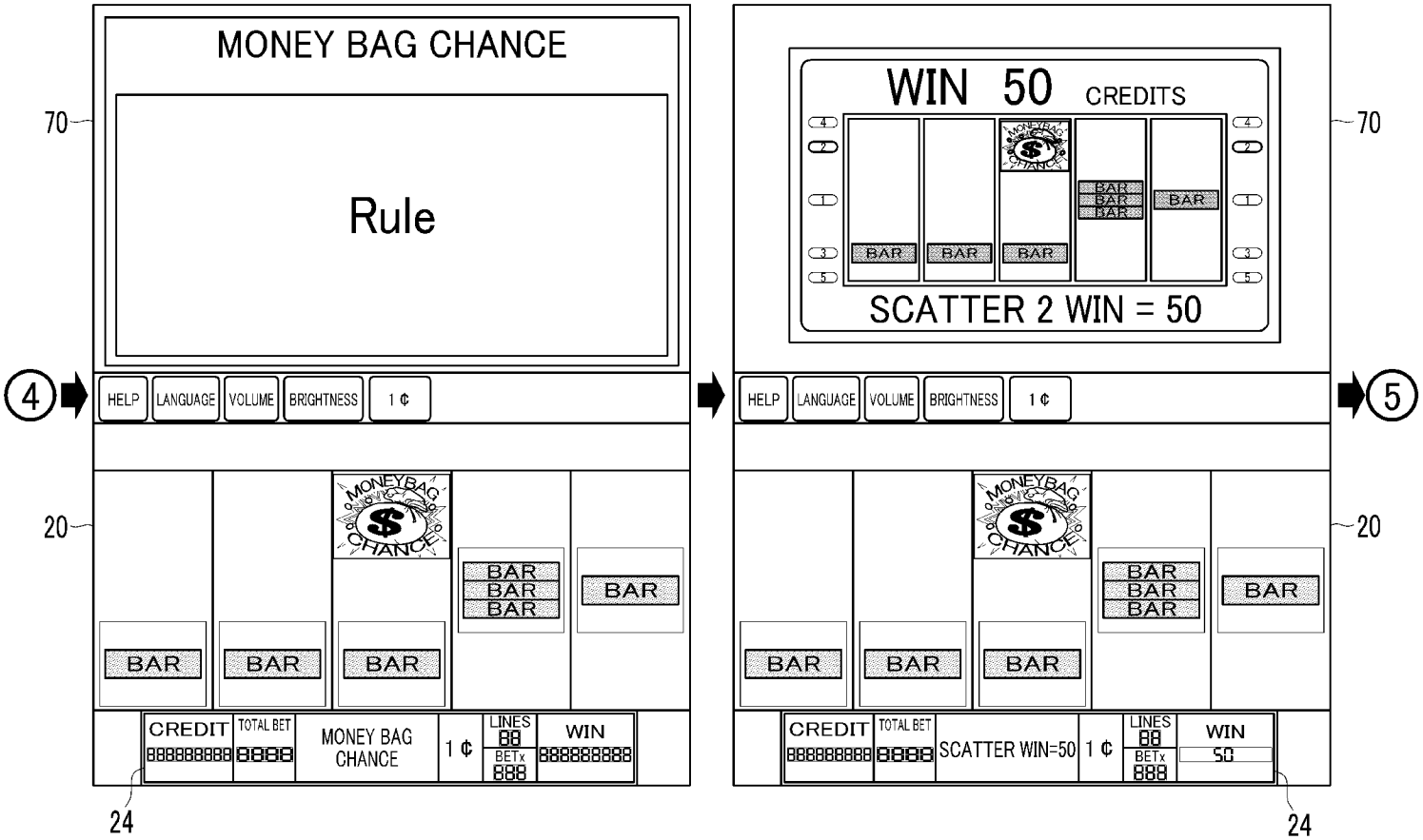
FIG. 29 is an exemplary screen image subsequent to the image shown in FIG. 28.

Next, the secondary display 70 displays a rule of the chance round as shown in FIG. 29. Subsequently, the secondary display 70 displays an image for symbols appeared on the display window 22, and an image representing a combination of symbols (i.e., the "CHANCE" symbol) achieving the winning combination. Further, the secondary display 70 displays an image for notifying the payout (e.g., 50 credits) according to the scatter symbol such as the "CHANCE" symbol, for example, as "WIN 50 CREDITS" and "SCATTER WIN=50." Moreover, the display panel 24 of the primary display 20 displays the payout according to the scatter symbol (e.g., "SCATTER WIN=50") on a game message area 24*c*.

Figure 30:
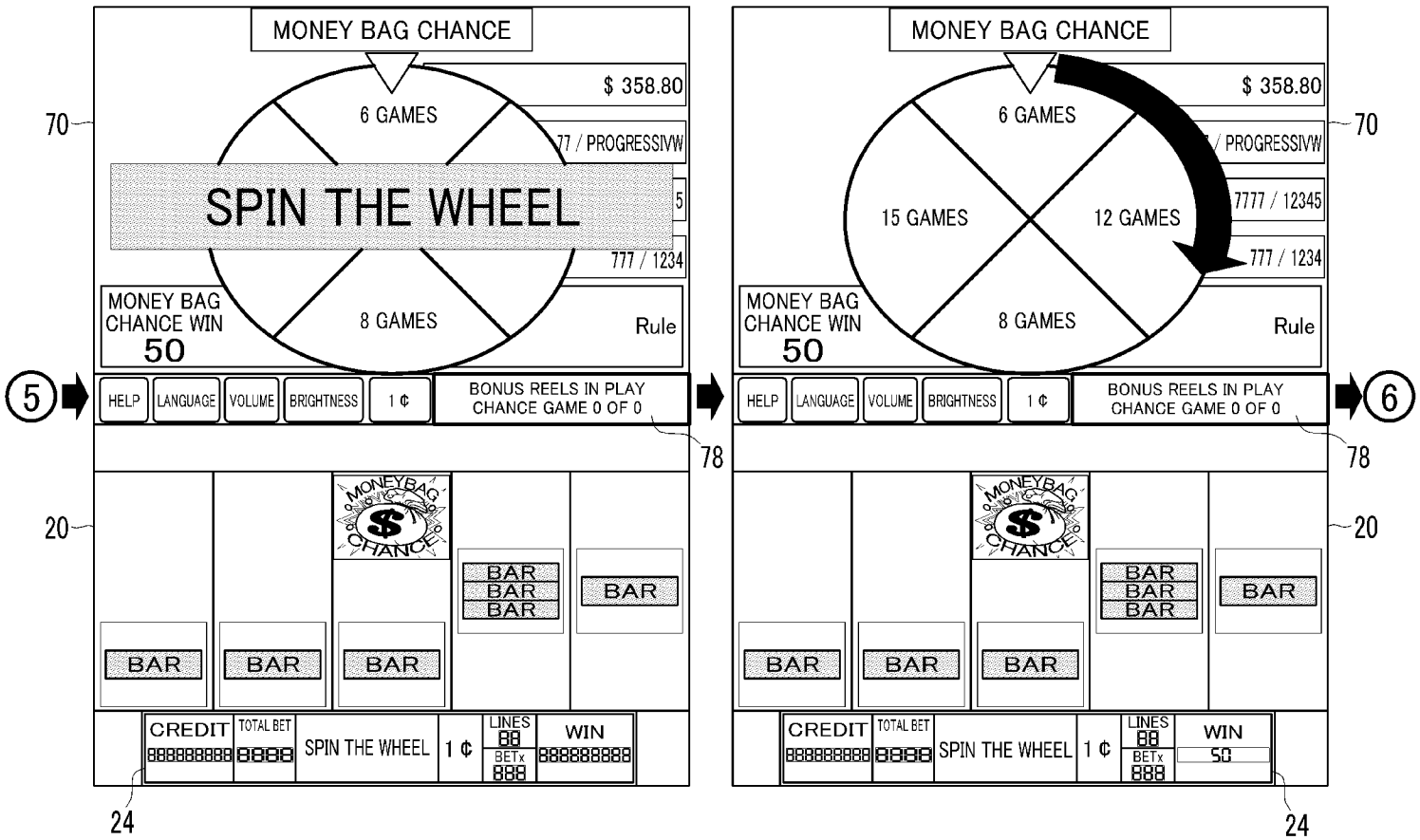
FIG. 30 is an exemplary screen image subsequent to the image shown in FIG. 29.

Next, the secondary display 70 displays a wheel having a plurality of options each corresponding to the number of free rounds, as shown in FIG. 30. The secondary display 70 displays a message (e.g., "SPIN THE WHEEL") for notifying the player to spin the wheel. Further, the display panel 24 displays the message (e.g., "SPIN THE WHEEL") for notifying the player to spin the wheel. Furthermore, the secondary display 70 displays a chance round counter 78 on a lower part. The chance round counter 78 indicates the total number of free rounds and the number of executed free rounds. Before the number of free rounds is determined, the chance round counter 78 displays the total number of free rounds and the number of executed free rounds as zero and zero, respectively. For example, the chance round counter 78 displays "BONUS REELS IN PLAY" and "CHANCE GAME 0 OF 0".

Figure 31:
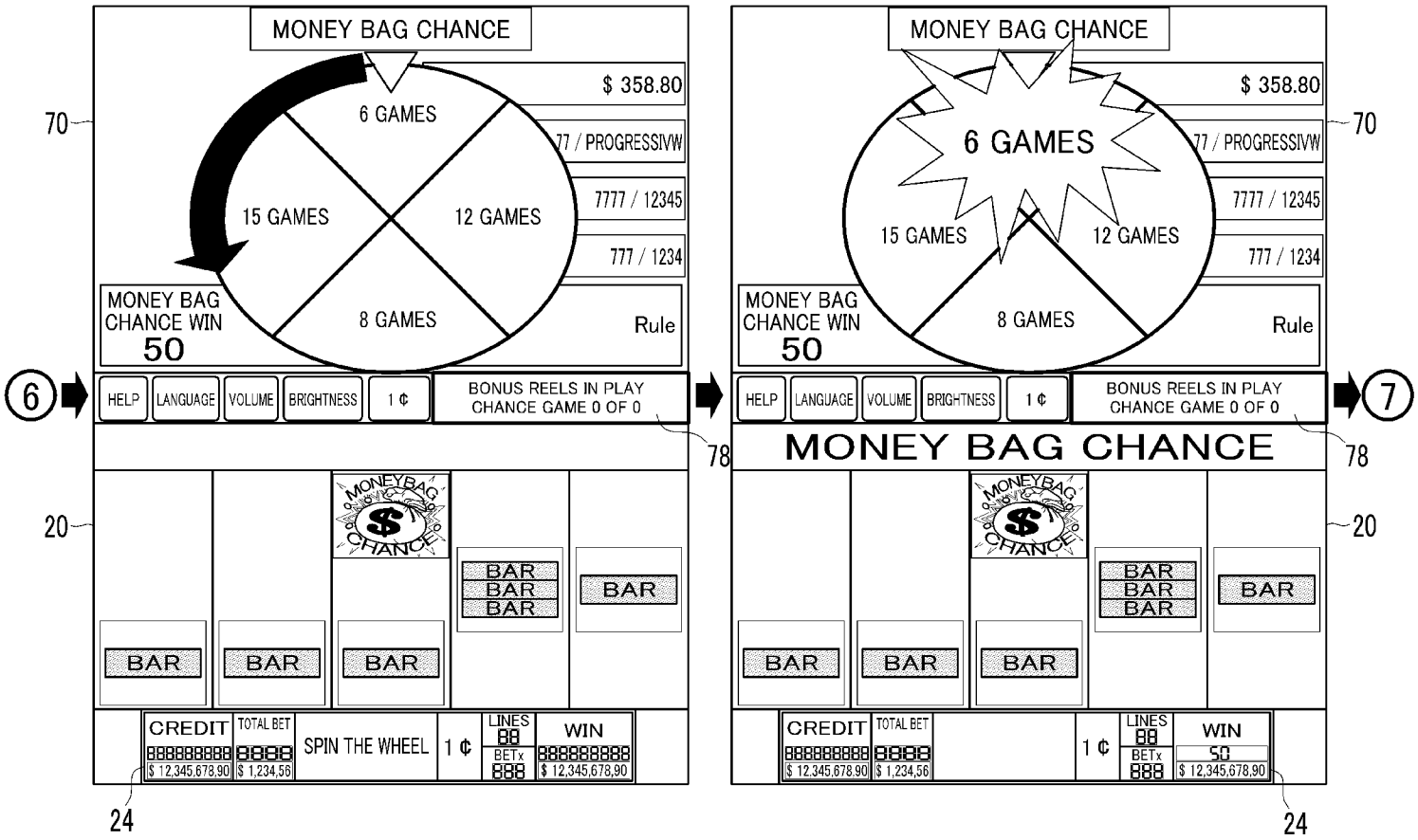
FIG. 31 is an exemplary screen image subsequent to the image shown in FIG. 30.

Subsequently, the secondary display 70 displays an image for indicating the player to spin the wheel in a clockwise direction as shown in FIG. 30. At this time, an image that a finger image is spinning in the clockwise direction along with the wheel may be displayed in order to indicate the player to move a finger in the clockwise direction with continuously touching a screen of the secondary display 70. Next, the secondary display 70 displays an image for indicating the player to spin the wheel in a counterclockwise direction as shown in FIG. 31. At this time, an image that the finger image is spinning in the counterclockwise direction along with the wheel may be displayed in order to indicate the player to move the finger in the counterclockwise direction with continuously touching the screen of the secondary display 70. When the player moves the finger in the clockwise or counterclockwise direction along with the wheel, the secondary display 70 displays an image that the wheel spins in the clockwise or counterclockwise direction. Further, the controller randomly determines the number of free rounds, and displays in the secondary display 70 an image that the wheel is stopped at a position corresponding to the determined number of free rounds. In an example shown in FIG. 31, the wheel is stopped at a position corresponding to six games of the free rounds.

Figure 32:
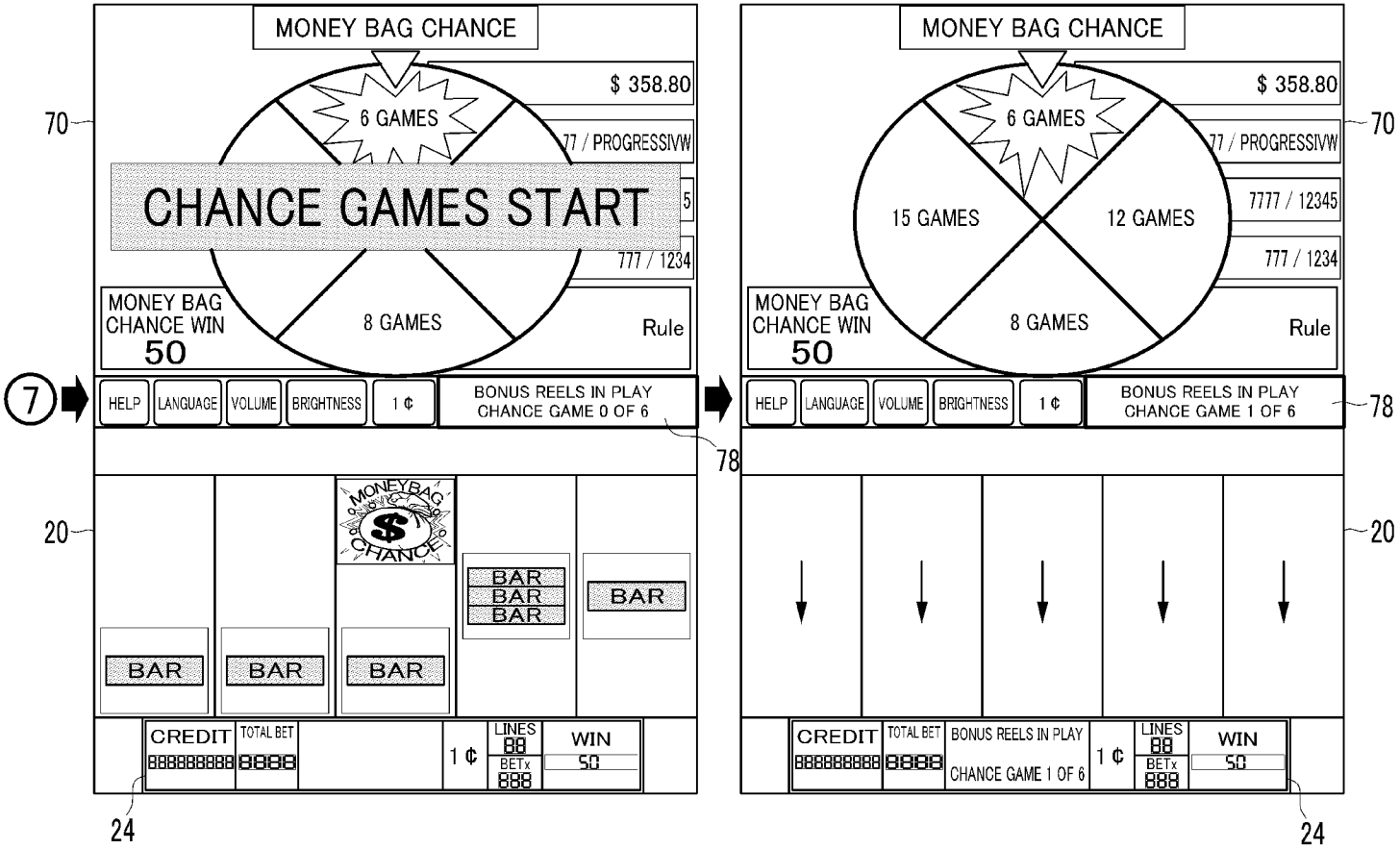
FIG. 32 is an exemplary screen image subsequent to the image shown in FIG. 31.

Subsequently, the secondary display 70 notifies a start of the chance round as shown in FIG. 32. For example, the secondary display 70 may display "CHANCE GAMES START." At this time, the secondary display 70 displays the determined numbers of free rounds in the chance round counter 78, for example as "CHANCE GAME 0 OF 6". Next, the free round is started, and the plurality of reels 31*a* to 31*e* spins. At this time, the chance round counter 78 increments the number of executed free rounds by one, for example as "CHANCE GAME 1 OF 6". Further, the display panel 24 of the primary display 20 displays the total number of free rounds and the number of executed free rounds. When the plurality of reels 31*a* to 31*e* are stopped according to the result of the symbol determining process, a payout is provided if a winning combination is achieved.

Figure 33:
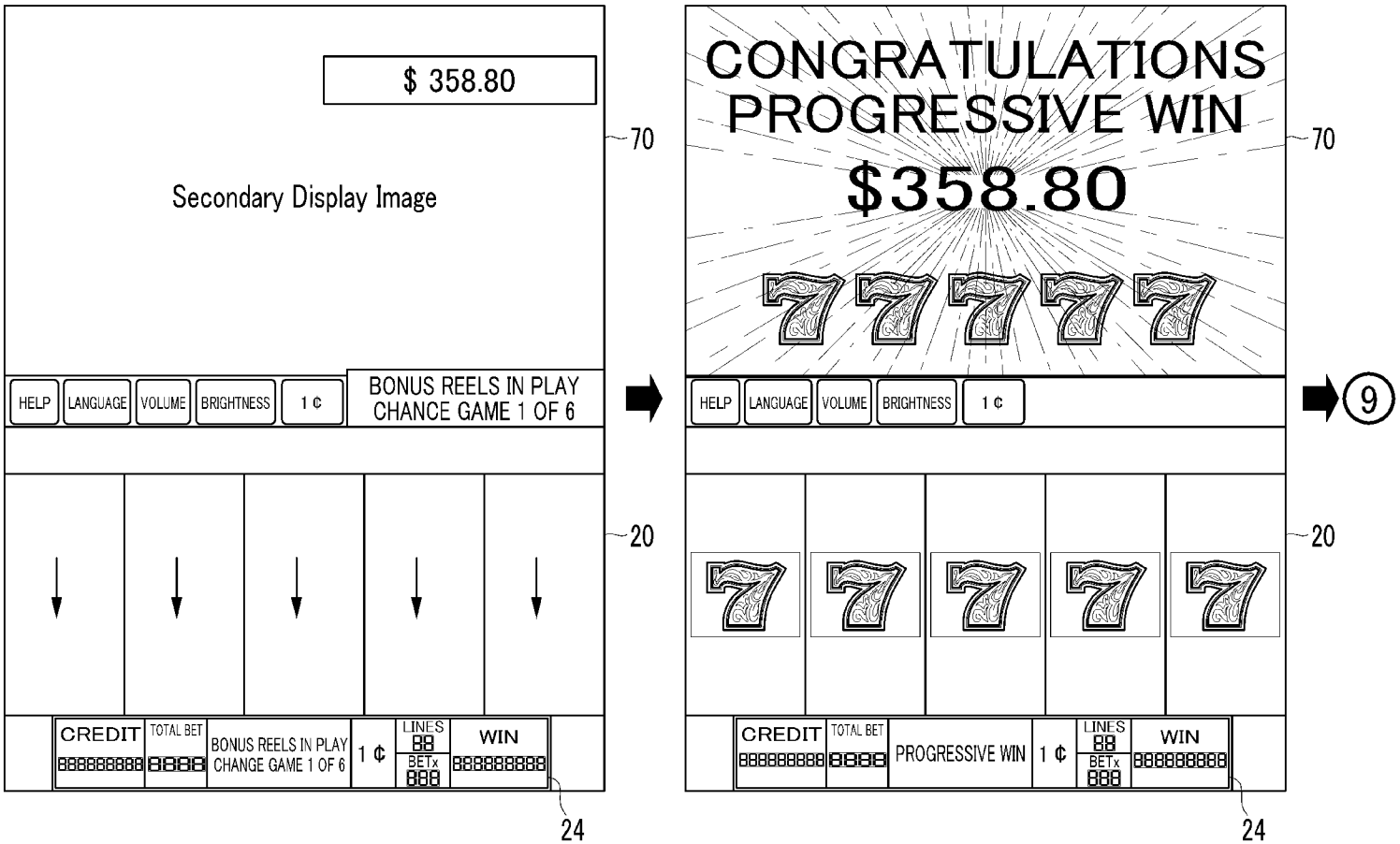
FIG. 33 is an exemplary screen image of a progressive jackpot shown on a primary display and a secondary display in a chance round of a game according to an embodiment of the present invention.
Figure 34:
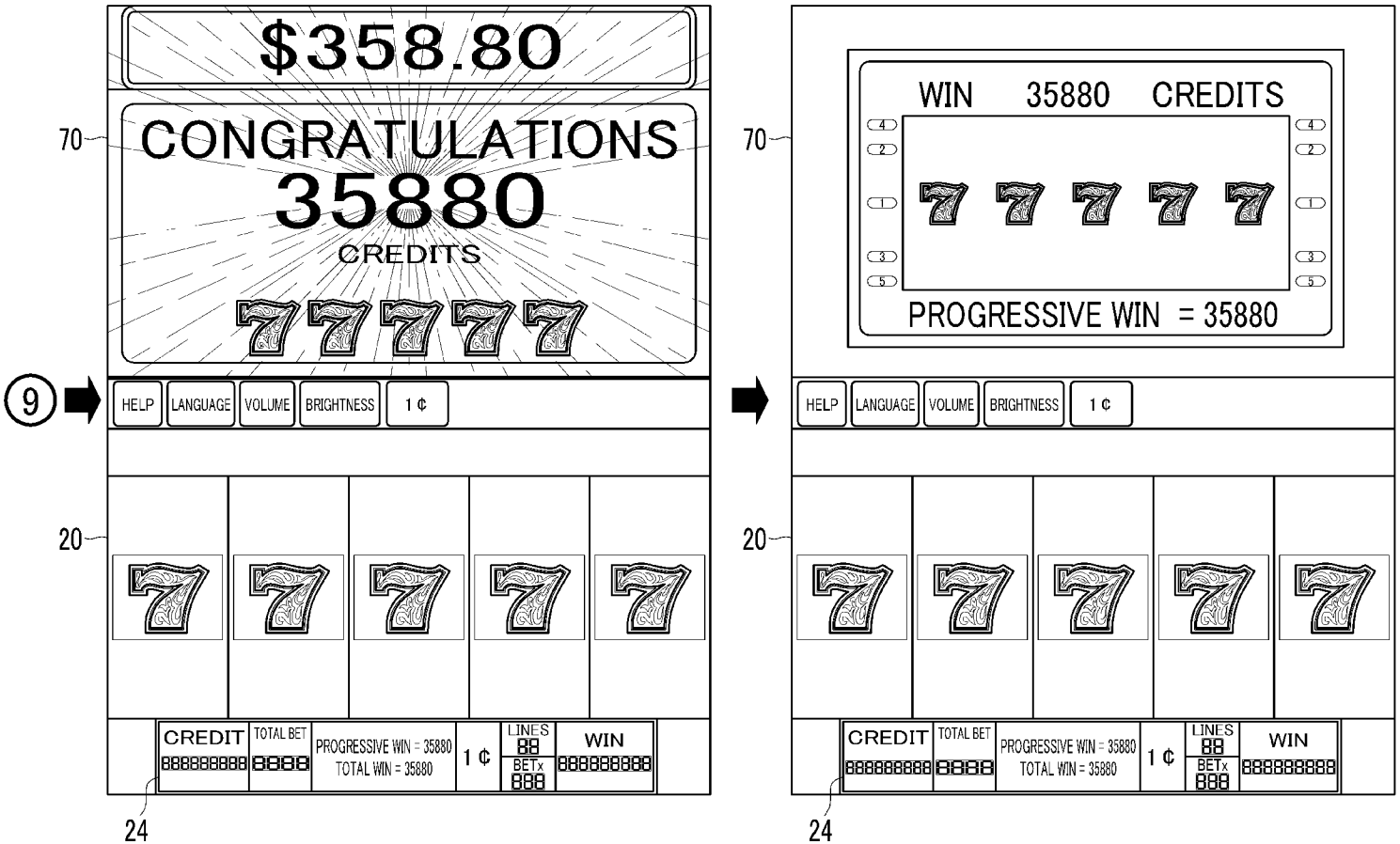
FIG. 34 is an exemplary screen image subsequent to the image shown in FIG. 33.

FIG. 33 and FIG. 34 are exemplary screen images of a progressive jackpot shown on a primary display and a secondary display in a chance round of a game according to an embodiment of the present invention.

Referring FIG. 33, when the reels 31*a* to 31*e* are stopped according to the result of the symbol determining process in a certain free round of the chance round, the winning combination is achieved by a combination of five "7" symbols arranged on the first payline. Accordingly, the secondary display 70 displays an image for notifying the progressive jackpot according to the combination of five "7" symbols. The image further includes for a payout (e.g., $358.80), which is represented as a money, according to the combination of five "7" symbols and a congratulatory message (e.g., "CONGRATULATIONS PROGRESSIVE WIN") according to the progressive jackpot. Further, the display panel 24 of the primary display 20 displays a message (e.g., "PROGRESSIVE WIN") for notifying the progressive jackpot.

Subsequently, the secondary display 70 renders a screen shining brightly, and displays the payout according to the combination of five "7" symbols as credits (e.g., "35880 CREDITS"), as shown in FIG. 34. Further, the display panel 24 displays a payout of the payline achieving the winning combination (e.g., "PROGRESSIVE WIN=35880") and the total credits (e.g., "TOTAL WIN=35880") on the game message area 24*c*. Next, the secondary display 70 displays an image for symbols appeared on the display window 22. Further, the secondary display 70 displays an image for notifying the payout (e.g., 35880 credits) according to the progressive jackpot, for example, as "WIN 35880 CREDITS" and "PROGRESSIVE WIN=35880."

Figure 35:
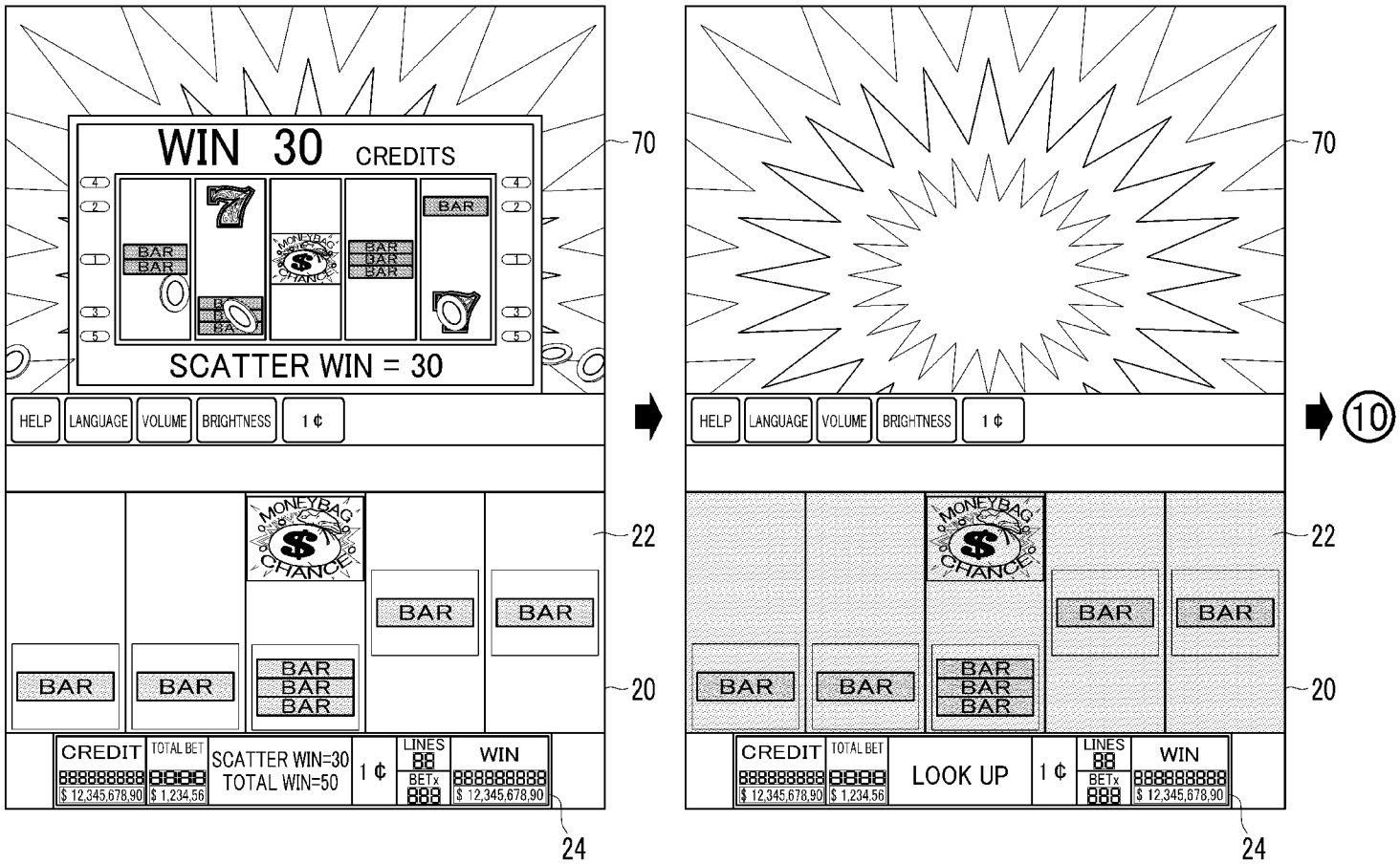
FIG. 35 is an exemplary screen image shown on a primary display and a secondary display when a chance round is triggered according to an embodiment of the present invention.
Figure 36:
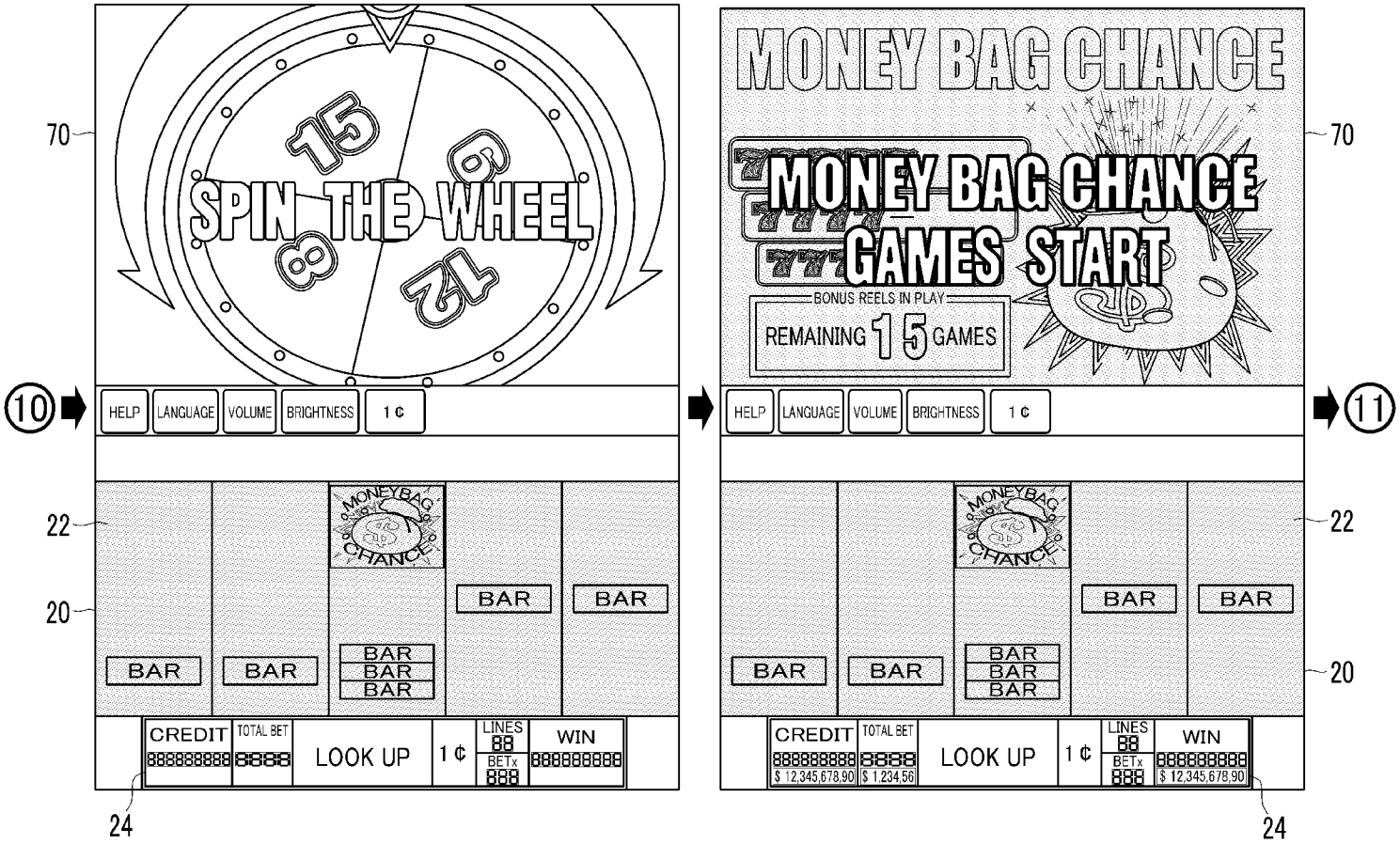
FIG. 36 is an exemplary screen image shown on a primary display and a secondary display after a chance round is started according to an embodiment of the present invention.
Figure 37:
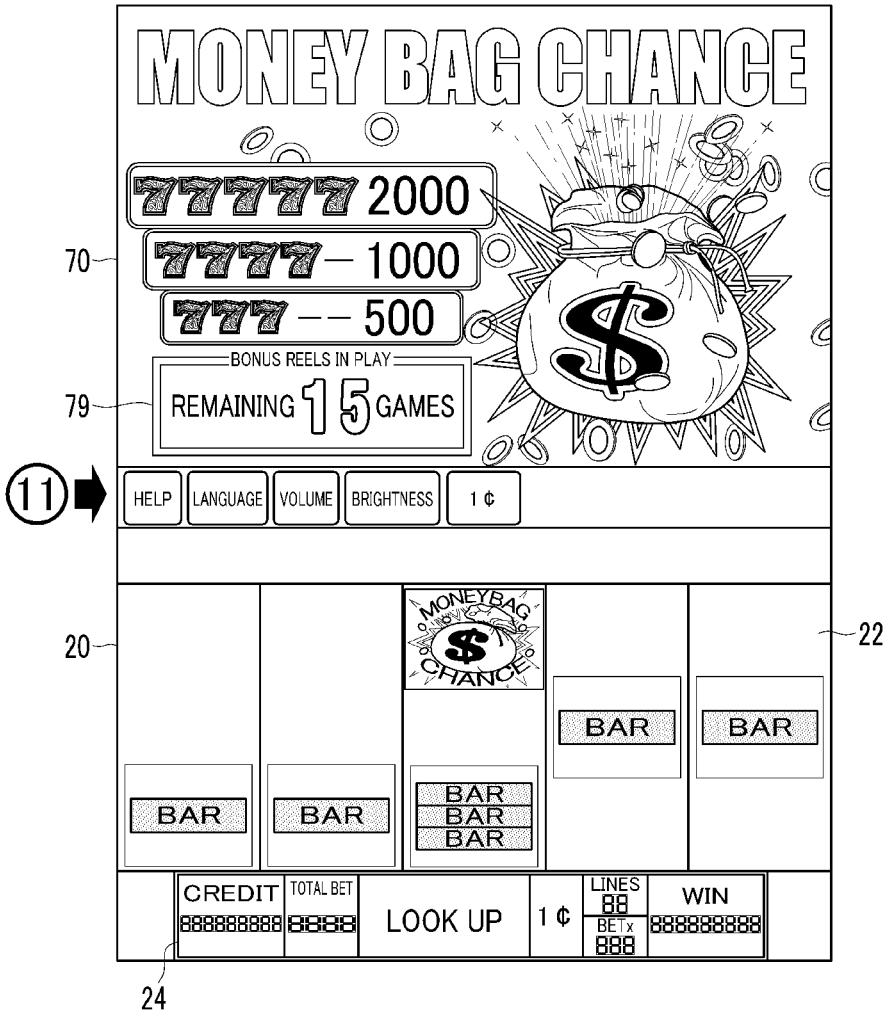
FIG. 37 is an exemplary screen image subsequent to the image shown in FIG. 36.

FIG. 35 is an exemplary screen image shown on a primary display and a secondary display when a chance round is triggered according to an embodiment of the present invention, and FIG. 36 and FIG. 37 are exemplary screen images shown on a primary display and a secondary display after a chance round is started according to an embodiment of the present invention.

Referring to FIG. 35, when a "CHANCE" symbol is appeared on a display window 22 in a normal round of a game, a chance round of the game is triggered. The secondary display 70 displays an image for symbols appeared on the display window 22, and an image representing a combination of symbols (i.e., the "CHANCE" symbol) achieving the winning combination. Further, the secondary display 70 displays an image for notifying the payout (e.g., 30 credits) according to the scatter symbol, for example, as "WIN 30 CREDITS" and "SCATTER WIN=30." Moreover, the display panel 24 of the primary display 20 displays the payout according to the scatter symbol (e.g., "SCATTER WIN=30") and a total payout (e.g., "TOTAL WIN=30") on a game message area 24*c*.

Subsequently, the display window 22 of the primary display 20 is darkened, and the secondary display 70 is shined brightly. The display window 22 may be darkened by backlight units (34 of FIG. 12) that are turned off by backlight drivers (34*t* of FIG. 12). At this time, the display panel 24 displays a message (e.g., "LOOK UP") for indicating the player to look up. Further, a speaker (17 of FIG. 11) of the gaming machine 1 may output a sound corresponding to "LOOK UP."

Next, while the display window 22 is darkened, the secondary display displays a wheel having a plurality of options each corresponding to the number of free rounds, as shown in FIG. 36. The secondary display 70 displays a message (e.g., "SPIN THE WHEEL") for notifying the player to spin the wheel. Further, the display panel 24 still displays the message (e.g., "LOOK UP") for indicating the player to look up. After the number of free rounds is determined by spinning of the wheel, the secondary display 70 notifies a start of the chance round. For example, the secondary display 70 may display "MONEY BAG CHANCE GAMES START." Further, the display panel 24 displays a message (e.g., "MONEG BAG CHANCE") for notifying the start of the chance round in the a game message area 24*c*.

Next, as shown in FIG. 37, the display window 22 of the primary display 20 is brightened again, and the secondary display 70 displays an image for the chance round. The image includes an image for representing a theme (e.g., "MONEY BAG"). Further, the secondary display 70 displays a chance round counter 79 for notifying the number of remaining free rounds. For example, the chance round counter 79 displays "REMAINING 15 GAMES". Furthermore, the secondary display 70 displays a payout for a combination of specific symbols. For example, the secondary display 70 displays a payout (500 credits) for a combination of three "7" symbols, a payout (1000 credits) for a combination of fourth "7" symbols, and a payout (2000 credits) for a combination of five "7" symbols.

Next, an operation of a wheel in a chance round is described with reference to FIG. 38 to FIG. 44. A controller of the gaming machine 1 may control the operation of the wheel.

Figure 38:
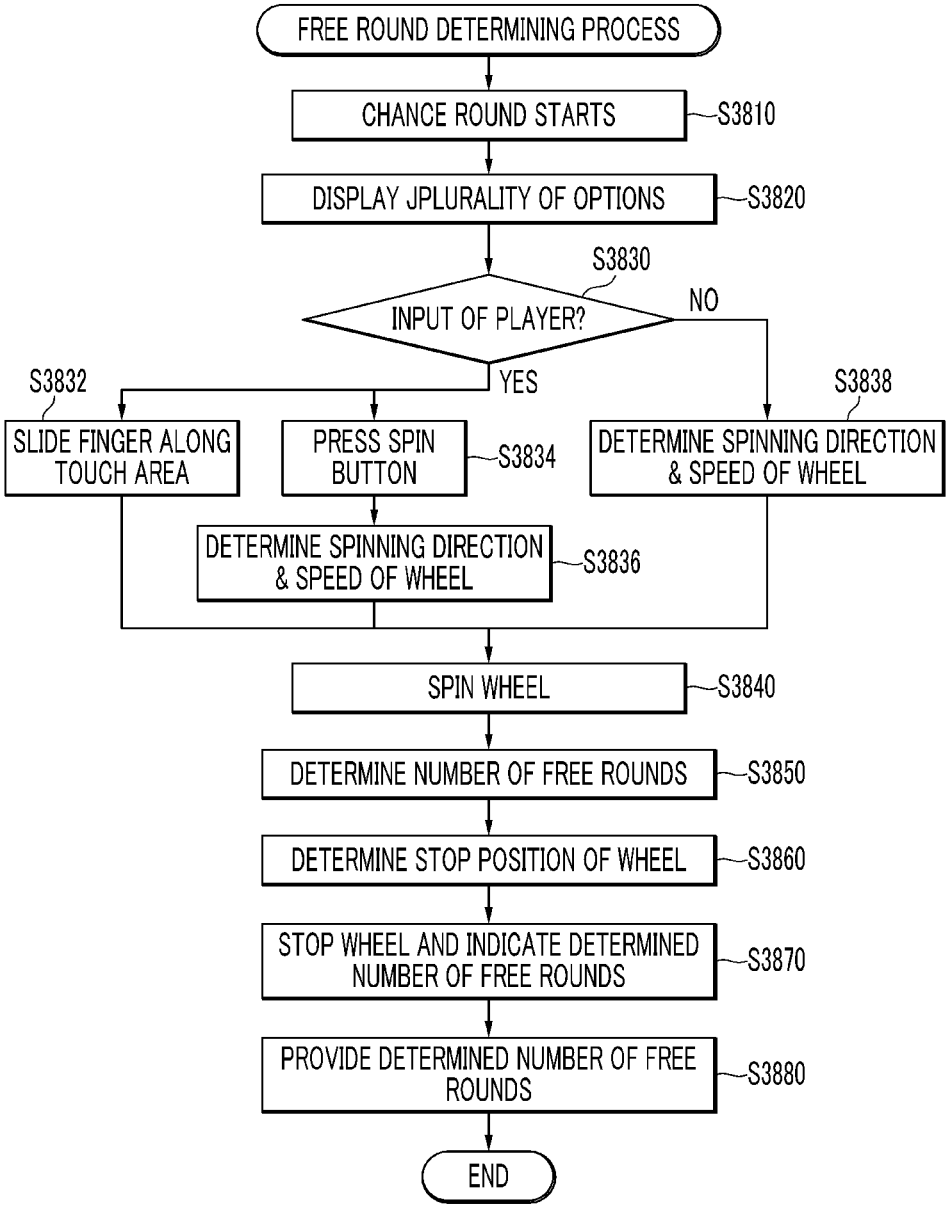
FIG. 38 is a flowchart of a free round determining process according to an embodiment of the present invention.
Figure 39:
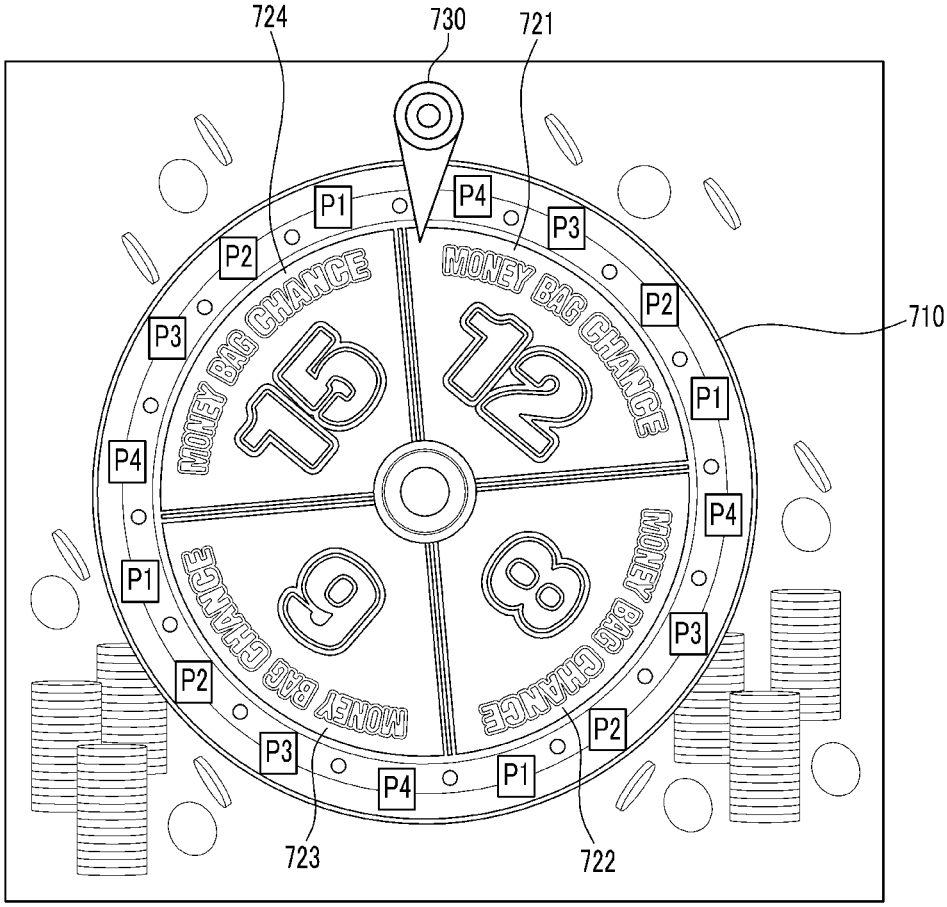
FIG. 39 is an exemplary screen image for the number of free rounds shown on a secondary display according to an embodiment of the present invention.
Figure 40:
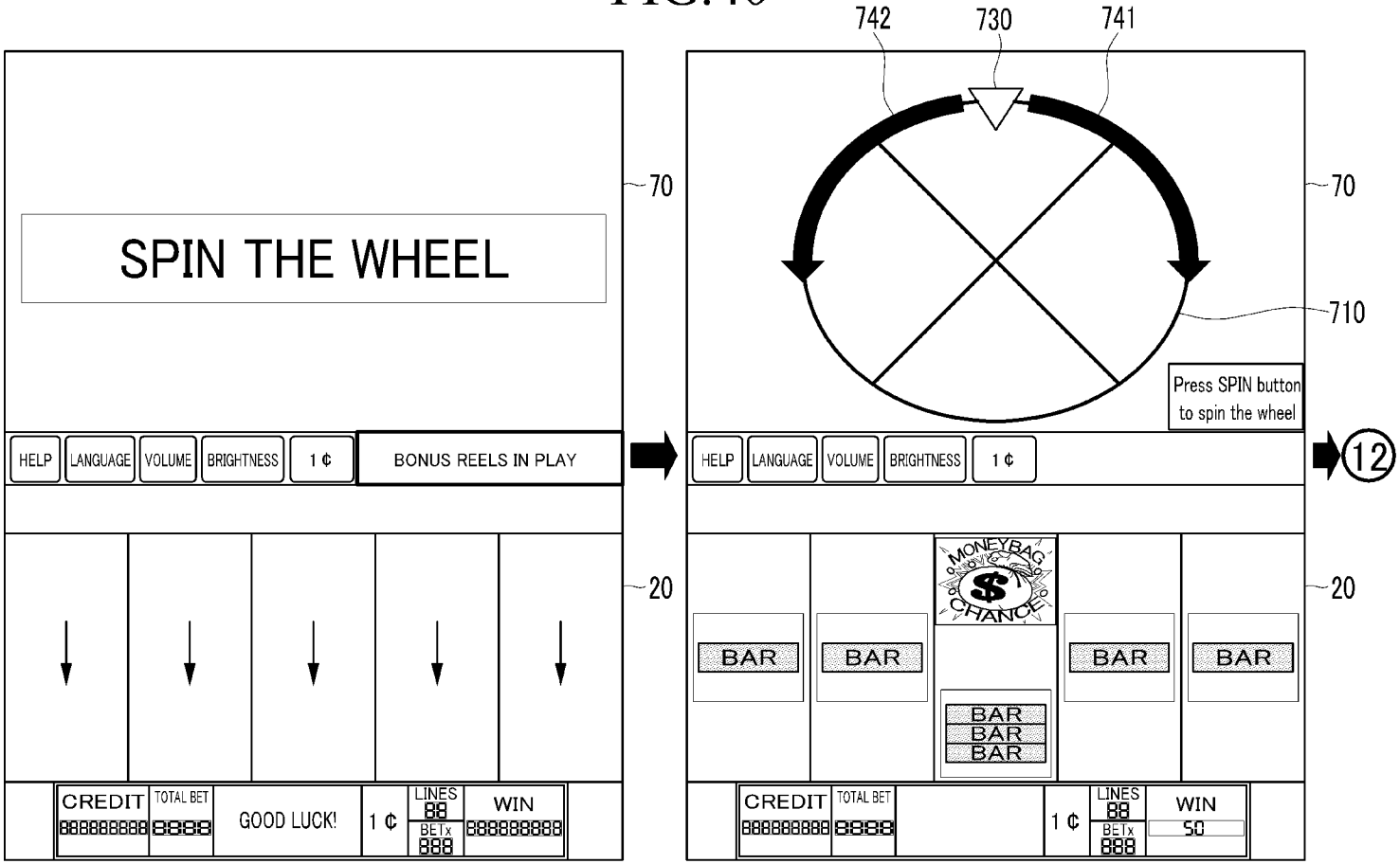
FIG. 40 is an exemplary screen image for spinning a wheel shown on a primary display and a secondary display according to an embodiment of the present invention.
Figure 41:
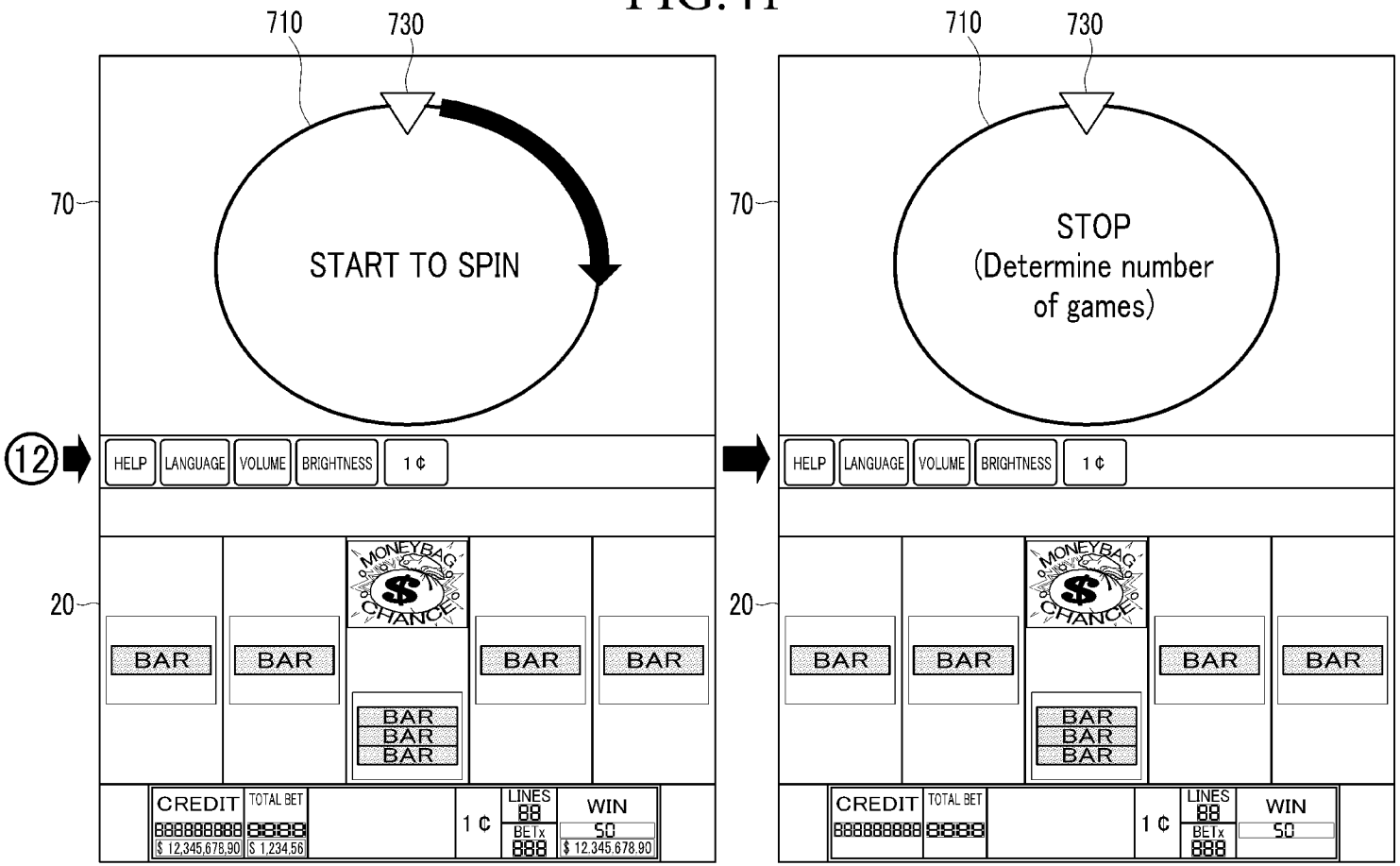
FIG. 41 is an exemplary screen image subsequent to the image shown in FIG. 40.

FIG. 38 is a flowchart of a free round determining process according to an embodiment of the present invention, FIG. 39 is an exemplary screen image for the number of free rounds shown on a secondary display according to an embodiment of the present invention, FIG. 40 and FIG. 41 are exemplary screen images for spinning a wheel shown on a primary display and a secondary display according to an embodiment of the present invention, FIG. 42 is an exemplary spinning speed table according to an embodiment of the present invention, FIG. 43 is an exemplary spin table according to an embodiment of the present invention, and FIG. 44 is an exemplary position determination table according to an embodiment of the present invention.

Referring to FIG. 38, when a chance round is started (S3810), a controller of the gaming machine 1 displays a plurality options for determining the number of free rounds in a secondary display 70 (S3820). As shown in FIG. 39, for determining the number of free rounds, a wheel 710 including a plurality of areas 721, 722, 723 and 724 that correspond to the plurality of options respectively is provided in the secondary display 70. The predetermined number of free rounds is allocated to each of the plurality of options. Each of the plurality of areas 721 to 724 includes a plurality of positions P1, P2, P3 and P4. The plurality of positions includes positions P1 and P4 that are adjacent to a boundary of two adjacent areas, and remaining positions P2 and P3. For example, the wheel 710 may include four areas 721 to 724, and each of the areas 721 to 724 may include four positions P1 to P4. In the four positions P1 to P4, two positions P1 and P4 may be adjacent to the boundary of the adjacent areas. When the wheel 710 is stopped after spinning, an indicator 730 of the wheel 710 indicates any one position of any one area. The predetermined number of free rounds that is allocated to the area indicated by the indicator 730 is determined as the number of free rounds for the chance round.

Referring to FIG. 40, the secondary display 70 further displays touch areas 741 and 742 for indicating to the player to spin the wheel 710. One touch area 741 indicates the player to spin wheel 710 in a clockwise direction, and the other touch area 742 indicates the player to spin wheel 710 in a counterclockwise direction. Accordingly, the player can touch a finger on a screen of the secondary display 70 and slide the finger along any one of the touch areas 741 and 742, thereby spinning the wheel 710.

Referring to FIG. 38 again, the controller waits for an input of the player (S3830). When the player touches the finger on the screen of the secondary display 70 and slides the finger along any one of the touch areas 741 and 742 (S3832), the controller renders in the secondary display 70 an effect that the wheel 710 spins in the clockwise or counterclockwise direction as shown in FIG. 41 (S3840). The spinning direction may be determined by the sliding direction of the player. That is, when the player slides the finger along the touch area 741, the wheel 710 spins in the clockwise direction. When the player slides the finger along the touch area 742, the wheel 710 spins in the counterclockwise direction. Further, the controller may determine a speed at which the wheel 710 spins based on a speed at which the player slides the finger with touching the screen of the secondary display 70. The speed at which the wheel 710 spins may be proportional to the speed at which the player slides the finger. Accordingly, the player can feel like he or she spins a real wheel to select the number of free rounds. As a result, the gaming machine can continuously attract the players' attention.

When the player presses a SPIN button 54 (S3834), the controller randomly determines the direction in which the wheel 710 spins and the speed at which the wheel 710 spins (S3836), the controller renders an effect that the wheel 710 spins according to the determined direction and speed (S3840). When there is no input of the player during a predetermined time (S3830: NO), the controller randomly determines the direction in which the wheel 710 spins and the speed at which the wheel 710 spins (S3838), the controller renders an effect that the wheel 710 spins according to the determined direction and speed (S3840).

Next, the controller randomly determines the number of free rounds for the chance round (S3850). For determining the number of free rounds, the gaming machine 1 may store a plurality of spin tables in a memory. The memory may be a RAM (93 of FIG. 11), a ROM (92 of FIG. 11), or other storage devices. Each of the plurality of spin tables may correspond to any one of a plurality of spinning speeds of the wheel 710 as shown in FIG. 42. Accordingly, the controller may select any one of the plurality of spin tables based on the determined spinning speed of the wheel 710. The plurality of spinning speeds may include a low speed, a middle speed, and a high speed. In this case, when two or more spin tables correspond to one spinning speed, any one spin table may be randomly determined from among the two or more spin tables. Each spin table matches the number of free rounds and a random number. Accordingly, the controller may generate a random number, and determine the number of free rounds based on the random number and the selected spin table. In an example shown in FIG. 43, each spin table stores a plurality of numbers and a range of random numbers corresponding to each of the numbers. The range of random numbers corresponding to each number may be determined based on a weight of each number shown in FIG. 43. The weight of each number corresponds to a probability of each number being determined. The weight may be inversely proportional to the number of free rounds. That is, the maximum number of free rounds may be determined with the lowest probability.

Subsequently, the controller randomly determines a position at which the wheel 710 is to be stopped (S3860). The controller may determine any one position from among a plurality of positions of an area corresponding to the determined number of free rounds. In this case, the controller may determine any one position based on a position determination table stored in the memory of the gaming machine 1. The position determination table matches the position and a random number. Accordingly, the controller may generate a random number, and determine the position based on the random number and the position determination table. In an example shown in FIG. 44, the position determination table stores a plurality of positions P1 to P4 and a range of random numbers corresponding to each of the positions P1 to P4. The range of random numbers corresponding to each position may be determined based on a weight of each position. The weight of each position corresponds to a probability of each position being determined. The weights of the positions P1 and P4 adjacent to the boundary of the adjacent areas may be higher than the weights of the other positions P2 and P3. In the example shown in FIG. 44, the weights of the positions P1 and P4 adjacent to the boundary of the adjacent areas are 40, and the weights of the other positions P2 and P3 are 10. The higher weights of the positions P1 and P4 adjacent to the boundary of the adjacent areas can boost the player's expectation that the area having more free rounds can be selected among the adjacent areas.

The controller renders in the secondary display 70 an effect that the wheel 710 is stopped for the indicator 730 to indicate the determined position of the area corresponding to the determined number of free rounds (S3870). The controller provides the determined number of free rounds and notifies the player of the same (S3880).

On the other hand, in the step S3840, the wheel 710 may start to spin when the player takes off his or her finger from the screen of the secondary display 70. Further, when a period during which the player slides the finger with touching the screen of the secondary display 70 exceeds a first predetermined time, the wheel 710 may start to spin even though the player does not take off the finger from the screen. The first predetermined time may be, for example, 8 seconds. Furthermore, when the player touches the finger on the screen during a period that is shorter than a second predetermined time, the wheel 710 does not start to spin even though the player takes off the finger from the screen.

As described above, according to an embodiment of the present invention, the gaming machine 1 can provide the wheel which can spin in the clockwise or the counterclockwise by the touch of the player or whose spinning speed can be varied by the touch of the player, thereby allow the player to feel like he or she spins the real wheel. Further, the gaming machine 1 can stop the wheel at a position near to the boundary of the adjacent areas with the high probability, thereby boosting the player's expectation that the area having more free rounds can be selected. As a result, the player can be continuously interested in the game.

Display Panel of Primary Display

Next, a display panel 24 of a primary display 20 in a gaming machine 1 according to an embodiment of the present invention is described with reference to FIG. 45 to FIG. 58.

FIG. 45 to FIG. 58 shows exemplary screen images shown in a display panel of a primary display according to an embodiment of the present invention. A controller of the gaming machine 1 may display the screen images on the display panel 24 of the primary display 20.

Figure 45:
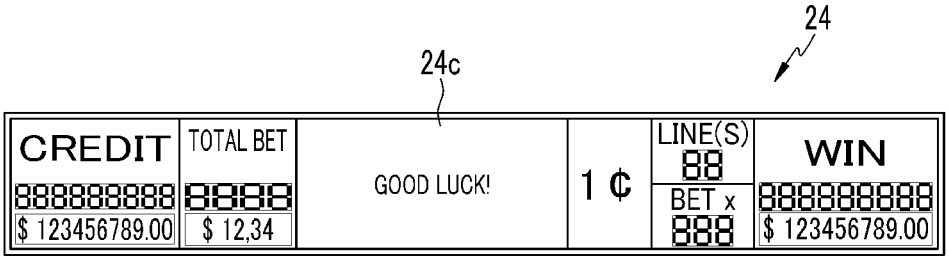
FIG. 45 to FIG. 58 shows exemplary screen images shown in a display panel of a primary display according to an embodiment of the present invention.

Referring to FIG. 45, a game message area 24*c* of a display panel 24 displays a message such as "GOOD LUCK!" when a plurality of reels 31*a* to 31*e* start to spin.

Figure 46:
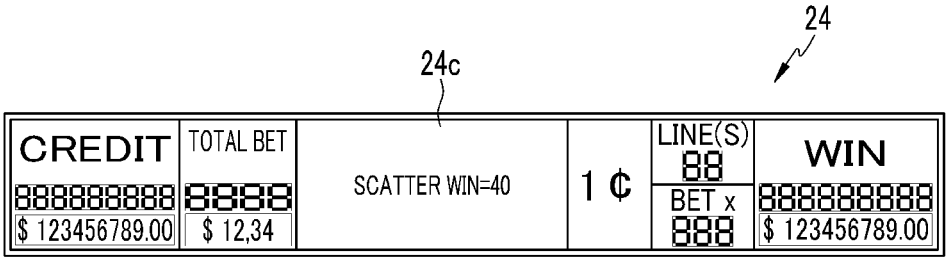

Referring to FIG. 46, the game message area 24*c* of the display panel 24 displays a message (e.g., "SCATTER WIN=40") for notifying a scatter win and a payout (e.g., 40 credits) according to the scatter win when a result of a game is a payout according to a scatter symbol.

Figure 47:
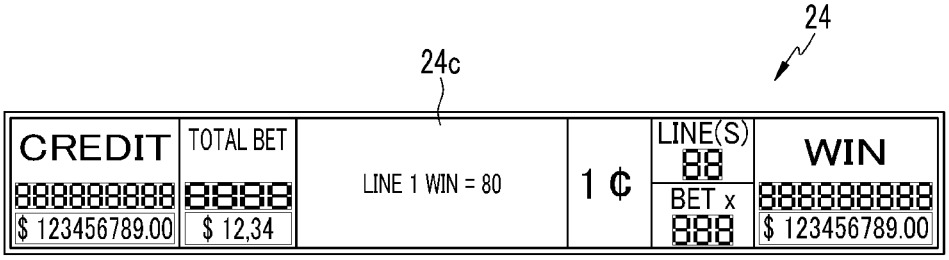

Referring to FIG. 47, the game message area 24*c* of the display panel 24 displays a message (e.g., "LINE 1 WIN=80") for notifying a payline (e.g., line 1) achieving a winning combination and a payout (e.g., 80 credits) according to the winning combination when the result of the game satisfies the winning combination.

Figure 48:
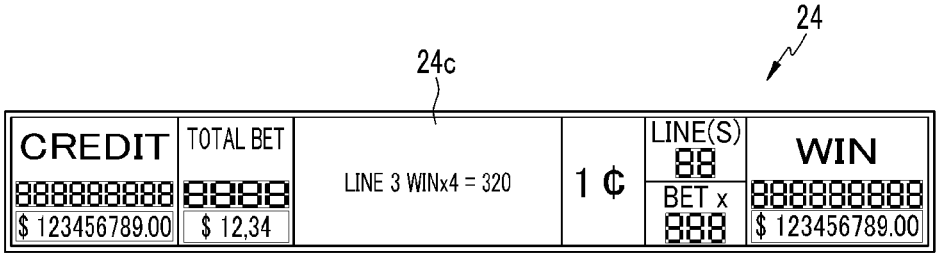

Referring to FIG. 48, the game message area 24*c* of the display panel 24 displays a message (e.g., "LINE 3 WIN×4=320") for notifying a payline (e.g., line 3) achieving a winning combination, a multiplier (e.g., BET×4) determined by a total bet, and a payout (e.g., 320 credits) according to the winning combination when the result of the game satisfies the winning combination.

Figure 49:
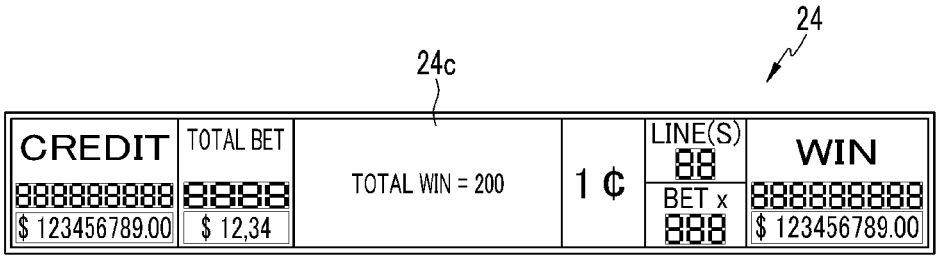

Referring to FIG. 49, the game message area 24*c* of the display panel 24 displays a message (e.g., "TOTAL WIN=200") for notifying total credits (e.g., 200 credits) to be awarded by all paylines achieving a winning combination after displaying a payout according to each payline.

Figure 50:
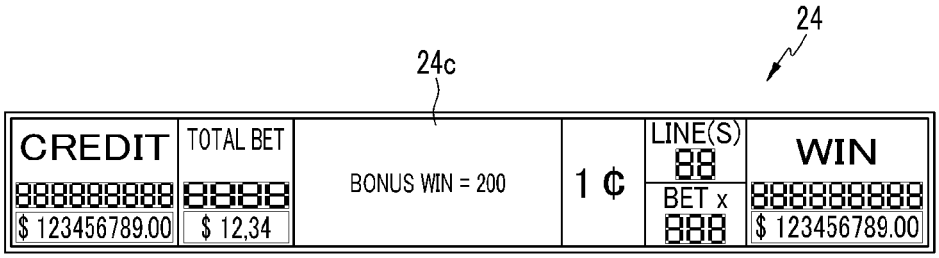

Referring to FIG. 50, the game message area 24*c* of the display panel 24 displays a message (e.g., "BONUS WIN=200") for notifying a payout according to a combination of "BONUS" symbols when a winning combination is the combination of "BONUS" symbols.

Figure 51:
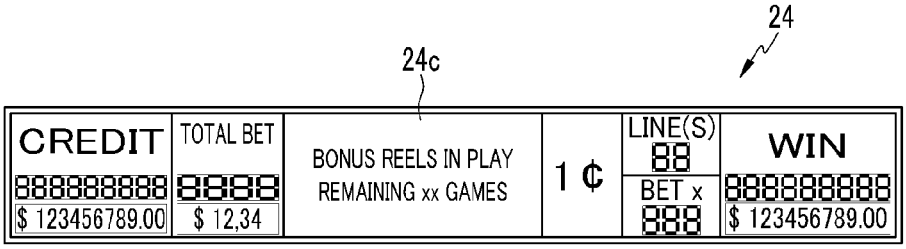

Referring to FIG. 51, the game message area 24*c* of the display panel 24 displays a message (e.g., "BONUS REELS IN PLAY" and "REMAINING xx GAMES") for notifying an execution of a chance round and remaining number of free rounds when the chance round is executed.

Figure 52:
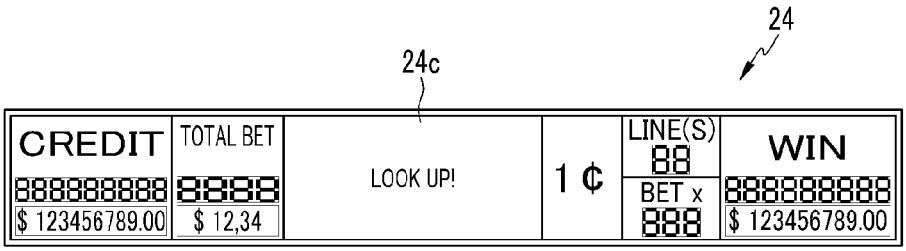

Referring to FIG. 52, the game message area 24*c* of the display panel 24 displays a message (e.g., "LOOK UP!") for indicating the player to look up when a rendering effect is rendered in a secondary display 70.

Figure 53:
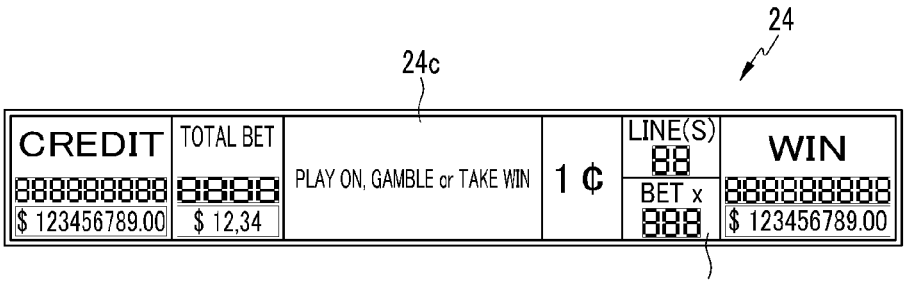

Referring to FIG. 53, the game message area 24*c* of the display panel 24 displays a message (e.g., "PLAY ON, GAMBLE or TAKE WIN") for indicating the player to continuously play the game or take a payout when the payout is provided to the player.

Figure 54:
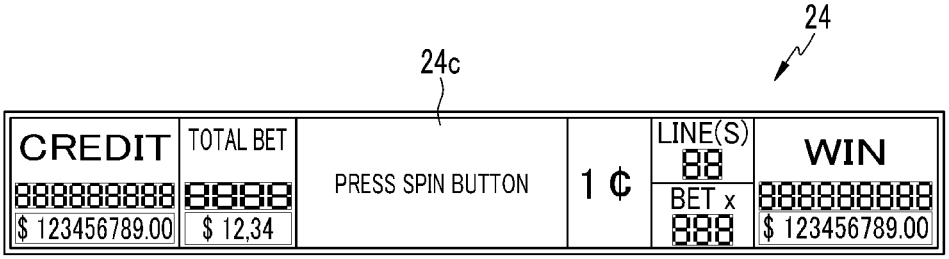

Referring to FIG. 54, the game message area 24*c* of the display panel 24 displays a message (e.g., "PRESS SPIN BUTTON") for indicating the player to press a SPIN button 54 when a gaming machine 1 waits for an input of the player.

Figure 55:
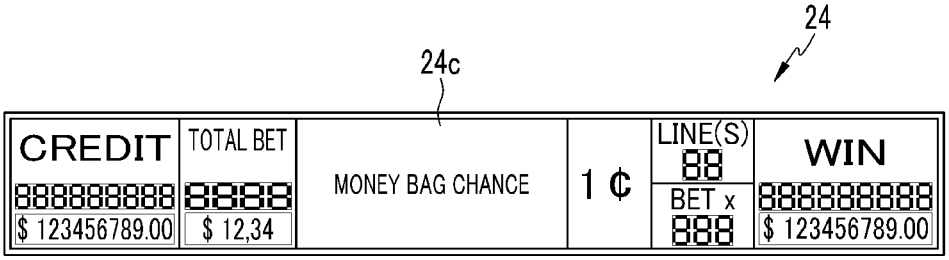

Referring to FIG. 55, the game message area 24*c* of the display panel 24 displays a message (e.g., "MONEY BAC CHNACE") for notifying a trigger of a chance round when the chance round of the game is triggered.

Figure 56:
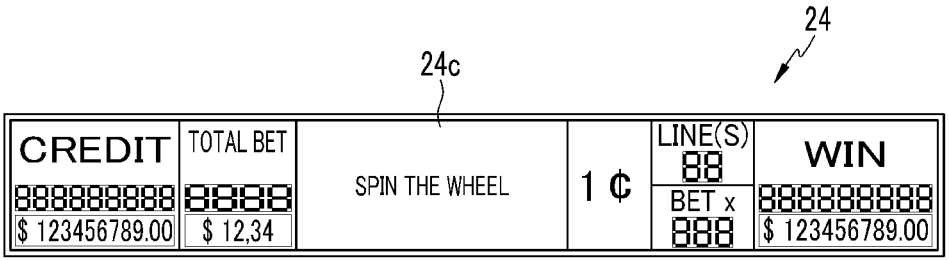

Referring to FIG. 56, the game message area 24*c* of the display panel 24 displays a message (e.g., "SPIN THE WHEEL") for indicating the player to spin a wheel on a secondary display 70 when a gaming machine 1 determines the number of free rounds in the chance round.

Figure 57:
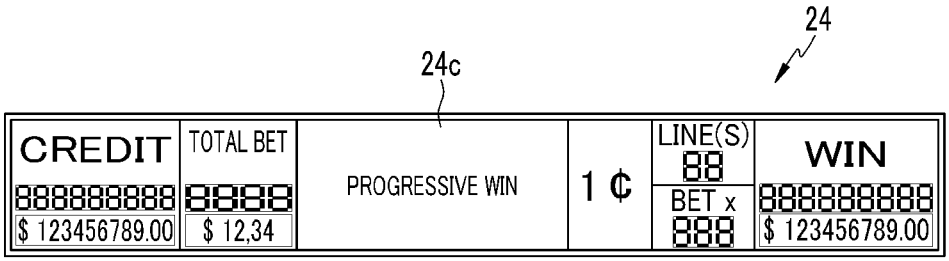

Referring to FIG. 57, the game message area 24*c* of the display panel 24 displays a message (e.g., "PROGRESSIVE WIN") for notifying a progressive jackpot when the result of the game is a combination of five "7" symbols.

Figure 58:
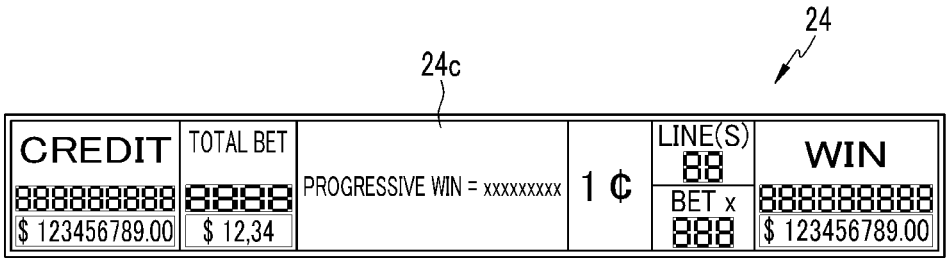

Referring to FIG. 58, the game message area 24*c* of the display panel 24 displays a message (e.g., "PROGRESSIVE WIN=xxxxxxx") for notifying a payout according to the progressive jackpot when the result of the game is the combination of five "7" symbols.

Rendering Process

Next, a rendering process in a gaming machine according to an embodiment of the present invention is described with reference to FIG. 59 to FIG. 78. In the below embodiment, a rendering process according to a combination of "7" symbols is described as an example.

Figure 59:
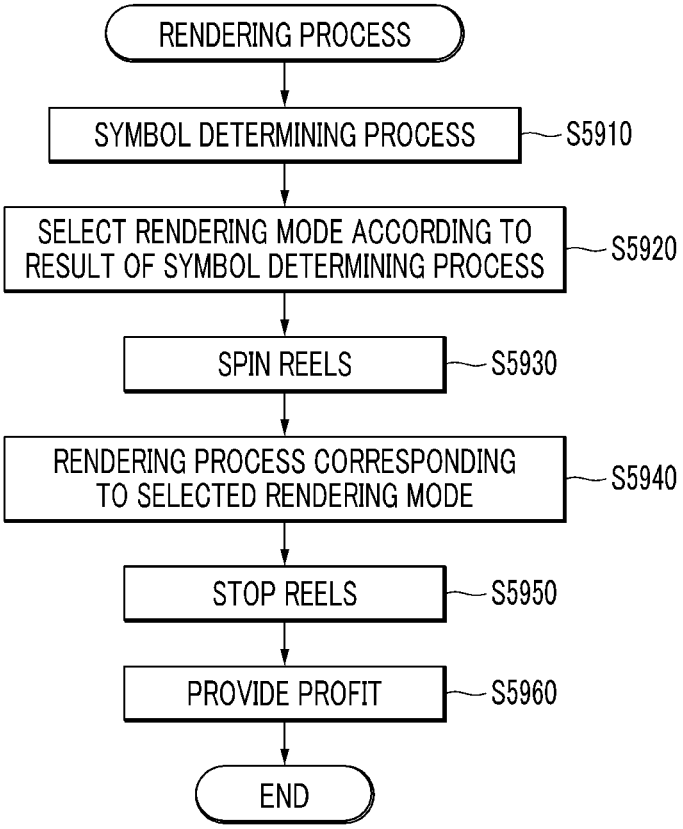
FIG. 59 is a flowchart of a rendering process according to an embodiment of the present invention.

FIG. 59 is a flowchart of a rendering process according to an embodiment of the present invention.

Referring to FIG. 59, a controller of the gaming machine 1 performs a symbol determining process in a normal round or a free round of a game (S5910). The controller selects a rendering mode (rendering pattern) corresponding to a result of the symbol determining process (S5920). The controller starts to spin reels 31*a* to 31*e* (S5930), and performs a rendering process corresponding to the selected rendering mode (S5940). The controller stops the reels 31*a* to 31*e* according to the result of the symbol determining process (S5950), and provides a profit corresponding to the result of the symbol determining process (S5960).

When the specific symbols are stopped on the first and second reels 31*a* and 31*b* according to the result of the symbol determining process, the controller renders a rendering effect that the other reels move according to time, thereby providing a player with an expectation that the specific symbols will be stopped on the other reels. In this case, six types of rendering effects may be provided. The six types of the rendering effects may include, for example, a rendering effect 1 that the specific symbol fails to be stopped on the third reel 31*c*, a rendering effect 2 that the specific symbol is stopped on the third reel 31*c*, a rendering effect 3 that the specific symbol is stopped on the third reel 31*c* and fails to be stopped to the fourth reel 31*d*, a rendering effect 4 that the specific symbol is stopped on the fourth reel 31*d*, a rendering effect 5 that the specific symbol is stopped on the fourth reel 31*d* and fails to be stopped to the fifth reel 31*e*, and a rendering effect 6 that the specific symbol is stopped on the fifth reel 31*e*. These rendering effects are described in below with reference to FIG. 60A to FIG. 65. It is assumed in FIG. 60A to FIG. 65 that the specific symbol is a "7" symbol for providing the progressive jackpot.

Figure 60A:
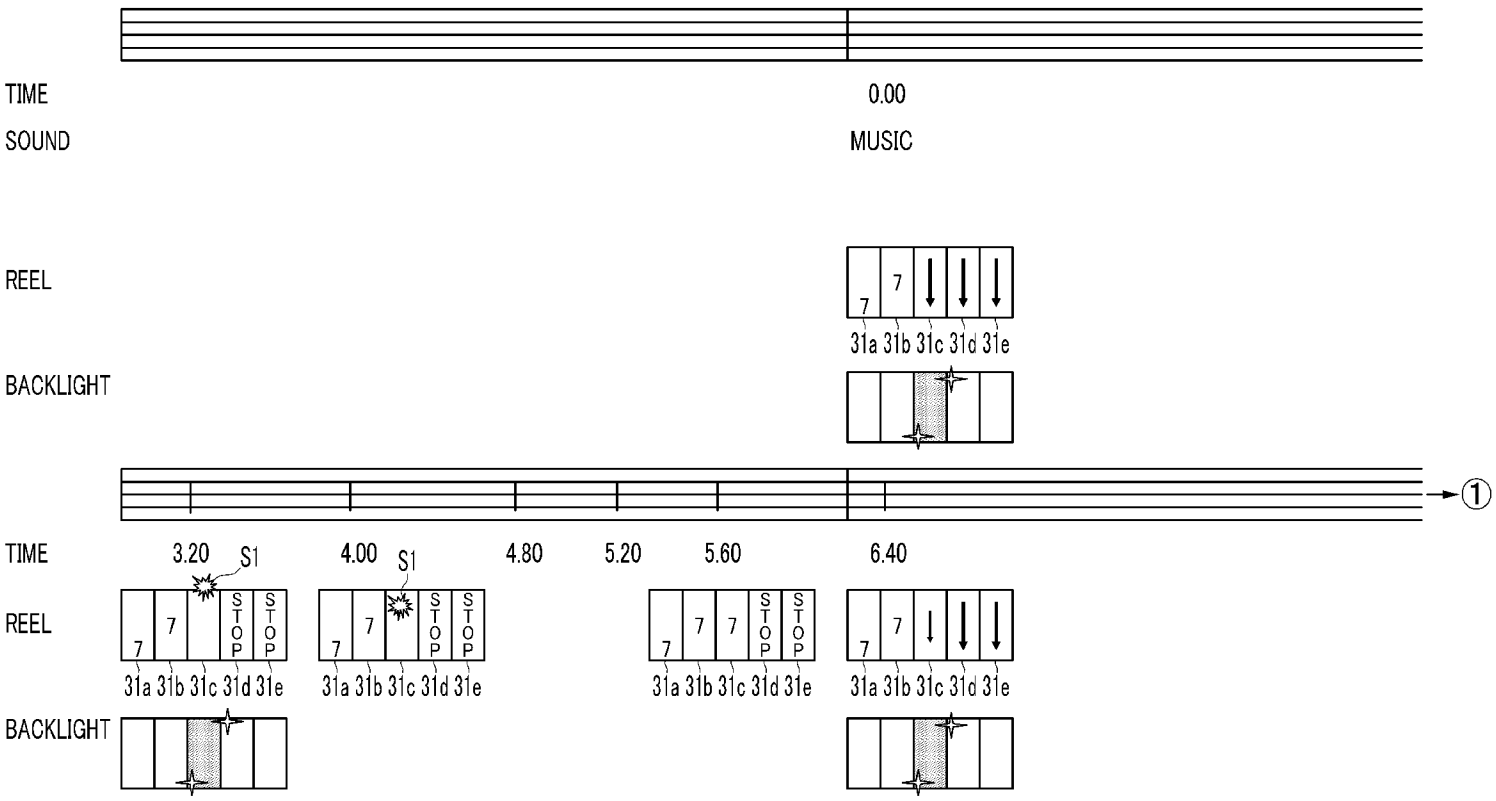
FIG. 60A and FIG. 60B shows a rendering effect 1 that a specific symbol fails to be stopped on the third reel.
Figure 60B:
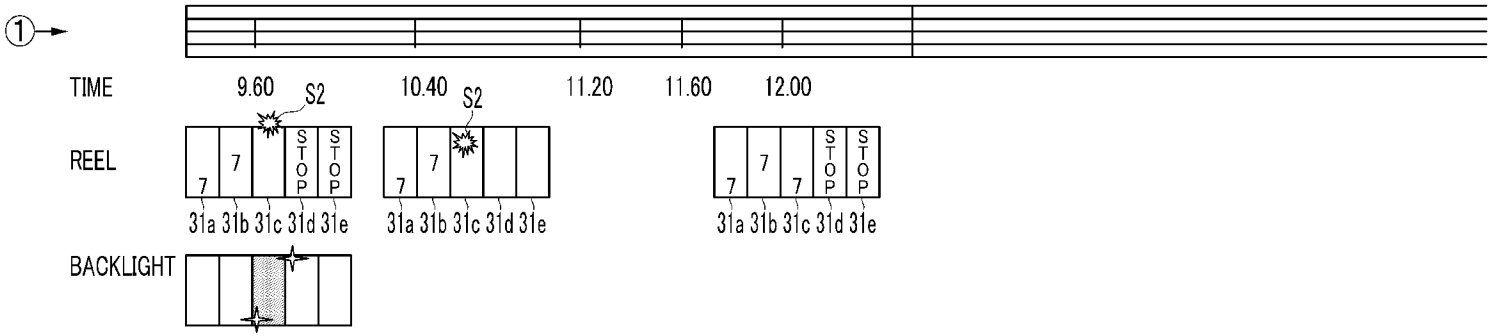

FIG. 60A and FIG. 60B shows a rendering effect 1 that a specific symbol fails to be stopped on the third reel.

Referring to FIG. 60A and FIG. 60B, after a plurality of reels 31*a* to 31*e* start to spin, the first and second reels 31*a* and 31*b* are sequentially stopped such that the "7" symbols are rearranged on a payline, for example the fifth payline (P5 of FIG. 5), of the first and second reels 31*a* and 31*b*. When the second reel 31*b* is stopped, a timer for a rendering effect is started, and a backlight unit 34 of the third reel 31*c* emits the light according to a predetermined lighting pattern.

When a time of the timer becomes a predefined time, for example 3.20 seconds, the third reel 31*c* starts to spin by one symbol each time a predetermined period, for example 0.8 second, elapses. Further, the fourth and fifth symbols 31*d* and 31*e* are stopped. Accordingly, a symbol S1 that is stopped on an upper boundary of an upper block of the third reel 31*c* in a display window (22 of FIG. 4) when the time of the timer is 3.20 seconds moves to the upper block when the time of the timer becomes 4.00 seconds. The symbol S1 moves to a boundary between the upper block and a middle block when the time of the timer becomes 4.80 seconds, and moves to the middle block when the time of the timer becomes 5.60 seconds. When the symbol S1 arrives at the middle block, the third reel 31*c* is stopped. When the third reel 31*c* is stopped, the "7" symbol is not stopped on the payline P5 of the third reel 31*c* for increasing the expectation.

When the predetermined period (e.g., 0.8 second) elapses (i.e., the time of the timer becomes a predefined time, for example 6.40 seconds) after the third reel 31*c* is stopped, the third reel 31*c* starts to spin at a low speed, and the fourth and fifth reels 31*d* and 31*e* start to spin at a normal speed. Further, the backlight unit 34 of the third reel 31*c* emits the light according to a predetermined lighting pattern.

When the time of the timer becomes a predefined time, for example 9.60 seconds, the third reel 31*c* starts to spin by one symbol again each time 0.8 second elapses. Further, the fourth and fifth symbols 31*d* and 31*e* are stopped. Accordingly, a symbol S2 that is stopped on the upper boundary of the upper block of the third reel 31*c* in the display window 22 when the time of the timer is 9.60 seconds moves to the upper block when the time of the timer becomes 10.40 seconds. The symbol S2 moves to the boundary between the upper block and the middle block when the time of the timer becomes 11.20 seconds, and moves to the middle block when the time of the timer becomes 12.00 seconds. When the symbol S2 arrives at the middle block, the third reel 31*c* is stopped. When the third reel 31*c* is stopped, the "7" symbol fails to be stopped on the payline P5 of the third reel 31*c*. As a result, a winning combination of the "7" symbol fails to be established.

Figure 61:
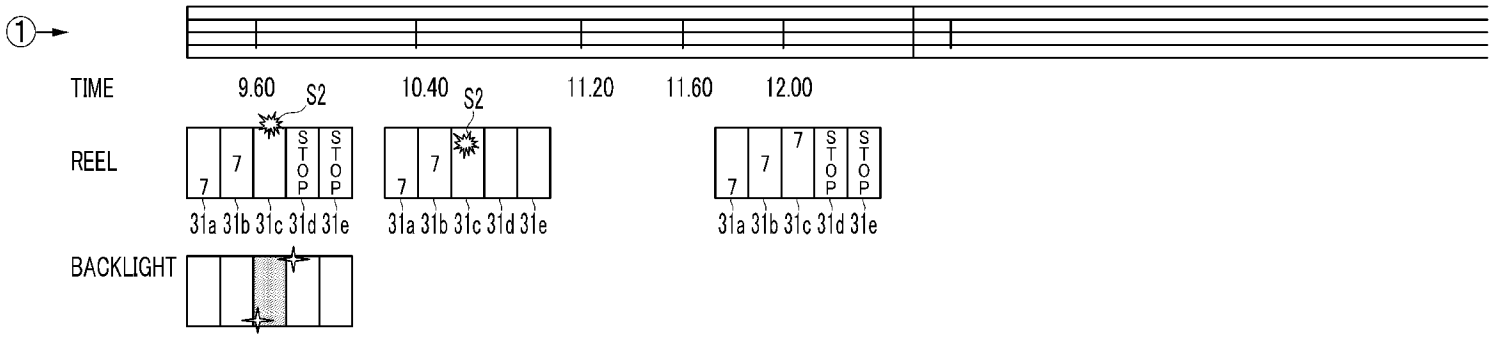
FIG. 61 shows a rendering effect 2 that a specific symbol is stopped on the third reel.

FIG. 61 shows a rendering effect 2 that a specific symbol is stopped on the third reel.

Referring to FIG. 61, when the time of the timer becomes 12.00 seconds, the third reel 31*c* is stopped, and the "7" symbol is arranged on the payline P5 of the third reel 31*c*. Accordingly, a winning combination is established by a combination of three "7" symbols that are rearranged on the first to third reels 31*a* to 31*c* of the payline P5.

Figure 62:
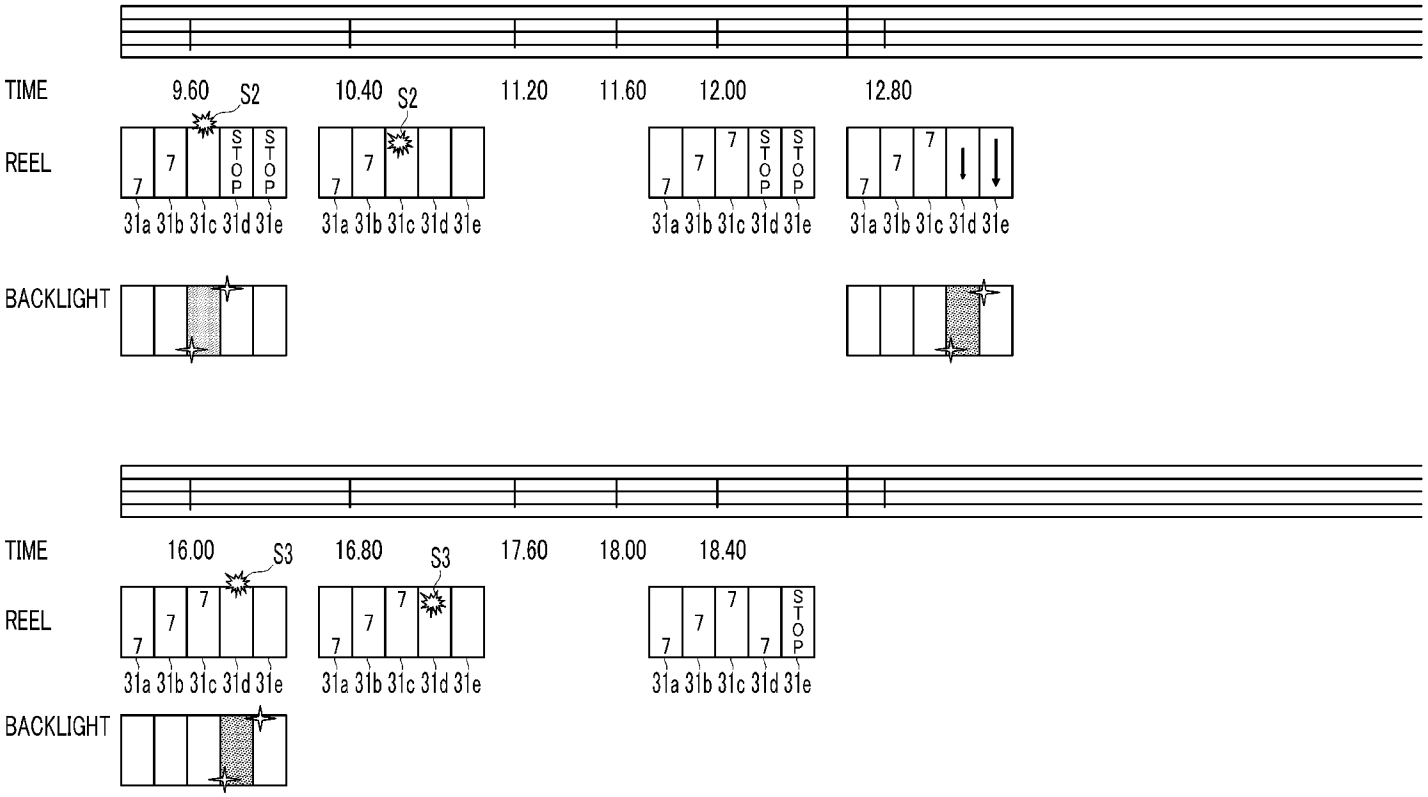
FIG. 62 shows a rendering effect 3 that a specific symbol fails to be stopped on the fourth reel.

FIG. 62 shows a rendering effect 3 that a specific symbol fails to be stopped on the fourth reel.

Referring to FIG. 62, when the predetermined period (e.g., 0.8 second) elapses (i.e., the time of the timer becomes a predefined time, for example 12.80 seconds) after the "7" symbol is arranged on the payline P5 of the third reel 31*c* as shown in FIG. 61, the fourth reel 31*d* starts to spin at a low speed, and the fifth reel 31*e* start to spin at a normal speed. Further, the backlight unit 34 of the fourth reel 31*d* emits the light according to a predetermined lighting pattern.

When the time of the timer becomes a predefined time, for example 16.00 seconds, the fourth reel 31*d* starts to spin by one symbol each time 0.8 second elapses, and the fifth symbol 31*e* is stopped. Accordingly, a symbol S3 that is stopped on the upper boundary of the upper block of the fourth reel 31*d* in the display window 22 when the time of the timer is 16.00 seconds moves to the upper block when the time of the timer becomes 16.80 seconds. The symbol S3 moves to the boundary between the upper block and the middle block when the time of the timer becomes 17.60 seconds, and moves to the middle block when the time of the timer becomes 18.40 seconds. When the symbol S3 arrives at the middle block, the fourth reel 31*d* is stopped. When the fourth reel 31*d* is stopped, the "7" symbol fails to be stopped on the payline P5 of the fourth reel 31*d*. As a result, a winning combination is finally established by a combination of three "7" symbols that are rearranged on the first to third reels 31*a* to 31*c* of the payline P5.

Figure 63:
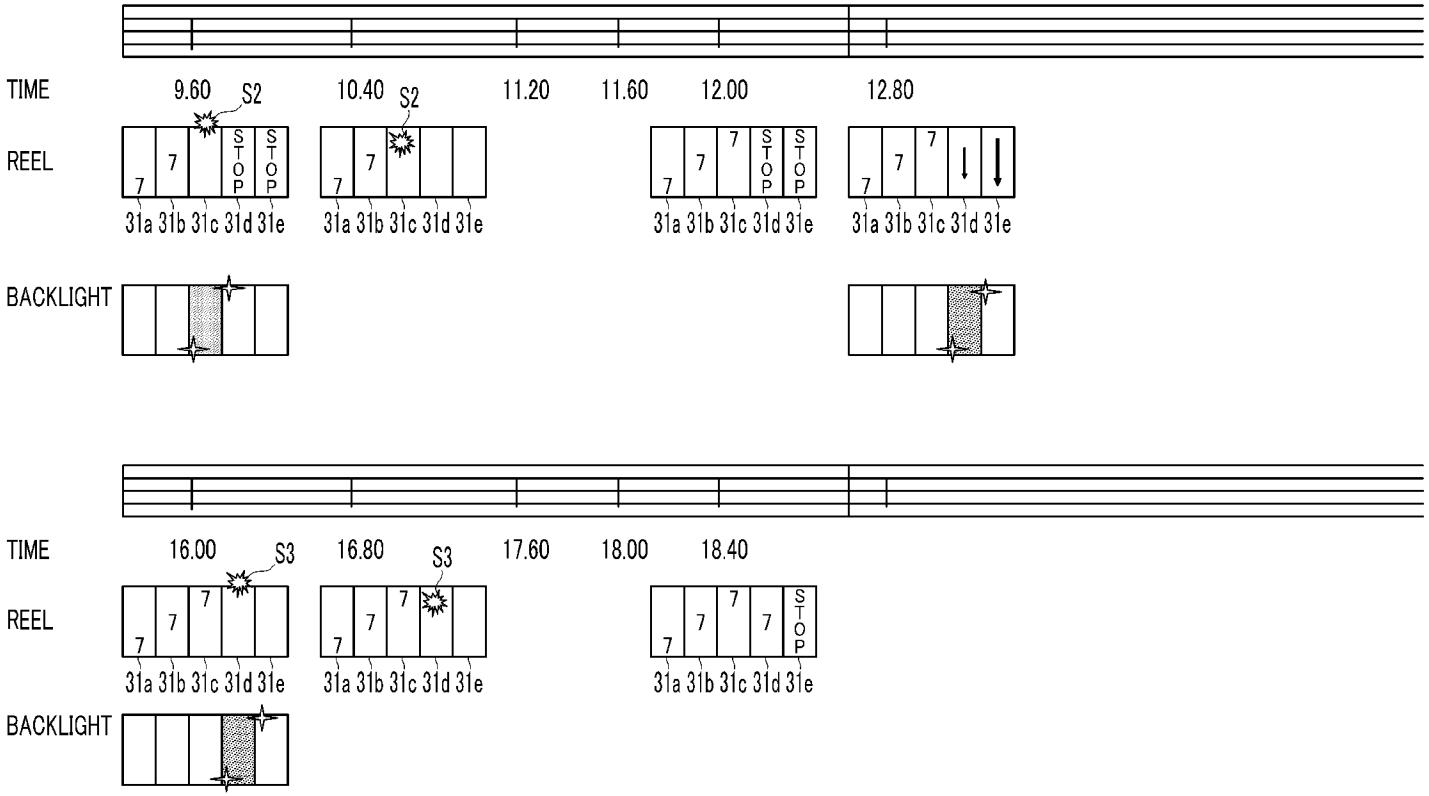
FIG. 63 shows a rendering effect 4 that a specific symbol is stopped on the fourth reel.

FIG. 63 shows a rendering effect 4 that a specific symbol is stopped on the fourth reel.

Referring to FIG. 63, when the time of the timer becomes 18.40 seconds, the fourth reel 31*d* is stopped, and the "7" symbol is arranged on the payline P5 of the fourth reel 31*d*. Accordingly, a winning combination is established by a combination of four "7" symbols that are rearranged on the first to fourth reels 31*a* to 31*d* of the payline P5.

Figure 64:
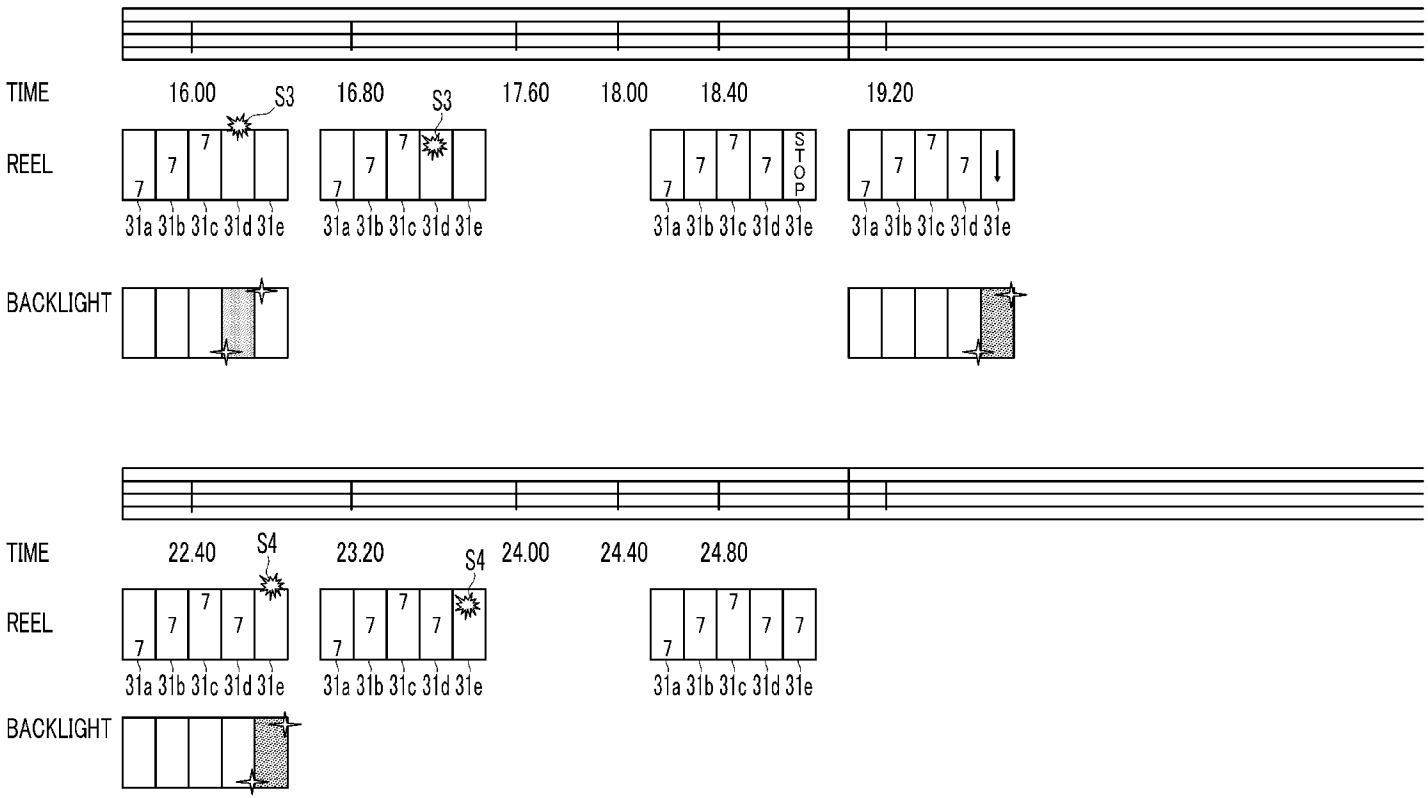
FIG. 64 shows a rendering effect 5 that a specific symbol fails to be stopped on the fifth reel.

FIG. 64 shows a rendering effect 5 that a specific symbol fails to be stopped on the fifth reel.

Referring to FIG. 64, when the predetermined period (e.g., 0.8 second) elapses (i.e., the time of the timer becomes a predefined time, for example 19.20 seconds) after the "7" symbol is arranged on the payline P5 of the fourth reel 31*d* as shown in FIG. 63, the fifth reel 31*e* starts to spin at a low speed. Further, the backlight unit 34 of the fifth reel 31*e* emits the light according to a predetermined lighting pattern.

When the time of the timer becomes a predefined time, for example 22.40 seconds, the fifth reel 31*e* starts to spin by one symbol each time 0.8 second elapses. Accordingly, a symbol S4 that is stopped on the upper boundary of the upper block of the fifth reel 31*e* in the display window 22 when the time of the timer is 22.40 seconds moves to the upper block when the time of the timer becomes 23.20 seconds. The symbol S4 moves to the boundary between the upper block and the middle block when the time of the timer becomes 24.00 seconds, and moves to the middle block when the time of the timer becomes 24.80 seconds. When the symbol S4 arrives at the middle block, the fifth reel 31*e* is stopped. When the fifth reel 31*e* is stopped, the "7" symbol fails to be stopped on the payline P5 of the fifth reel 31*e*. As a result, a winning combination is finally established by a combination of fourth "7" symbols that are rearranged on the first to fourth reels 31*a* to 31*d* of the payline P5.

Figure 65:
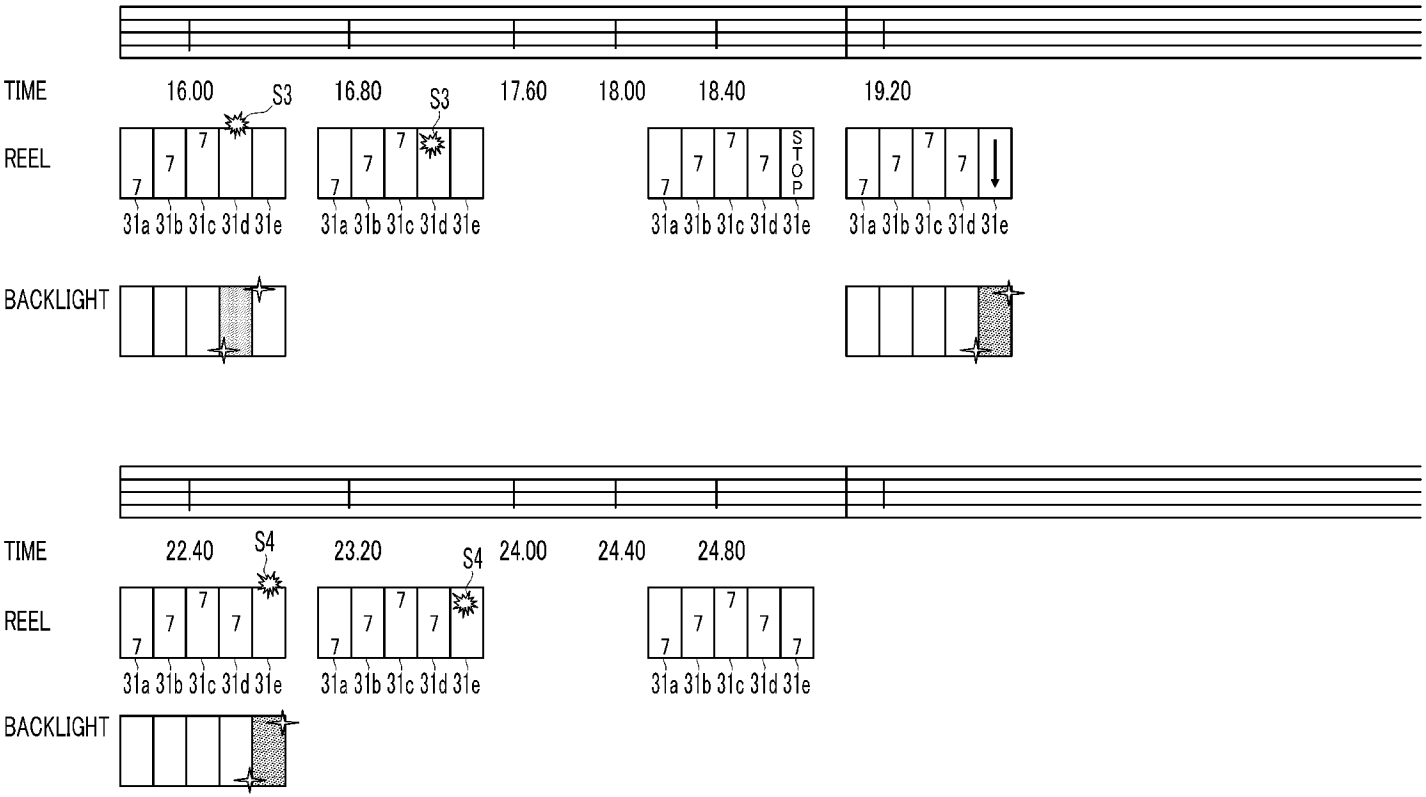
FIG. 65 shows a rendering effect 6 that a specific symbol is stopped on the fifth reel.

FIG. 65 shows a rendering effect 6 that a specific symbol is stopped on the fifth reel.

Referring to FIG. 65, when the time of the timer becomes 24.80 seconds, the fifth reel 31*e* is stopped, and the "7" symbol is arranged on the payline P5 of the fifth reel 31*e*. Accordingly, a winning combination is established by a combination of five "7" symbols that are rearranged on the first to fifth reels 31*a* to 31*e* of the payline P5.

As such, the gaming machine can control the reels 31*a* to 31*e* and/or the backlight units 34 in synchronization with the time. At this time, the gaming machine may output a sound such as a music that is synchronized with the predefined times. Then, the reels 31*a* to 31*e* can move in synchronization with the music. Accordingly, the player can feel like the reels 31*a* to 31*e* dance to the music such that the player can be interested in the game.

When the gaming machine 1 performs the rendering process, the gaming machine 1 may use an execution program referring to various files such as data sheets or may use a program into which the various files are programmed and complied. The data sheets may be generated by a gaming machine development system and then be provided to the gaming machine 1. Alternatively, the gaming machine development system may generate the data sheets and then generate the program by compiling the data sheets, and provide the program to the gaming machine 1.

Now, a data generating method of a gaming machine development system according to embodiments of the present invention is described in detail with reference to FIG. 66.

Example of Data Sheet

FIG. 66 is a schematic diagram of a data sheet provided by a gaming machine development system according to an embodiment of the present invention.

Referring to FIG. 66, a gaming machine development system provides a data sheet having an editable format such as a spreadsheet. Commands for a gaming operation of a gaming machine 1 are input to the data sheet, and the data sheet to which the commands are input is stored to the gaming machine development system. The commands may include commands for controlling a plurality of reels (31*a* to 31*e* of FIG. 2) and commands for controlling at least one rendering device. Accordingly, reel drivers (32*t* of FIG. 12) can control the reels 31*a* to 31*e* according to the commands of the data sheet, and the rendering driver can control a corresponding rendering device according to the commands of the data sheet. The rendering device renders an effect such as a visual effect or a sound effect, and may include backlight units (34 of FIG. 12) for the reels 31*a* to 31*e* and a speaker (17 of FIG. 2). The rendering drivers of the backlight units 34 may be backlight drivers (34*t* of FIG. 12), and the rendering driver of the speaker 17 may be a main CPU (91 of FIG. 11) or a processor mounted on a motherboard (90 of FIG. 11).

The data sheet includes a plurality of row and a plurality of columns defining a plurality of cells. Each cell is editable, and a corresponding command is input to each cell. The data sheet further includes a plurality of field names that correspond to the plurality of columns, respectively. The field names include field names indicating the reels 31*a* to 31*e* and/or the rendering devices 34 and/or 17. The field names may further include a field name indicating a trigger for triggering each of the plurality of rows and a field name indicating a scene number corresponding to each of the plurality of rows. When each of the rows is triggered, commands that are input to each of the rows may be executed in synchronization with each other.

In an example shown in FIG. 66, the plurality of field names include a scene number (Scene No), a plurality of triggers (Trigger 1, Trigger 2, and Trigger 3), and a plurality of device names. The plurality of device names include a reel field for a column that is predefined to be associated with a plurality of reels 31*a* to 31*e*, a sound field for a column that is predefined to be associated with a speaker 17, and a light field for a column that is predefined to be associated with the backlight units 34.

Further, any one of a plurality of tags is input to a beginning of each row and indicates a function of each row. The plurality of tags are used for synchronization of commands included in the plurality of columns. The plurality of tags may include a scene start tag (#SCENE_ST), a scene trigger tag (#SCENE_TR), and a scene end tag (#SCENE_END). The scene end tag (#SCENE_END) may be omitted. A scene corresponds to a rendering effect for the gaming machine 1. The scene start tag (#SCENE_ST) is input to a row including commands to be executed when each scene starts. The scene trigger tag (#SCENE_TR) is input to a row including commands to be executed when a triggering condition is satisfied after the scene start tag (#SCENE_ST). The scene end tag (#SCENE_END) is input to a row including commands to be executed when each scene ends.

The scene number (Scene No) indicates a number of the scene and corresponds to a priority for defining an order of execution of commands for a plurality of scenes. The scene number (the priority) may start from zero and be incremented to nine. The scene number may be incremented by one when the scene is changed.

The plurality of triggers may include a trigger (Trigger 1 and Trigger 2) for indicating a triggering condition of a scene trigger and a trigger (Trigger 3) for indicating a start or an end of the scene. The trigger (Trigger 1) indicates a triggering condition for triggering each row, and the trigger (Trigger 2) indicates a delay between a time when the triggering condition is satisfied and a time when commands are executed. "START" is input to the trigger (Trigger 3) when the scene is in progress by at least one of the reels 31*a* to 31*e* that is spinning, and "END" is input to the trigger (Trigger 3) when all of the reels 31*a* to 31*e* are stopped. Accordingly, "START" may be input to the trigger (Trigger 3) of rows having the scene start tag (#SCENE_ST) or the scene trigger tag (#SCENE_TR), and "START" may be input to the trigger (Trigger 3) of rows having the scene end tag (#SCENE_END).

When a plurality of scene numbers (Scene No) are input to the data sheet, commands are in the order of scene number (Scene No) in the gaming machine 1. That is, commands that are input to rows having the smallest scene number (Scene No=0) are first performed, and commands that are input to rows having the largest scene number (Scene No=9) are performed last. Further, in rows having the same scene number (Scene No), commands are performed in order of rows having the scene start tag (#SCENE_ST), rows having the scene trigger tag (#SCENE_TR), and rows having the scene end tag (#SCENE_END). Furthermore, in rows having the scene trigger tag in the same scene number (Scene No), commands are performed in order of a triggering condition (Trigger 1 and/or Trigger 2). Accordingly, the order of execution for the commands is defined based on the tag, the scene number (the priority), and the triggering condition.

In some embodiments, the order of execution for the commands may be defined based on the scene number (the priority) and the triggering condition without the tag. That is, a game program or an execution program can identify that commands are executed in order of scene number. Further, the game program or the execution program can identify that commands of rows having no triggering condition are first executed and then commands of rows having the triggering condition are executed in the same scene number because the rows having no triggering condition (Trigger 1 or Trigger 2) correspond to the scene start tag. Furthermore, the game program or the execution program can identify that commands of rows are executed in order of triggering condition. In this case, the scene end tag may not be used in the data sheet.

A filename of a reel control file for controlling the plurality of reels 31*a* to 31*e* may be input to the reel field as a command. The reel control file includes information for controlling the reels 31*a* to 31*e*, and may include, for example, a speed for spinning each of the reels 31*a* to 31*e*, a direction for spinning each of the reels 31*a* to 31*e*, and/or a time for stopping each of the reels 31*a* to 31*e*. The reel control file may be a comma-separated values (CSV) file.

A sound filename field for controlling a sound output from the speaker 17 may be input to the sound field. The sound control file may be an audio file such waveform audio file (WAV) format, MPEG-1 or MPEG-2 audio layer III (MP3) format, or an ogg format that is a free, open container format maintained by the Xiph.Org Foundation. Further, the sound field may further include an attribute field to which an attribute of the sound is input. The attribute may be any one of "ONCE" for playing the sound control file once, "REPEAT" for repeatedly playing the sound control file, and "STOP" for stopping a play of the sound control file. The sound control file may be a CSV file.

A light control file for controlling the backlight units 34 of the reels 31*a* to 31*e* may be input to the light field. The light control file includes information for controlling the backlight units 34, and may include, for example, information for controlling the backlight unit 34 corresponding to each of the reels 31*a* to 31*e*. The light control file may be a CSV file.

The data sheets generated and stored by the gaming machine development system are provided to the gaming machine 1. In this case, the data sheets may be transferred to the gaming machine 1 through a wire or wireless network, and the transferred data sheets may be stored to a memory of the gaming machine 1, for example a RAM 93 or a ROM 92. Alternatively, a data storage device storing the data sheets may be provided to the gaming machine 1. The data storage device may be a storage device of the gaming machine 1, for example a memory card (84*s* of FIG. 11). The gaming machine 1 may copy the data sheets stored to the data storage device to its memory, for example the RAM 93 or ROM 92. Next, a controller of the gaming machine 1 executes the commands of the data sheets using an execution program. Since each column of the data sheet is predefined to be associated with the reels 31*a* to 31*e* or the rendering device of the gaming machine 1, the controller can execute the command of each field to control the reels 31*a* to 31*e*, the speaker 17, and/or the backlight units 34.

Alternatively, the gaming machine development system may generates a program based on the data sheets. For example, the gaming machine development system may combine the commands of the data sheets with a basic program such that the program may be generated. In this case, the basic program may be a program including a plurality of subroutines for interpreting the commands of the data sheets. That is, the data sheets may be compiled by the basic program. The generated program may be transferred or provided to the gaming machine 1, and the program may be stored to a memory of the gaming machine 1. Alternatively, a data storage device storing the data sheets may be provided to the gaming machine 1. Next, the controller of the gaming machine 1 executes the program to control the reels 31*a* to 31*e*, the speaker 17, and/or the backlight units 34 according to the commands of the data sheets included in the program.

As such, according to an embodiment of the present invention, a user can easily input to the data sheets commands for controlling the reels 31*a* to 31*e* and the rendering device, thereby generating the commands for synchronizing operations of the reels 31*a* to 31*a* and/or the rendering device with a time.

Example of Data Sheet for Rendering Effect 6

Next, an example of a data sheet for the rendering effect shown in FIG. 65 is described in detail with reference to FIG. 67 to FIG. 70.

FIG. 67 is a schematic diagram of an example data sheet for a rendering effect 6 according to an embodiment of the present invention, FIG. 68 to FIG. 75 are schematic diagrams of example reel controls file shown in FIG. 67.

It is exemplified in FIG. 67 that the specific symbols ("7" symbols) are stopped on a payline of the first to fifth reels 31*a* to 31*e*. Accordingly, commands for rendering the rendering effect 6 are input to the data sheet as shown in FIG. 67.

As shown in FIG. 67, a scene start tag (#SCENE_ST) is first input to at least one row for a start of the first scene (Scene No=0). It is assumed in FIG. 124 that the scene start tag (#SCENE_ST) is input to one row. When inputting the scene start tag (#SCENE_ST), a user may input "START" to a trigger (Trigger 3) of the row to which the scene start tag (#SCENE_ST) is input.

In the first scene (Scene No=0), after a plurality of reels 31*a* to 31*e* start to spin, the first and second reels 31*a* and 31*b* are sequentially stopped. A filename (ReelAllSpeed.csv) of a reel control file for controlling these movements of the reels 31*a* to 31*e* is input to a reel field of the data sheet. Accordingly, the gaming machine 1 can spin the reels 31*a* to 31*e* according to information included in the reel control file when the scene starts.

Referring to FIG. 68, the reel control file includes commands for controlling each of the reels 31*a* to 31*e*. An example of the reel control file includes a reel number (Reel No), a reel spin, a spin direction, a highest speed, a lowest speed, a lowest spin time, and a stop interval.

The reel number indicates each of the first, second, third, fourth, and fifth reels 31*a* to 31*e*. A command for defining moving of each of the reels 31*a* to 31*e* is input to the reel spin field of the reel control file. For example, the value "0" of the reel spin may indicate stopping a spin of a corresponding reel at a predetermined time, and the value "1" of the reel spin may indicate maintaining the spin of the corresponding reel. A command for defining a spin direction of each of the reels 31*a* to 31*e* is input to the spin direction field of the reel control file. For example, a value for indicating "a forward spin" or a value for indicating "a reverse spin" of a corresponding reel may be input to the spin direction field. Values for defining the highest spin speed and the lowest spin of each of the reels 31*a* to 31*e* are input to the highest speed and the lowest speed of the reel control file, respectively. Their measurement units may be revolutions per minute (RPM). The highest speed may be generally used as the spin speed of the corresponding reel, and the lowest speed may be used as the spin speed of the corresponding reel at a special mode, for example, a mode for a low speed spin of the corresponding reel. The lowest value of a spin time of each of the reels 31*a* to 31*e* is input to the lowest spin time field of the reel control file. A time interval, i.e., a delay time between the lowest spin time and a stop of the corresponding is input to the stop interval field of the reel control file. Accordingly, each of the reels 31*a* to 31*e* is stopped after a sum of the value of a corresponding stop interval and a corresponding lowest spin time is lapsed. In the example of FIG. 68, the spin time (five seconds) of the first reel 31*a* is input to the lowest spin time field, and one second is input to the stop interval of the second reel 31*b*. Accordingly, after the reels 31*a* to 31*e* spin for five seconds in the forward direction, the first reel 31*a* is stopped and then the second reel 31*b* is stopped. Further, the value of "1" is input to the reel spin fields of the third to fifth reels 31*c* to 31*e* such that the third to fifth reels 31*c* to 31*e* can continuously spin after the first scene.

A data type of a command input to each of the fields of the reel control file may be defined as a data type of a programming language (for example, the C programming language) for the execution program or the basic program compiling the data sheet. The execution program can execute the commands of the reel control file, or the commands of the reel control file can be complied by the basic program.

Referring to FIG. 67 again, when the reels 31*a* to 31*e* move according to the reel control file, the speaker 17 can output a sound. Accordingly, a filename (BGM) of a sound file to be output is input to a sound field of the data sheet. Accordingly, the gaming machine 1 can output the sound in synchronization with movements of the reels 31*a* to 31*e*.

Furthermore, when the reels 31*a* to 31*e* move according to the reel control file, the backlight emits the light. Accordingly, a filename of a lighting control file for controlling the backlight units 34*t* may be input to a light field of the data sheet.

A scene trigger tag (#SCENE_TR) is input to at least one row for an event to be triggered in the scene. In the first scene, two events corresponding to stops of the first and second reels 31*a* and 31*b* may be triggered. That is, the scene trigger tag (#SCENE_TR) is first input to at least one row for the event corresponding to the stop of the first reel 31*a*. It is assumed in FIG. 67 that the scene trigger tag (#SCENE_TR) is input to one row. Further, the stop of the first reel 31*a* (R1_STOP) is input, as a triggering condition, to a trigger (Trigger 1) of the row to which the scene trigger tag (#SCENE_TR) is input. Accordingly, commands of the row to which the scene trigger tag (#SCENE_TR) and "R1_STOP" are input are simultaneously executed when the first reel 31*a* stops. When inputting "R1_STOP", the user may input "START" to a trigger (Trigger 3) of the same row. Further, a filename of a sound file (STOP_SOUND) for outputting a sound notifying a stop of the reel is input, as a command, to the sound field of the row to which the scene trigger tag (#SCENE_TR) and "R1_STOP" are input.

Next, the scene trigger tag (#SCENE_TR) is input to at least one row for the event corresponding to the stop of the second reel 31*b*. Further, the stop of the second reel 31*b* (R2_STOP) and "START" are input to triggers (Trigger 1 and Trigger 3) of the row to which the scene trigger tag (#SCENE_TR) for the stop of the second reel 31*b* is input. Furthermore, a filename (STOP_SOUND) of the sound control file is input, as a command, to the sound field of the row to which the scene trigger tag (#SCENE_TR) and "R1_STOP" are input.

Accordingly, when the first and second reels 31*a* and 31*b* are stopped in the first scene, the commands of the rows to which the scene trigger tag (#SCENE_TR) and the triggering condition of "R1_STOP" or "R2_STOP" are input are executed. Accordingly, the STOP_SOUND can be output from the speaker 17 when each of the first and second reels 31*a* and 31*b* is stopped.

The first scene ends and the second scene starts when both the first and second reels 31*a* and 31*b* are stopped. Accordingly, a scene start tag (#SCENE_ST) for the second scene (Scene No=1) is input to at least one row. In the second scene, after the third to fifth reels 31*c* to 31*e* spins for a predetermined time, for example 3.20 seconds, the fourth and fifth reels 31*d* and 31*e* are stopped and the third reels spins by one symbol each time 0.8 second elapses. Therefore, a filename (12Stop345High.csv) of a reel control file for controlling these movements of the reels 31*a* to 31*e* is input to a reel field of the data sheet.

Referring to FIG. 69, the reel control file (12Stop345High.csv) includes commands for controlling each of the reels 31*a* to 31*e*. In the example of FIG. 69, 3.20 seconds is input to the lowest spin time fields of the fourth and fifth reels 31*d* and 31*e*, and zero second is input to the stop interval fields of the fourth and fifth reels 31*d* and 31*e*. Accordingly, when 3.2 seconds elapse after the second scene starts, the fourth and fifth reels 31*d* and 31*e* are stopped. Further, the value of "1" is input to the reel spin field of the third reel 31*c* such the third reel can continuously spin. Furthermore, zero second is input to the lowest spin time fields and the stop interval fields of the first and second reels 31*a* and 31*b* such that the first and second reels 31*a* and 31*b* can be stopped.

Referring to FIG. 67 again, when the third reel 31*c* spins according to the reel control file (12Stop345High.csv), the gaming machine 1 starts to output a sound such as a music through the speaker 17. A filename (MUSIC) of a sound file to be output is input to a sound field of the data sheet. Accordingly, the third reel 31*c* can move in synchronization with the music.

Furthermore, when the third reel 31*c* spins according to the reel control file (12Stop345High.csv), the backlight unit 34*t* of the third reel 31*c* emits the light according to a predetermined lighting pattern. Accordingly, a filename of a lighting control file (Lighting_Pattern1.csv) corresponding to the predetermined lighting pattern is input to a light field of the data sheet.

Next, a scene trigger tag (#SCENE_TR) is input to at least one row for the first event to be triggered in the second scene. In the second scene, when 3.20 seconds elapse after the speaker 17 starts to output the music by the start of the second scene, the first event for spinning the third reel 31*c* by one symbol is triggered. Accordingly, the start of the music (MUSIC_START) is input, as a triggering condition, to a trigger (Trigger 1) of the row to which the scene trigger tag (#SCENE_TR) is input. Further, 3.20 seconds is input, as another triggering condition, to a trigger (Trigger 2) of the row to which the scene trigger tag (#SCENE_TR) is input. Commands of the row to which the scene trigger tag (#SCENE_TR), "MUSIC_START" and "3.20 seconds" are input are simultaneously executed when 3.20 seconds elapse after the start of the second scene.

Further, a filename (1245Stop3Coma.csv) of a reel control file for spinning the third reel 31*c* by one symbol is input to the reel field of the row to which the scene trigger tag (#SCENE_TR), "MUSIC_START" and "3.20 seconds" are input. Referring to FIG. 70, the reel control file (1245Stop3Coma.csv) includes commands for controlling the third reel 31*c*. In the example of FIG. 70, 3 RPM is input to the lowest speed field of the third reel 31*c* and 2.4 seconds are input to the lowest spin time field of the third reel 31*c*. Accordingly, the third reels 31*c* spins at the speed of the 3 RPM during 2.4 seconds. It is assumed that the speed of 3 RPM is a speed at which the third reel 31*c* can spin by one symbol during 0.8 seconds. Further, zero second is input to the lowest spin time fields and the stop interval fields of the first, second, fourth, and fifth reels 31*a*, 31*b*, 31*d*, and 31*e* such that the first, second, fourth, and fifth reels 31*a*, 31*b*, 31*d*, and 31*e* can be stopped. Therefore, the third reel 31*c* can spin by one symbol each time 0.8 second elapses and can be stopped after 2.4 seconds. Further, the third reel 31 can move in synchronization with the time or the music of the second scene.

Furthermore, when the third reel 31*c* spins according to the reel control file (1245Stop3Coma.csv), the backlight unit 34*t* of the third reel 31*c* emits the light according to a predetermined lighting pattern. Accordingly, the filename of the lighting control file (Lighting_Pattern1.csv) corresponding to the predetermined lighting pattern is input to the light field of the data sheet. The lighting control file for the first event may be equal to or different from the lighting control file for the second scene start.

As a result, an effect from zero second to 5.60 seconds can be rendering in the rendering effect 6 as shown in FIG. 61.

Next, a scene trigger tag (#SCENE_TR) is input to at least one row for the second event to be triggered in the second scene. When 6.40 seconds elapse after the speaker 17 starts to output the music by the start of the second scene, the second event for spinning the third reel 31*c* at a low speed is triggered. Accordingly, the start of the music (MUSIC_START) is input, as a triggering condition, to a trigger (Trigger 1) of the row to which the scene trigger tag (#SCENE_TR) is input. Further, 6.40 seconds are input, as another triggering condition, to a trigger (Trigger 2) of the row to which the scene trigger tag (#SCENE_TR) is input. Commands of the row to which the scene trigger tag (#SCENE_TR), "MUSIC_START" and "6.40 seconds" are input are simultaneously executed when 6.40 seconds elapse after the start of the second scene.

Further, a filename (12Stop3Slow.csv) of a reel control file for spinning the third reel 31*c* at the low speed is input to the reel field of the row to which the scene trigger tag (#SCENE_TR), "MUSIC_START" and "6.40 seconds" are input. Referring to FIG. 71, the reel control file (12Stop3Slow.csv) includes commands for controlling the third to fifth reels 31*c* to 31*e*. In the example of FIG. 71, 20 RPM is input to the lowest speed field of the third reel 31*c*, and 80 RPM is input to the lowest speed fields of the fourth and fifth reels 31*d* and 31*e*. Further, 3.2 seconds are input to the lowest spin time fields of the fourth and fifth reels 31*d* and 31*e*, and zero second is input to the stop interval fields of the fourth and fifth reels 31*d* and 31*e*. The value of "1" is input to the reel spin field of the third reel 31*c*. Accordingly, the third reels 31*c* can spin at the low speed of the 20 RPM, and the fourth and fifth reels 31*d* and 31*e* can spin at the high speed of the 80 RPM during 3.2 seconds, in synchronization with the time or the music of the second scene.

Furthermore, when the third reel 31*c* spins according to the reel control file (12Stop3Slow.csv), the backlight unit 34*t* of the third reel 31*c* emits the light according to a predetermined lighting pattern. Accordingly, a filename of a lighting control file (Lighting_Pattern2.csv) corresponding to the predetermined lighting pattern is input to the light field of the data sheet.

As a result, an effect from 6.40 seconds to 9.60 seconds can be rendering in the rendering effect 6 as shown in FIG. 61.

Next, a scene trigger tag (#SCENE_TR) is input to at least one row for the third event to be triggered in the second scene. When 9.60 seconds elapse after the speaker 17 starts to output the music by the start of the second scene, the third event for spinning the third reel 31*c* by one symbol is triggered. Accordingly, the start of the music (MUSIC_START) is input, as a triggering condition, to a trigger (Trigger 1) of the row to which the scene trigger tag (#SCENE_TR) is input. Further, 9.60 seconds are input, as another triggering condition, to a trigger (Trigger 2) of the row to which the scene trigger tag (#SCENE_TR) is input. Commands of the row to which the scene trigger tag (#SCENE_TR), "MUSIC_START" and "9.60 seconds" are input are simultaneously executed when 9.60 seconds elapse after the start of the second scene.

Further, a filename (1245Stop3Coma.csv) of a reel control file for spinning the third reel 31*c* by one symbol is input to the reel field of the row to which the scene trigger tag (#SCENE_TR), "MUSIC_START" and "9.60 seconds" are input. The reel control file (1245Stop3Coma.csv) may include commands shown in FIG. 70. Therefore, the third reel 31*c* can spin by one symbol each time 0.8 second elapses and can be stopped after 2.4 seconds. Further, the third reel 31 can move in synchronization with the music of the second scene.

Furthermore, when the third reel 31*c* spins according to the reel control file (1245Stop3Coma.csv), the backlight unit 34*t* of the third reel 31*c* emits the light according to a predetermined lighting pattern. Accordingly, the filename of the lighting control file (Lighting_Pattern2.csv) corresponding to the predetermined lighting pattern is input to the light field of the data sheet. The lighting control file for the third event may be equal to or different from the lighting control file for the second event.

As a result, an effect from 9.60 seconds to 12.00 seconds can be rendering in the rendering effect 6 as shown in FIG. 61.

Next, a scene trigger tag (#SCENE_TR) is input to at least one row for the fourth event to be triggered in the second scene. When 12.80 seconds elapse after the speaker 17 starts to output the music by the start of the second scene, the fourth event for spinning the fourth reel 31*d* at the low speed is triggered. Accordingly, the start of the music (MUSIC_START) is input, as a triggering condition, to a trigger (Trigger 1) of the row to which the scene trigger tag (#SCENE_TR) is input. Further, 12.80 seconds are input, as another triggering condition, to a trigger (Trigger 2) of the row to which the scene trigger tag (#SCENE_TR) is input. Commands of the row to which the scene trigger tag (#SCENE_TR), "MUSIC_START" and "12.80 seconds" are input are simultaneously executed when 12.80 seconds elapse after the start of the second scene.

Further, a filename (123Stop4Slow.csv) of a reel control file for spinning the fourth reel 31*d* at the low speed is input to the reel field of the row to which the scene trigger tag (#SCENE_TR), "MUSIC_START" and "12.80 seconds" are input. Referring to FIG. 72, the reel control file (123Stop4Slow.csv) includes commands for controlling the fourth and fifth reels 31*d* and 31*e*. In the example of FIG. 72, 20 RPM is input to the lowest speed field of the fourth reel 31*d*, and 80 RPM is input to the lowest speed field of the fifth reel 31*e*. Further, 3.2 seconds are input to the lowest spin time field of the fifth reel 31*e*, and zero second is input to the stop interval field of the fifth reel 31*e*. The value of "1" is input to the reel spin field of the fourth reel 31*d*. Accordingly, the fourth reels 31*d* can spin at the low speed of the 20 RPM, and the fifth reel 31*e* can spin at the high speed of the 80 RPM during 3.2 seconds, in synchronization with the time or the music of the second scene.

Furthermore, when the fourth reel 31*d* spins according to the reel control file (123Stop4Slow.csv), the backlight unit 34*t* of the fourth reel 31*d* emits the light according to a predetermined lighting pattern. Accordingly, a filename of a lighting control file (Lighting_Pattern3.csv) corresponding to the predetermined lighting pattern is input to the light field of the data sheet.

As a result, an effect from 12.80 seconds to 16.00 seconds can be rendering in the rendering effect 6 as shown in FIG. 63.

Next, a scene trigger tag (#SCENE_TR) is input to at least one row for the fifth event to be triggered in the second scene. When 16.00 seconds elapse after the speaker 17 starts to output the music by the start of the second scene, the fifth event for spinning the fourth reel 31*d* by one symbol is triggered. Accordingly, the start of the music (MUSIC_START) is input, as a triggering condition, to a trigger (Trigger 1) of the row to which the scene trigger tag (#SCENE_TR) is input. Further, 16.00 seconds are input, as another triggering condition, to a trigger (Trigger 2) of the row to which the scene trigger tag (#SCENE_TR) is input. Commands of the row to which the scene trigger tag (#SCENE_TR), "MUSIC_START" and "16.00 seconds" are input are simultaneously executed when 16.00 seconds elapse after the start of the second scene.

Further, a filename (1235Stop4Coma.csv) of a reel control file for spinning the fourth reel 31*d* by one symbol is input to the reel field of the row to which the scene trigger tag (#SCENE_TR), "MUSIC_START" and "16.00 seconds" are input. Referring to FIG. 73, 3 RPM is input to the lowest speed field of the fourth reel 31*d* and 2.4 seconds are input to the lowest spin time field of the fourth reel 31*d*. Further, zero second is input to the lowest spin time fields and the stop interval fields of the first, second, third, and fifth reels 31*a*, 31*b*, 31*e*, and 31*e* such that the first, second, third, and fifth reels 31*a*, 31*b*, 31*c*, and 31*e* can be stopped. Therefore, the fourth reel 31*d* can spin by one symbol each time 0.8 second elapses and can be stopped after 2.4 seconds. Further, the fourth reel 31*d* can move in synchronization with the time or the music of the second scene.

Furthermore, when the fourth reel 31*d* spins according to the reel control file (1235Stop4Coma.csv), the backlight unit 34*t* of the fourth reel 31*d* emits the light according to a predetermined lighting pattern. Accordingly, the filename of the lighting control file (Lighting_Pattern3.csv) corresponding to the predetermined lighting pattern is input to the light field of the data sheet. The lighting control file for the fifth event may be equal to or different from the lighting control file for the fourth event.

As a result, an effect from 16.00 seconds to 18.40 seconds can be rendering in the rendering effect 6 as shown in FIG. 63.

Next, a scene trigger tag (#SCENE_TR) is input to at least one row for the sixth event to be triggered in the second scene. When 19.20 seconds elapse after the speaker 17 starts to output the music by the start of the second scene, the sixth event for spinning the fifth reel 31*e* at the low speed is triggered. Accordingly, the start of the music (MUSIC_START) is input, as a triggering condition, to a trigger (Trigger 1) of the row to which the scene trigger tag (#SCENE_TR) is input. Further, 19.20 seconds are input, as another triggering condition, to a trigger (Trigger 2) of the row to which the scene trigger tag (#SCENE_TR) is input. Commands of the row to which the scene trigger tag (#SCENE_TR), "MUSIC_START" and "19.20 seconds" are input are simultaneously executed when 19.20 seconds elapse after the start of the second scene.

Further, a filename (1234Stop5Slow.csv) of a reel control file for spinning the fifth reel 31*e* at the low speed is input to the reel field of the row to which the scene trigger tag (#SCENE_TR), "MUSIC_START" and "19.20 seconds" are input. Referring to FIG. 74, the reel control file (1234Stop5Slow.csv) includes commands for controlling the fifth reel 31*e*. That is, 20 RPM is input to the lowest speed field of the fifth reel 31*e*. Accordingly, the fifth reel 31*e* can spin at the low speed of the 20 RPM in synchronization with the time or the music of the second scene.

Furthermore, when the fifth reel 31*e* spins according to the reel control file (1234Stop5Slow.csv), the backlight unit 34*t* of the third reel 31*c* emits the light according to a predetermined lighting pattern. Accordingly, a filename of a lighting control file (Lighting_Pattern4.csv) corresponding to the predetermined lighting pattern is input to the light field of the data sheet.

As a result, an effect from 19.20 seconds to 22.40 seconds can be rendering in the rendering effect 6 as shown in FIG. 65.

Next, a scene trigger tag (#SCENE_TR) is input to at least one row for the seventh event to be triggered in the second scene. When 22.40 seconds elapse after the speaker 17 starts to output the music by the start of the second scene, the seventh event for spinning the fifth reel 31*e* by one symbol is triggered. Accordingly, the start of the music (MUSIC_START) is input, as a triggering condition, to a trigger (Trigger 1) of the row to which the scene trigger tag (#SCENE_TR) is input. Further, 22.40 seconds are input, as another triggering condition, to a trigger (Trigger 2) of the row to which the scene trigger tag (#SCENE_TR) is input. Commands of the row to which the scene trigger tag (#SCENE_TR), "MUSIC_START" and "22.40 seconds" are input are simultaneously executed when 22.40 seconds elapse after the start of the second scene.

Further, a filename (1234Stop5Coma.csv) of a reel control file for spinning the fifth reel 31*e* by one symbol is input to the reel field of the row to which the scene trigger tag (#SCENE_TR), "MUSIC_START" and "22.40 seconds" are input. Referring to FIG. 75, 3 RPM is input to the lowest speed field of the fifth reel 31*e* and 2.4 seconds are input to the lowest spin time field of the fifth reel 31*e*. Further, zero second is input to the lowest spin time fields and the stop interval fields of the first to fourth reels 31*a* to 31*d* such that the first to fourth reels 31*a* to 31*d* can be stopped. Therefore, the fifth reel 31*e* can spin by one symbol each time 0.8 second elapses and can be stopped after 2.4 seconds. Further, the fifth reel 31*e* can move in synchronization with the time or the music of the second scene.

Furthermore, when the fifth reel 31*e* spins according to the reel control file (1234Stop5Coma.csv), the backlight unit 34*t* of the fifth reel 31*e* emits the light according to a predetermined lighting pattern. Accordingly, the filename of the lighting control file (Lighting_Pattern4.csv) corresponding to the predetermined lighting pattern is input to the light field of the data sheet. The lighting control file for the seventh event may be equal to or different from the lighting control file for the sixth event.

As a result, an effect from 22.40 seconds to 24.80 seconds can be rendering in the rendering effect 6 as shown in FIG. 65.

The second scene ends when all of the reels 31*a* to 31*e* are stopped. Accordingly, a scene end tag (#SCENE_END) is input to at least one row for an event corresponding to the end of the scene. When inputting the scene end tag, the user may input "END" to a trigger (Trigger 3) of the same row. If no event is performed when the scene ends, the scene end tag (#SCENE_END) may be omitted.

As such, according to the example of the data sheet shown in FIG. 67 to FIG. 75, the rendering effect 6 can be rendered. In this case, movements of the reels 31*a* to 31*e* and/or the lighting pattern of the backlight units 34 can be synchronized with the time or the music.

Next, a game process of the gaming machine 1 using the example data sheet shown in FIG. 67 to FIG. 75 is described with reference to FIG. 76A to FIG. 76C.

Figure 76A:
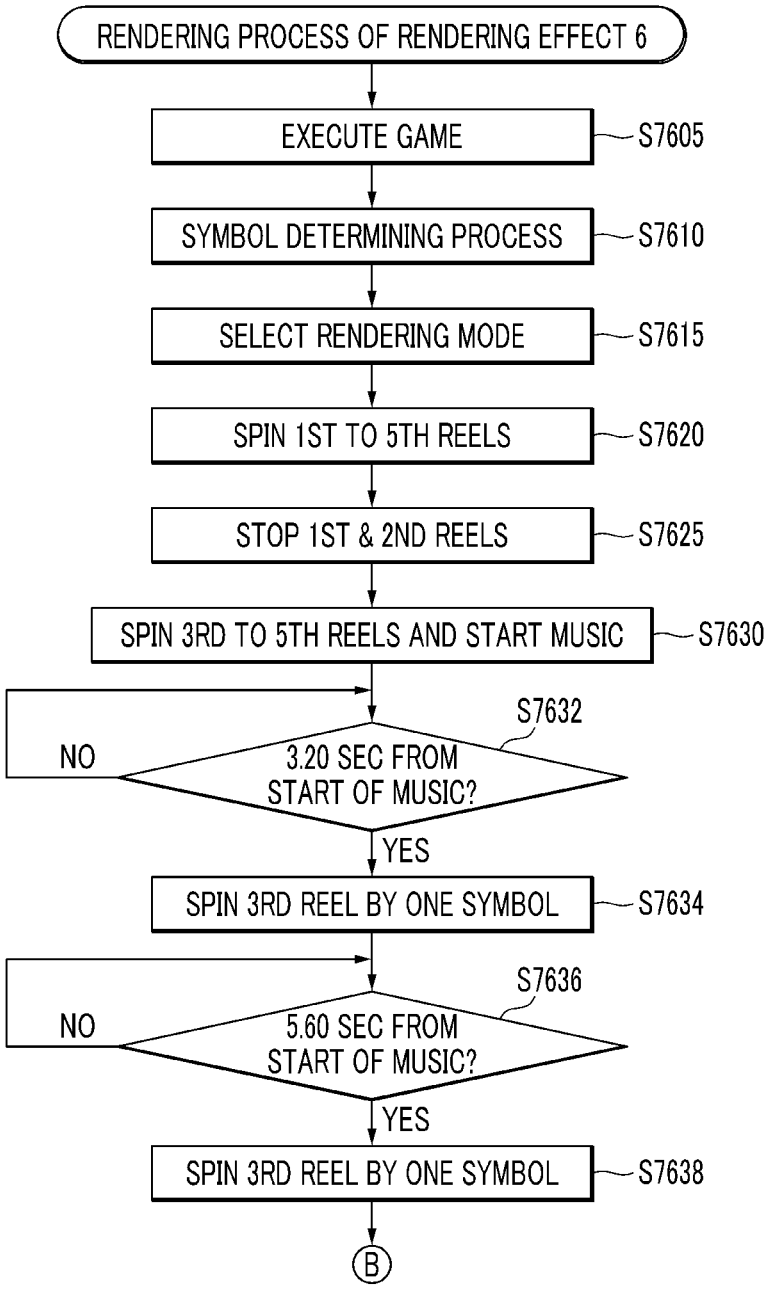
FIG. 76A to FIG. 76C are flowcharts of an example game process using a data sheet according to an embodiment of the present invention.
Figure 76B:
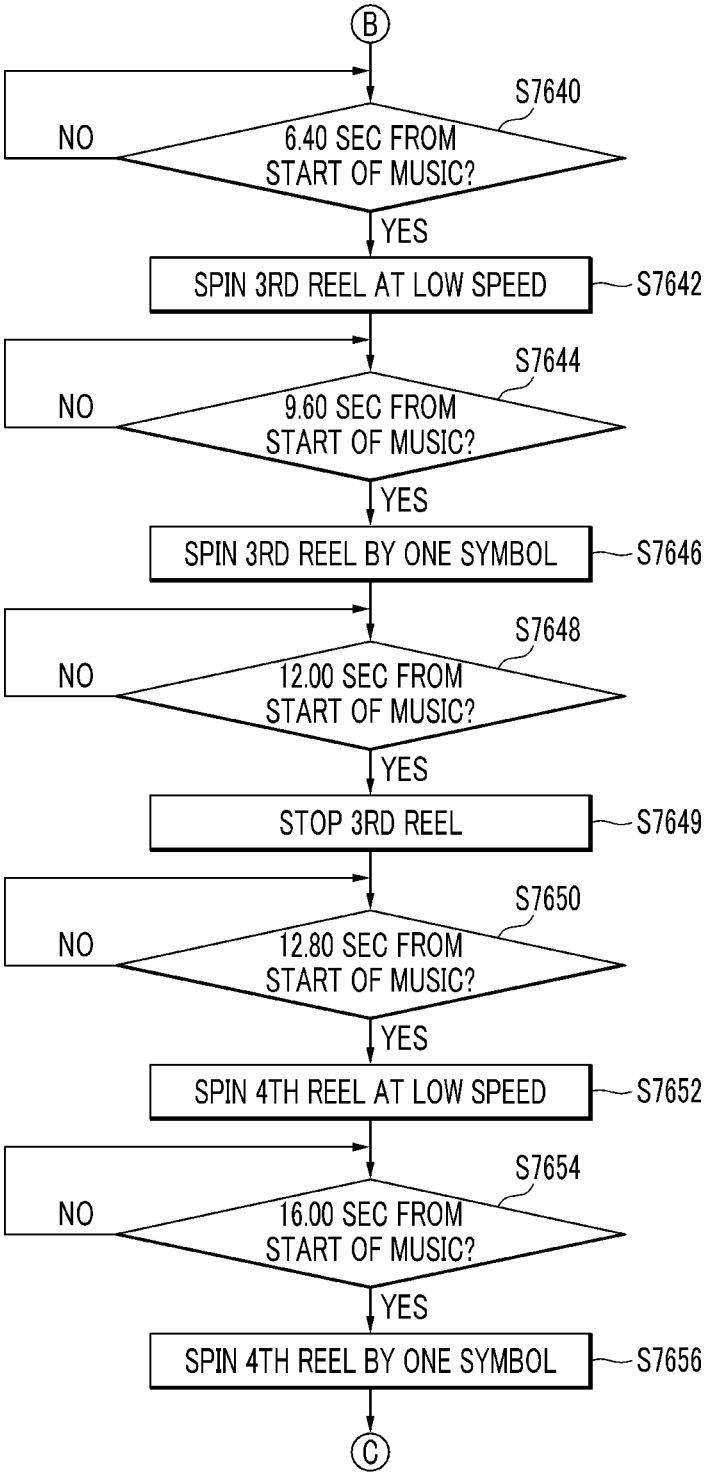
Figure 76C:
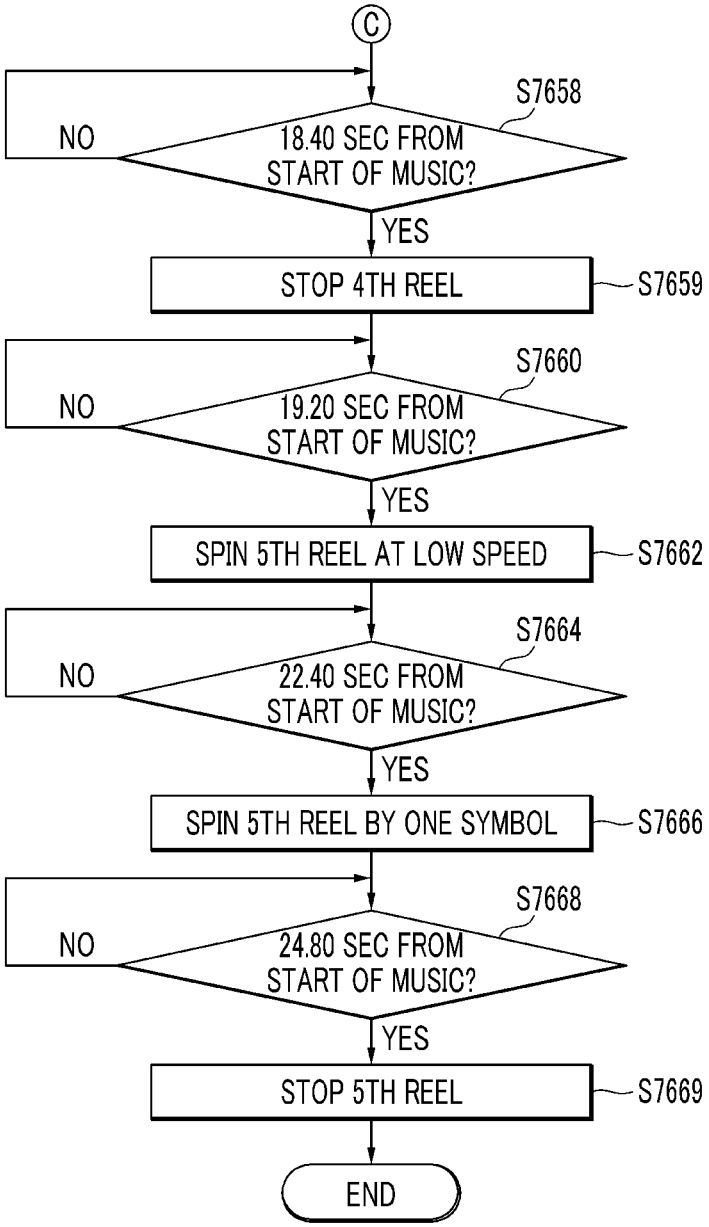

FIG. 76A to FIG. 76C are flowcharts of an example game process using a data sheet according to an embodiment of the present invention.

Referring to FIG. 76, the controller of the gaming machine 1 executes a normal round or a free round of a game (S7605), and performs a symbol determining process (S7610). It is assumed in this example that a result of the symbol determined process is a combination of five "7" symbols on the fifth payline (P5 of FIG. 5). The controller selects a rendering mode from among a plurality of rendering modes according to the result of the symbol determining process (S7615). In this example, the rendering mode corresponding to the rendering effect 6 shown in FIG. 65 is selected. Accordingly, the controller controls a plurality of reels 31*a* to 31*e* and/or a rendering device according to a data sheet that corresponds to the selected rendering mode among a plurality of data sheets for the plurality of rendering modes.

First, referring to FIG. 67 and FIG. 76, the controller spins the reels 31*a* to 31*e* according to a command of a row to which a scene start tag (#SCENE_ST) of the first scene (Scene No=0) is input (S7620), and sequentially stops the first and second reel 31*a* and 31*b* (S7625). When the first and second reels 31*a* and 31*b* are stopped, the "7" symbols are rearranged on the fifth payline P5 of the first and second reels 31*a* and 31*b*. Further, the controller may control the rendering device according to a command of a row having a stop of the first reel 31*a* ("R1_STOP") or a stop of the second reel 31*b* ("R2_STOP") as a triggering condition.

After the second reel 31*b* is stopped, the controller controls the reels 31*a* to 31*e* according to a command of a row to which a scene start tag (#SCENE_ST) of the second scene (Scene No=0) is input (S7630). That is, the controller continuously spins the third to fifth reels 31*c* to 31*c* while stopping the first and second reels 31*a* and 31*b*. Further, the controller may control the speaker 17 to output a music and control the backlight unit 34 of the third reel 31*c* to emit the light, according to a command of a row to which a scene start tag (#SCENE_ST) of the second scene (Scene No=0) is input.

When 3.20 seconds elapse from the start of the second scene, the controller controls the reels 31*a* to 31*e* according to a command of a row having a start of the music and 3.20 seconds as triggering conditions (S7635). That is, the controller spins the third reel 31*c* by one symbol each time 0.8 second elapses while stopping the first, second, fourth, and fifth reels 31*a*, 31*b*, 31*d*, and 31*e*. Further, the controller may control the backlight unit 34 of the third reel 31*c* to emit the light according to a command of said row. When 5.60 seconds elapse from the start of the second scene, the controller stops the third reel 31*c* (S7640). In this case, the "7" symbol is not rearranged on the fifth payline P5 of the third reel 31*c*.

When 6.40 seconds elapse from the start of the second scene, the controller controls the reels 31*a* to 31*e* according to a command of a row having the start of the music and 6.40 seconds as triggering conditions (S7645). That is, the controller spins the third reel 31*c* at a low speed while stopping the first and second reels 31*a* and 31*b* and spinning the fourth and fifth reels 31*d* and 31*e* at a high speed. Further, the controller may control the backlight unit 34 of the third reel 31*c* to emit the light according to a command of said row.

When 9.60 seconds elapse from the start of the second scene, the controller controls the reels 31*a* to 31*e* according to a command of a row having the start of the music and 9.60 seconds as triggering conditions (S7650). That is, the controller spins the third reel 31*c* by one symbol each time 0.8 second elapses while stopping the first, second, fourth, and fifth reels 31*a*, 31*b*, 31*d*, and 31*e*. Further, the controller may control the backlight unit 34 of the third reel 31*c* to emit the light according to a command of said row. When 12.00 seconds elapse from the start of the second scene, the controller stops the third reel 31*c* (S7655). In this case, the "7" symbol is rearranged on the fifth payline P5 of the third reel 31*c*.

When 12.80 seconds elapse from the start of the second scene, the controller controls the reels 31*a* to 31*e* according to a command of a row having the start of the music and 12.80 seconds as triggering conditions (S7660). That is, the controller spins the fourth reel 31*d* at the low speed while stopping the first to third reels 31*a* to 31*c* and spinning the fifth reel 31*e* at the high speed. Further, the controller may control the backlight unit 34 of the fourth reel 31*d* to emit the light according to a command of said row.

When 16.00 seconds elapse from the start of the second scene, the controller controls the reels 31*a* to 31*e* according to a command of a row having the start of the music and 16.00 seconds as triggering conditions (S7665). That is, the controller spins the fourth reel 31*d* by one symbol each time 0.8 second elapses while stopping the first, second, third, and fifth reels 31*a*, 31*b*, 31*c*, and 31*e*. Further, the controller may control the backlight unit 34 of the fourth reel 31*d* to emit the light according to a command of said row. When 18.40 seconds elapse from the start of the second scene, the controller stops the fourth reel 31*d* (S7670). In this case, the "7" symbol is rearranged on the fifth payline P5 of the fourth reel 31*d*.

When 19.20 seconds elapse from the start of the second scene, the controller controls the reels 31*a* to 31*e* according to a command of a row having the start of the music and 19.20 seconds as triggering conditions (S7675). That is, the controller spins the fifth reel 31*e* at the low speed while stopping the first to fourth reels 31*a* to 31*d*. Further, the controller may control the backlight unit 34 of the fifth reel 31*e* to emit the light according to a command of said row.

When 22.40 seconds elapse from the start of the second scene, the controller controls the reels 31*a* to 31*e* according to a command of a row having the start of the music and 22.40 seconds as triggering conditions (S7680). That is, the controller spins the fifth reel 31*e* by one symbol each time 0.8 second elapses while stopping the first to fourth reels 31*a* to 31*d*. Further, the controller may control the backlight unit 34 of the fifth reel 31*d* to emit the light according to a command of said row. When 24.80 seconds elapse from the start of the second scene, the controller stops the fifth reel 31*e* (S7685). In this case, the "7" symbol is rearranged on the fifth payline P5 of the fifth reel 31*e*. Accordingly, the progressive jackpot can be established by the five "7" symbols on the fifth payline P5.

As described above, according to an embodiment of the present invention, the reels 31*a* to 31*e* can be operated in synchronization with a time. Further, the rendering device such as the backlight unit 34 can be operated in synchronization with the time such that it can be operated in synchronization with the operation of the reels 31*a* to 31*e*. In this case, if the music is played according to the time, the reels 31*a* to 31*e* and/or the rendering device can be operated in synchronization with the music.

Further, for rendering the above effect, the user can input commands for controlling the reels 31*a* to 31*e* and/or the rendering device to the predefined columns of the data sheet based on the time. In this case, the time can be input to the data sheet as a triggering condition. Accordingly, the gamine machine can execute the commands of the rows according to the triggering condition.

On the other hand, while the start of the music is used as one triggering condition (Trigger 1) in the example shown in FIG. 67 to FIG. 75, another condition may be used as one triggering condition (Trigger 1). For example, as shown in FIG. 77, a stop of the second reel 31*b* may be used as one triggering condition (Trigger 1) since the second scene starts after the stop of the second reel 31*b*. Alternatively, if a timer for counting the time is started when the second scene starts, a start of the timer may be used as one triggering condition (Trigger 1) as shown in FIG. 78.

Further, the gaming machine 1 can be easily developed by using the data sheets according to an embodiment of the present invention. Now, a gaming machine development system and method according to an embodiment of the present invention is described with reference to FIG. 79 to FIG. 81.

Figure 79:
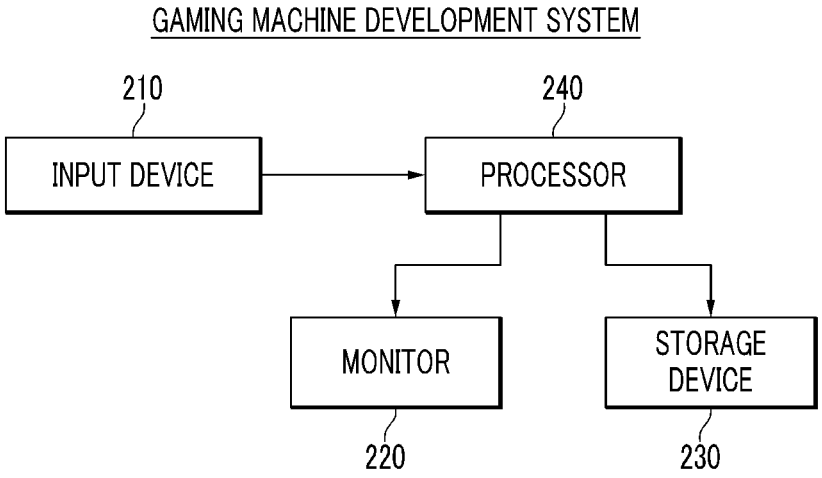
FIG. 79 is a schematic diagram of a gaming machine development system according to an embodiment of the present invention
Figure 80:
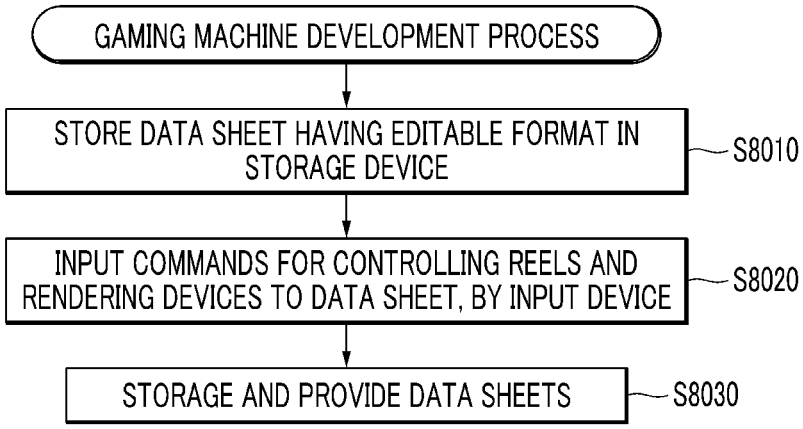
FIG. 80 and FIG. 81 are a flowchart of a game machine development method according to embodiments of the present invention.
Figure 81:
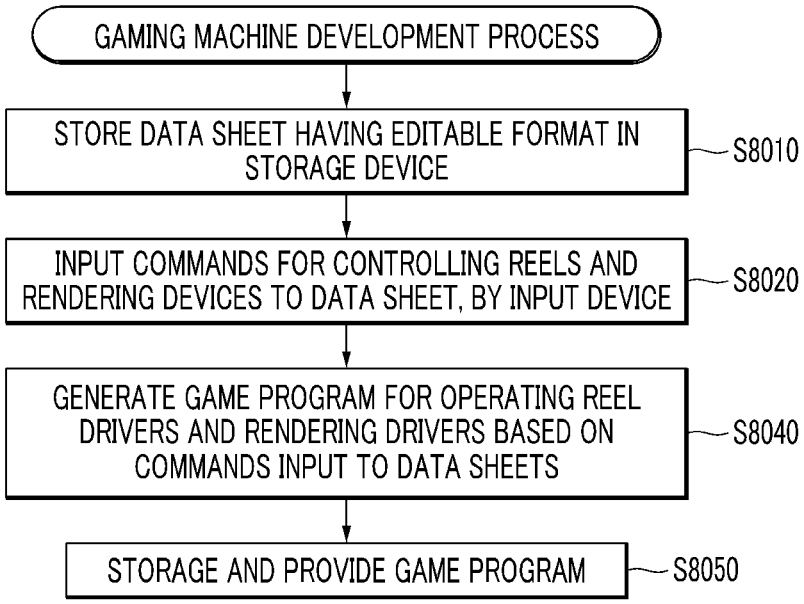

FIG. 79 is a schematic diagram of a gaming machine development system according to an embodiment of the present invention, and FIG. 80 and FIG. 81 are a flowchart of a game machine development method according to embodiments of the present invention.

Referring to FIG. 79, a gaming machine development system includes an input device 210 for receiving an input from a user, a monitor 220 for displaying an interface for a development tool, a storage device 230 for storing data sheet having an editable format, and a processor 240. The editable format may be, for example, CSV format. The input device 210 inputs commands to the data sheet stored in the storage device 230. The processor 240 loads the development tool to provide a data sheet stored in the storage device 230. Further, the processor 240 generates a data sheet according to the commands input by the input device 210, or generates a game program based on the data sheet to which the commands are input. The gaming machine development system may be a computer for developing a program operating the gaming machine 1.

Referring to FIG. 80, the storage device 230 of a gaming machine development system stores and provides a data sheet having an editable format (S8010). The monitor 220 of the gaming machine development system displays the data sheet stored in the storage device 230 through an interface for the development tool. The input device 210 of the gaming machine development system inputs commands for controlling a plurality of reels 31*a* to 31*e* and a rendering device and a triggering condition for executing each of the commands in synchronization with music, to corresponding rows and columns of the data sheet stored in the storage device 230 (S8020).

As described above, the columns are predefined to be associated with the reels 31*a* to 31*e* and the rendering device, and an execution order of row is defined based on a scene number (a priority) and a triggering condition. Accordingly, the user can easily synchronize operations of the reels 31*a* to 31*e* and rendering effect such as the visual effect and the sound effect even though the user is not a programming expert. An operation of the rendering effect can be quickly checked and modified after the rendering effect is generated. Further, the user can easily and quickly debug the data sheet by checking the commands input to the rows and columns such that reliability of the data sheet can be improved. Furthermore, since some of the commands include a control file such as a reel control file can be reused for other data sheets or other gaming machines.

In addition, the processor 240 stores data sheets to which the commands are input to the storage device 230, and provides the stored data sheets to the gaming machine 1 (S8030). Accordingly, the gaming machine 1 can select at least one data sheet for a determined rendering pattern from among the data sheets, and can execute the commands of the data sheet using an execution program for the data sheets.

In some embodiments, when executing the commands of the data sheet, the gaming machine 1 may not read tags such as a scene start tag, a scene trigger tag, and a scene end tag of the data sheet. In this case, the gaming machine 1 can identify an execution order of command based on a priority, i.e., a scene number and a triggering condition. In other words, the gaming machine 1 identify that the commands of rows having a scene number of "N" are executed earlier than the commands of rows having a scene number of "N+1". Further, the gaming machine 1 identify that the commands of rows having no triggering condition are executed earlier than the commands having a triggering condition, in the same scene number.

Differently from an embodiment shown in FIG. 80, the gaming machine development system may generate a game program using the data sheets. As shown in FIG. 81, the processor 240 generates the game program for controlling the reels 31*a* to 31*e* and the rendering device, based on the data sheets (S8040). For example, the processor 240 may compile the commands of the data sheets using a basic program having a plurality of subroutines. Since the commands can be simply input to the data sheet, the game program can be easily generated to control the reels 31*a* to 31*e* and the rendering device.

In some embodiments, when compiling the commands of the data sheets, the processor 240 may not read tags such as a scene start tag, a scene trigger tag, and a scene end tag of the data sheet. In this case, the processor 240 can identify an execution order of command based on a priority, i.e., a scene number and a triggering condition. In other words, the processor 240 identify that the commands of rows having a scene number of "N" are executed earlier than the commands of rows having a scene number of "N+1". Further, the processor 240 identify that the commands of rows having no triggering condition are executed earlier than the commands having a triggering condition, in the same scene number.

Next, the processor 240 stores the generated game program in the storage device 230 of the gaming machine development system, and provides the game program to the gaming machine 1 (S8050). When controlling the reels 31*a* to 31*e* and the rendering device, the game program may extract commands of the data sheet based on the index set to each cell or each column, and may control the reels 31*a* to 31*e* and the rendering device according an order of execution. Further, as shown in FIG. 11, since a body PCB 97 that directly exchanges control signals with a main CPU 91 controls the reel driver and the rendering driver using the commands and the program along with the main CPU 91, the reel drivers and the rendering drivers can quickly process the commands.

Embodiments of the present invention can also be embodied as a computer readable program on a computer-readable recording medium. The computer readable recording medium is any data storage device that can store data that can be read thereafter by a computer. Examples of the computer readable recording medium include ROMs, RAMs, CD-ROMs, magnetic tapes, floppy disks, and optical data storage devices. The computer readable recording medium can also be distributed over a network coupled computer system so that the computer readable code is stored and executed in a distributed fashion.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. A gaming machine comprising:

a plurality of reels, each configured to spin and rearrange a plurality of symbols in a game;

a memory configured to store a program corresponding to a data sheet including a plurality of rows and a plurality of columns, wherein the plurality of columns include a reel field being predefined to be associated with the reels and including a command for controlling the reels and a trigger field including a triggering condition for executing a command of a corresponding row, and trigger fields for a plurality of rows include a plurality of predefined times as the triggering condition, respectively; and a controller configured to determine a result of the game and to control the reels, at each of the predefined times, according to the command of a row having each of the predefined times as the triggering condition when it is determined that the result of the game satisfies a predetermined condition.

2. The gaming machine of claim 1, further comprising a speaker configured to output music at a predetermined time when the result of the game satisfies the predetermined condition, wherein the plurality of predefined times are synchronized with the music.

3. The gaming machine of claim 2, wherein each of the trigger fields further includes a start of the music as the triggering condition.

4. The gaming machine of claim 1, further comprising a backlight unit for the reels, wherein the plurality of columns further include a light field being predefined to be associated with the backlight unit and including a command for controlling the backlight unit, and wherein the controller is configured to control the backlight to emit light, at each of the predefined times, according to the command of the row having each of the predefined times as the triggering condition.

5. The gaming machine of claim 1, wherein the command of the reel field includes a control file including information for controlling the reels, and wherein the information includes a spin speed of each of the reels and a spin time of each of the reels.

6. The gaming machine of claim 1, wherein the controller is configured to spin the reels at a first speed when the game is started, and to start to spin a first reel of the reels at a second speed that is lower than the first speed, at a first time of the predefined times.

7. The gaming machine of claim 6, wherein the controller is configured to start to spin the first reel by one symbol each time a predetermined period elapses, at a second time of the predefined times, the second time being later than the first time.

8. The gaming machine of claim 7, wherein the controller is configured to start to spin a second reel of the reels at the second speed, at a third time of the predefined times, the second reel being next to the first reel and the third time being later than the second time.

9. The gaming machine of claim 8, wherein the controller is configured to start to spin the second reel by one symbol each time the predetermined period elapses, at a fourth time of the predefined times, the fourth time being later than the third time.

10. A gaming method by a controller of a gaming machine including a plurality of reels each configured to spin and rearrange a plurality of symbols in a game and a memory, the method comprising:

storing a program corresponding a data sheet including a plurality of rows and a plurality of columns, wherein the plurality of columns include a reel field being predefined to be associated with the reels and including a command for controlling the reels and a trigger field including a triggering condition for executing a command of a corresponding row, and trigger fields for a plurality of rows include a plurality of predefined times as the triggering condition, respectively;

executing a game to spin the reels;

determining a result of the game; and controlling the reels, at each of the predefined times, according to the command of the reel field for a row having each of the predefined times as the triggering condition when it is determined that the result of the game satisfies a predetermined condition.

11. The method of claim 10, wherein the gaming machine further includes a speaker configured to output music at a predetermined time when the result of the game satisfies the predetermined condition, wherein the plurality of predefined times are synchronized with the music.

12. The method of claim 10, wherein each of the trigger fields further includes a start of the music as the triggering condition.

* * * * *